US008177211B2

(12) United States Patent
Iguchi et al.

(10) Patent No.: US 8,177,211 B2
(45) Date of Patent: May 15, 2012

(54) SHEET FOLDING APPARATUS, IMAGE FORMING APPARATUS USING THE SAME, AND SHEET FOLDING METHOD

(75) Inventors: Ken Iguchi, Shizuoka-Ken (JP); Takahiro Kawaguchi, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/271,062

(22) Filed: Oct. 11, 2011

(65) Prior Publication Data

US 2012/0028781 A1 Feb. 2, 2012

Related U.S. Application Data

(63) Continuation of application No. 12/366,467, filed on Feb. 5, 2009, now Pat. No. 8,061,701.

(60) Provisional application No. 61/027,138, filed on Feb. 8, 2008, provisional application No. 61/028,444, filed on Feb. 13, 2008.

(51) Int. Cl.
*B31F 1/10* (2006.01)

(52) U.S. Cl. ..... 270/45; 270/32; 270/51; 493/406

(58) Field of Classification Search ..... 270/32, 270/37, 45, 51; 493/406, 442, 454
See application file for complete search history.

(56) References Cited

U.S. PATENT DOCUMENTS

| | | | | |
|---|---|---|---|---|
| 6,601,846 | B2 | 8/2003 | Saito et al. | |
| 6,905,118 | B2 * | 6/2005 | Yamada et al. | 270/8 |
| 7,147,598 | B2 | 12/2006 | Fujimoto et al. | |
| 7,431,274 | B2 | 10/2008 | Kushida et al. | |
| 7,604,225 | B2 * | 10/2009 | Fukatsu et al. | 270/32 |
| 2004/0070133 | A1 | 4/2004 | Yamada et al. | |
| 2005/0189689 | A1 | 9/2005 | Kushida et al. | |
| 2005/0191154 | A1 | 9/2005 | Fujimoto et al. | |
| 2008/0315481 | A1 | 12/2008 | Iguchi et al. | |
| 2008/0315482 | A1 | 12/2008 | Iguchi et al. | |
| 2008/0315484 | A1 | 12/2008 | Iguchi et al. | |
| 2008/0315485 | A1 | 12/2008 | Iguchi et al. | |
| 2008/0315486 | A1 | 12/2008 | Iguchi et al. | |
| 2008/0315488 | A1 | 12/2008 | Iguchi et al. | |
| 2009/0036287 | A1 | 2/2009 | Kawaguchi et al. | |

FOREIGN PATENT DOCUMENTS

JP 2003-182928 7/2003

* cited by examiner

*Primary Examiner* — Leslie A Nicholson, III
(74) *Attorney, Agent, or Firm* — Patterson & Sheridan, LLP

(57) ABSTRACT

A sheet folding apparatus includes: a saddle-stitching unit configured to stitch a center of a sheet bundle; a folding unit configured to fold the sheet bundle at the center to form a fold; a loading base onto which the sheet bundle conveyed from the folding unit is loaded; a nipping plate configured to be pressed to and separated from the loading base in parallel to the loading base and to nip the sheet bundle loaded onto the loading base; and first and second rollers that move along a direction of the fold while nipping and pressing the fold of the sheet bundle nipped by the nipping plate to reinforce the fold. Here, a surface, which faces the loading base, of the nipping plate is provided with an elastic member.

20 Claims, 41 Drawing Sheets

(B)

(A)

ROLLER UNIT (MOVING TO REINFORCE FOLD)

ROLLER UNIT (HOME POSITION)

SHEET FOLDING APPARATUS, IMAGE FORMING APPARATUS USING THE SAME, AND SHEET FOLDING METHOD

CROSS-REFERENCE TO RELATED APPLICATIONS

This application is a continuation of U.S. patent application Ser. No. 12/366,467, filed Feb. 5, 2009, which is based upon and claims the benefit of priority from: U.S. provisional applications 61/027,138, filed on Feb. 8, 2008, and 61/028,444, filed on Feb. 13, 2008, the entire contents of each of which are incorporated herein by reference.

TECHNICAL FIELD

Disclosed herein relates to a sheet folding apparatus, an image forming apparatus using the sheet folding apparatus, and a sheet folding method, and more particularly, to a sheet folding apparatus stitching and folding printed sheets, an image forming apparatus using the sheet folding apparatus, and a sheet folding method.

BACKGROUND

Hitherto, a sheet finisher is known which is disposed downstream of an image forming apparatus such as a copier, a printer, or a multi-function peripheral (MFP) and performs finishing such as punching or stitching on printed sheets.

Recently, functions of a sheet folding apparatus has been diversified, and the sheet folding apparatus (the sheet finisher) has been developed suggested which has, in addition to the punching and stitching functions, a folding function of folding a part of a sheet and a saddle-stitching and folding function of stitching the center of a sheet with staples and then folding the sheet at the center (see JP-A-2004-106991, JP-A-2003-182928, etc.).

The sheet folding apparatus having the saddle-stitching and folding function can form a booklet (bind a book) from plural printed sheets.

In the saddle-stitching and folding suggested hitherto, the center of sheets is stitched with staples or the like and then the stitched portion is creased and folded by a pair of rollers called folding rollers. At this time, a plate-like member called a folding blade is applied to the stitched portion of the sheet bundle and is pushed into a nip of the folding roller pair to crease the sheet bundle.

However, a time when the folded portion of the sheet bundle is pressed by the nip of the folding rollers is short and the entire folded portion is simultaneously pressed by the nip of the folding rollers. Accordingly, the pressure is dispersed to the entire fold. Thus, the fold formed by the folding rollers is a fold to which a sufficient pressure is not applied. Particularly, when the number of sheets is large or when the sheet bundle includes a thick sheet, an incomplete fold is often formed.

In order to deal with this problem, JP-A-2004-106991 or JP-A-2003-182928 discloses a technique of separately providing a roller called a fold reinforcing roller and reinforcing the fold formed by the folding rollers with the fold reinforcing roller.

In the technique disclosed in JP-A-2004-106991 or JP-A-2003-182928, the sheet bundle pushed out from the folding rollers is temporarily stopped on a guide plate and the fold reinforcing roller is made to move along the fold while applying a pressure from above to the fold of the sheet bundle. The fold nipped between the guide plate and the fold reinforcing roller is reinforced by the pressure generated between the guide plate and the fold reinforcing roller.

In addition, JP-A-2003-182928 discloses a technique of making a moving speed of the fold reinforcing roller variable depending on the number of sheets to be processed.

However, in the technique disclosed in JP-A-2004-106991 or JP-A-2003-182928, since the pressure is applied to the fold between the fold reinforcing roller and the plane guide plate, it is anticipated that the pressing force of the fold reinforcing roller is diffused by the plane guide plate and thus the pressure to reinforce the fold is not effectively applied to the fold.

A method is conceivable in which a fold in the nip of a pair of fold reinforcing rollers is reinforced by allowing the pair of fold reinforcing rollers to move along the fold with the fold interposed therebetween while applying a pressure to the nip. In this method, since the force of pressing the pair of fold reinforcing rollers to each other can be concentrated on one point of the nip, the high pressure can be generated at the nip, thereby more effectively reinforcing the fold.

Specifically, one fold reinforcing roller (first roller) of the pair can be made to freely rotate in a state where the position is fixed in the thickness direction of a sheet bundle. Meanwhile, the other fold reinforcing roller (second roller) of the pair can be made to freely rotate similarly to the first roller, and can be made to move in the thickness direction while applying an urging force by an elastic member such as a spring in the thickness direction of the sheet bundle.

By applying a strong urging force to the first and second rollers, it is possible to form an excellent fold sharp and not unfolded again.

However, since the urging force applied to the first and second rollers is strong, an impact sound not negligible is generated when the first and second rollers come in contact with each other in an area not having the sheet bundle or when the first and second rollers come in contact with each other in a state where no sheet bundle exists such as in an initial operation.

SUMMARY

An aspect of the disclosure is a sheet folding apparatus including: a saddle-stitching unit configured to stitch a center of a sheet bundle; a folding unit configured to fold the sheet bundle at the center to form a fold; a loading base onto which the sheet bundle conveyed from the folding unit is loaded; a nipping plate configured to be pressed to and separated from the loading base in parallel to the loading base and to nip the sheet bundle loaded onto the loading base; and first and second rollers that move along a direction of the fold while nipping and pressing the fold of the sheet bundle nipped by the nipping plate to reinforce the fold. Here, a surface, which faces the loading base, of the nipping plate is provided with an elastic member.

Another aspect of the disclosure is an image forming apparatus including: a reading section reading an original document and generating image data; an image forming section printing the image data on a sheet; a saddle-stitching unit configured to stitch a center of a sheet bundle; a folding unit configured to fold the sheet bundle at the center to form a fold; a loading base onto which the sheet bundle conveyed from the folding unit is loaded; a nipping plate configured to be pressed to and separated from the loading base in parallel to the loading base and to nip the sheet bundle loaded onto the loading base; and first and second rollers that move along a direction of the fold while nipping and pressing the fold of the sheet bundle nipped by the nipping plate to reinforce the fold.

Here, a surface, which faces the loading base, of the nipping plate is provided with an elastic member.

Still another aspect of the disclosure a sheet folding method including: stitching a center of a sheet bundle; folding the sheet bundle at the center to form a fold; loading the sheet bundle conveyed from the folding unit onto a loading base; pressing a nipping plate, a surface of which facing the loading base is provided with an elastic member, against the loading base in parallel to the loading base and nipping the sheet bundle loaded onto the loading base; and nipping and pressing the fold of the sheet bundle nipped by the nipping plate by the use of first and second rollers and allowing the first and second rollers to move along a direction of the fold to reinforce the fold.

DESCRIPTION OF THE DRAWINGS

In the accompanying drawings.

DETAILED DESCRIPTION

A sheet folding apparatus, an image forming apparatus, and a sheet folding method will be described with reference to the accompanying drawings.

(1) Configuration of Image Forming Apparatus and Sheet Folding Apparatus

Figure 1:
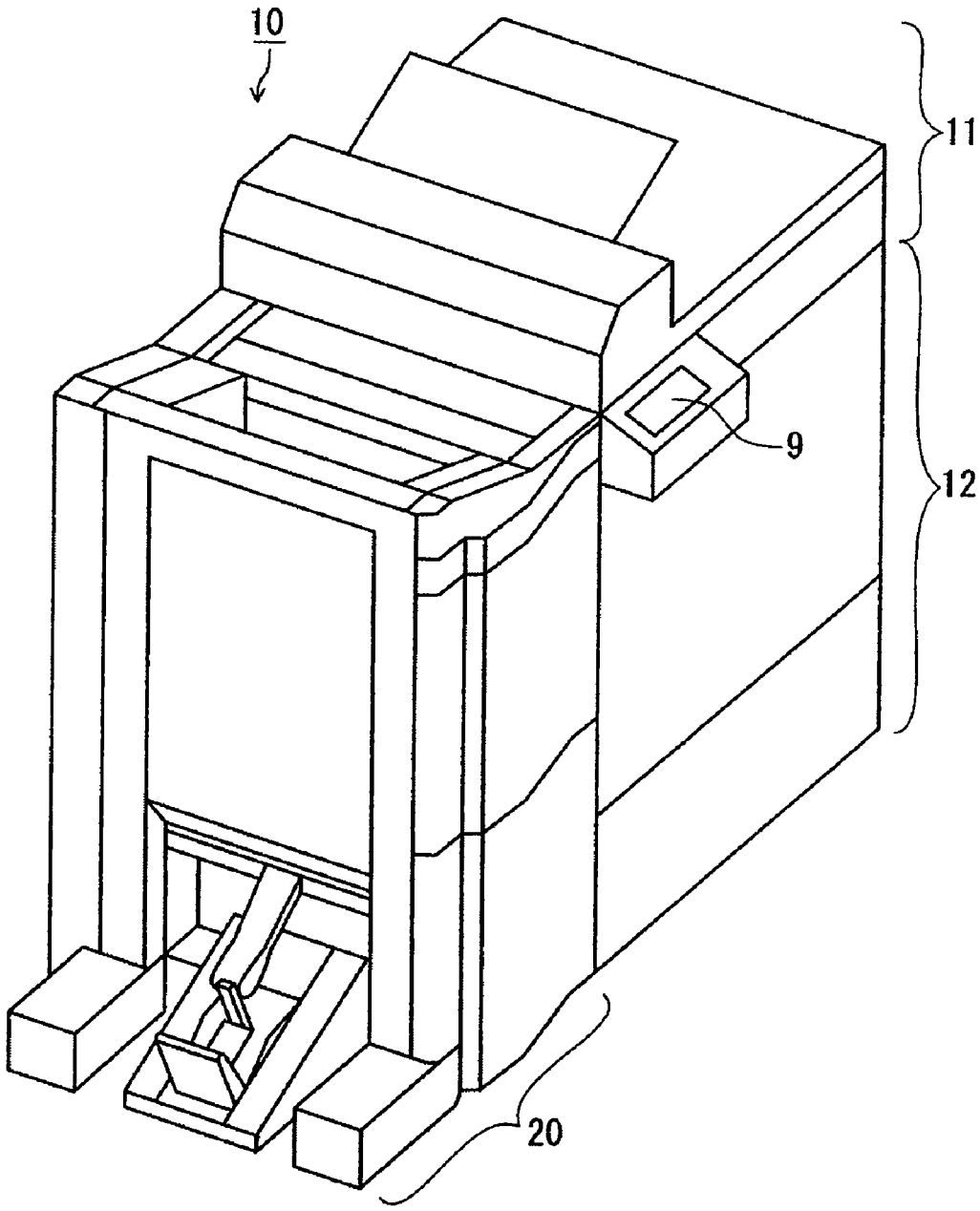
FIG. 1 is a perspective view illustrating an appearance of an image forming apparatus.

FIG. 1 is an appearance perspective view illustrating a basic configuration of an image forming apparatus 10. The image forming apparatus 10 includes a reading section 11 reading an original document, an image forming section 12 printing image data of the read original document on a sheet in an electrophotographic manner, and a sheet folding apparatus 30 performing finishing such as sorting, punching, folding, or saddle-stitching on the printed sheet. The image forming section 12 includes an operation section 9 by which a user performs various operations.

Figure 2:
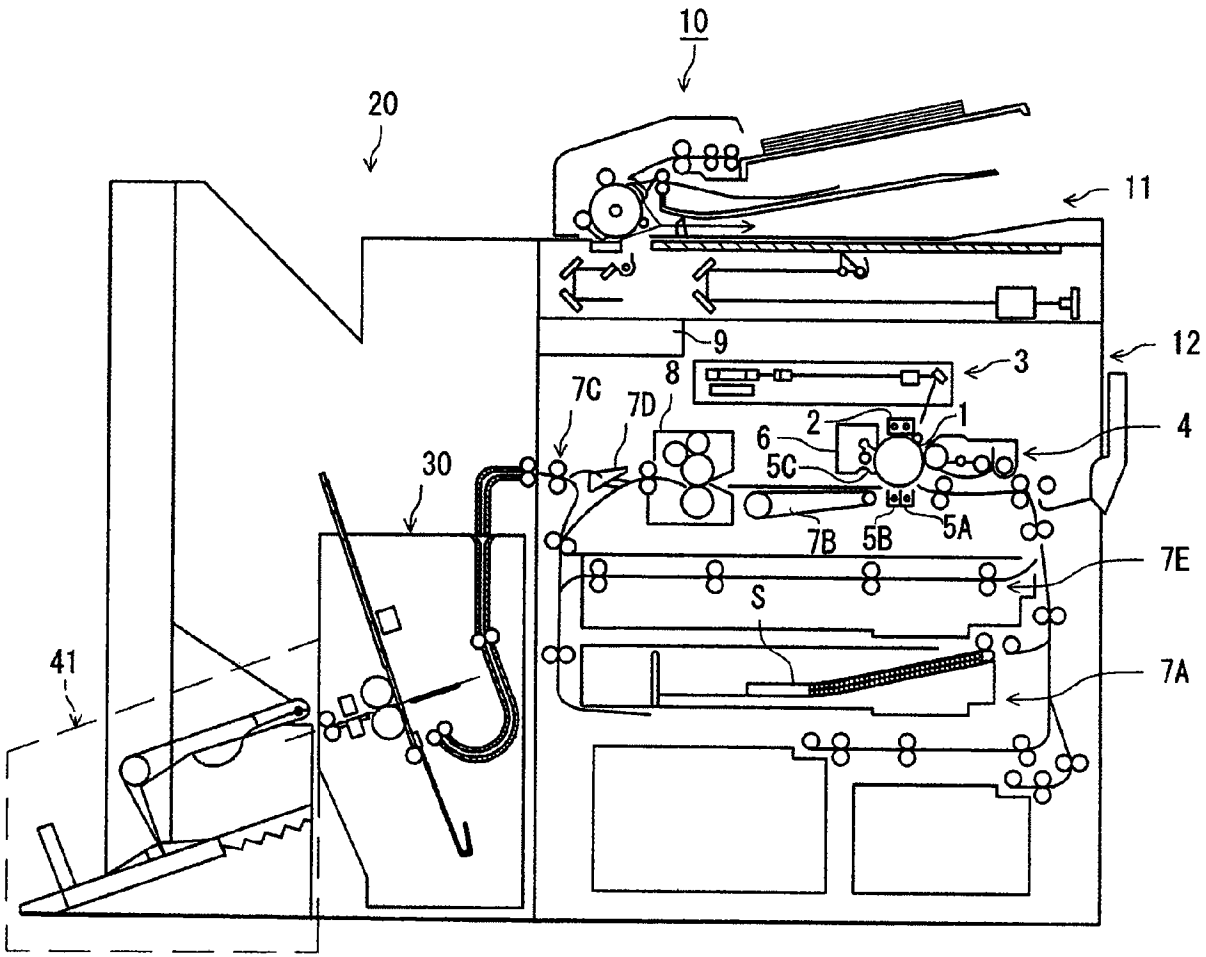
FIG. 2 is a sectional view illustrating a configuration of the image forming apparatus.

FIG. 2 is a sectional view illustrating a detailed configuration of the image forming apparatus 10.

The image forming section 12 of the image forming apparatus 10 includes a photoconductive drum 1 at the center. A charging unit 2, an exposure unit 3, a developing unit 4, a transfer unit 5A, a charge removing unit 5B, a separation pawl 5C, and a cleaning unit 6 are respectively disposed around the photoconductive drum 1. Besides, a fixing unit 8 is disposed downstream of the charge removing unit 5B. An image forming process is performed by these units roughly in the following procedure.

First, the charging unit 2 uniformly charges the surface of the photoconductive drum 1. An original document read by the reading section 11 is converted into image data and is inputted to the exposure unit 3. The exposure unit 3 applies a laser beam corresponding to the level of the image data to the photoconductive drum 1 to form an electrostatic latent image on the photoconductive drum 1. The electrostatic latent image is developed with toner supplied from the developing unit 4 and a toner image is formed on the photoconductive drum 1.

Meanwhile, a sheet contained in a sheet containing unit 7A is conveyed to a transfer position (a gap between the photoconductive drum 1 and the transfer unit 5A) by some conveyance rollers. At the transfer position, the toner image is transferred from the photoconductive drum 1 to the sheet by the transfer unit 5A. Electric charges on the surface of the sheet to which the toner image is transferred are removed by the charge removing unit 5B. Then, the sheet goes away from the photoconductive drum 1 by the separation pawl 5C. Thereafter, the sheet is conveyed by an intermediate conveyance unit 7B and is heated and pressed by the fixing unit 8 so that the toner image is fixed to the sheet. The sheet subjected to the fixing process is discharged from a discharge section 7C and is outputted to a sheet finisher 20.

The cleaning unit 6 located downstream of the separation pawl 5C removes the developer remaining on the surface of the photoconductive drum 1 and prepares for a next image formation.

When duplex printing is performed, a path of the sheet on the front side of which the toner image is formed is made to branch from a normal discharge path by a conveyance path switching plate 7D and the sheet is switched back by an inversion conveyance section 7E to invert the front and back sides. The same printing as a single-side printing is performed on the back side of the inverted sheet and the sheet is outputted to the sheet finisher 20 from the discharge section 7C.

The sheet finisher 20 includes a sheet folding apparatus 30 and a sheet bundle loading section 41 in addition to a sorter section sorting sheets.

The sheet folding apparatus 30 performs a process of (saddle-stitching) stitching the center of plural printed sheets discharged from the image forming section 12 with staples and then folding the sheets to form a booklet.

The booklet subjected to the saddle-stitching by the sheet folding apparatus 30 is outputted to the sheet bundle loading section 41 and the bound booklet is finally loaded thereon.

Figure 3:
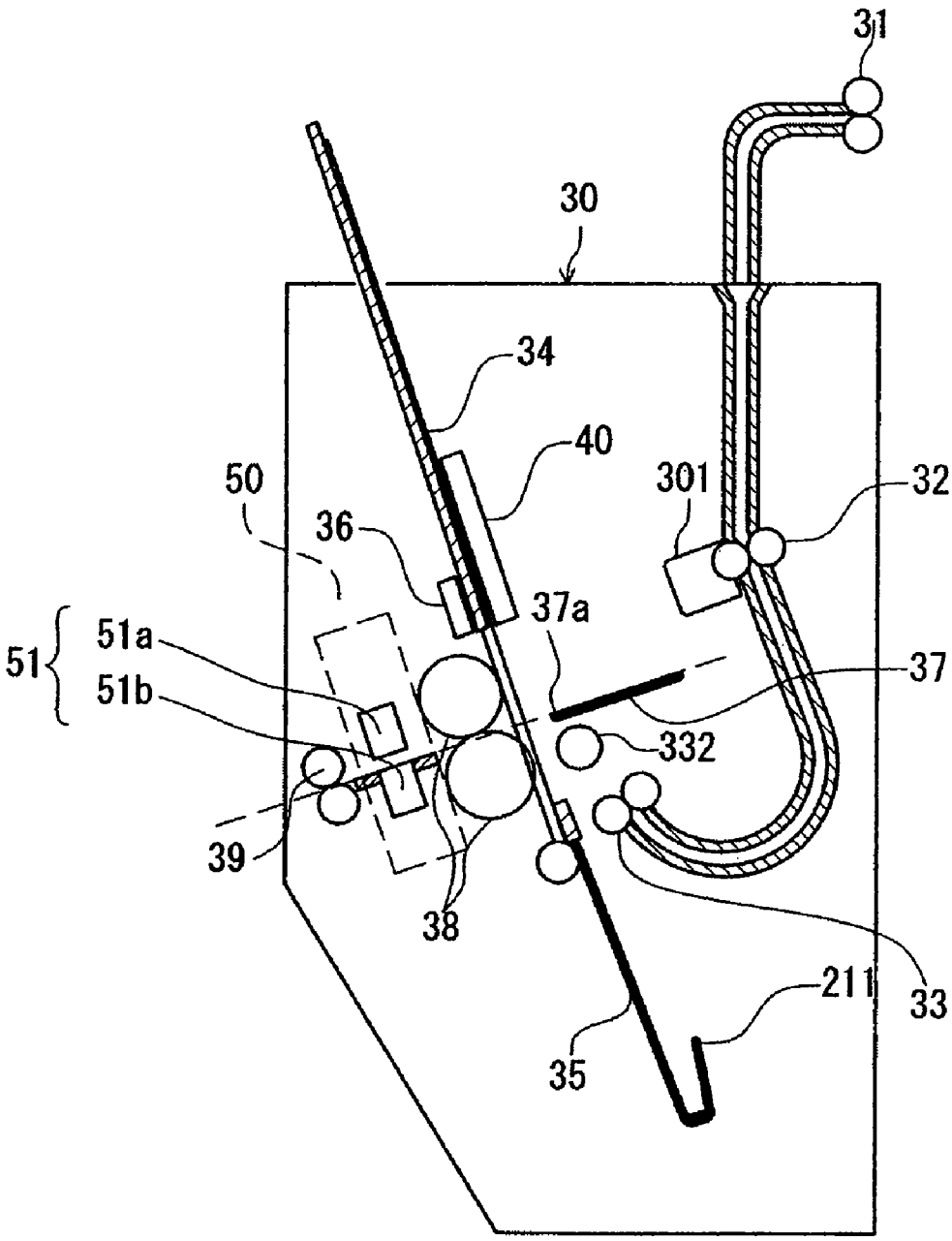
FIG. 3 is a sectional view illustrating a configuration of a sheet folding apparatus.
Figure 4:
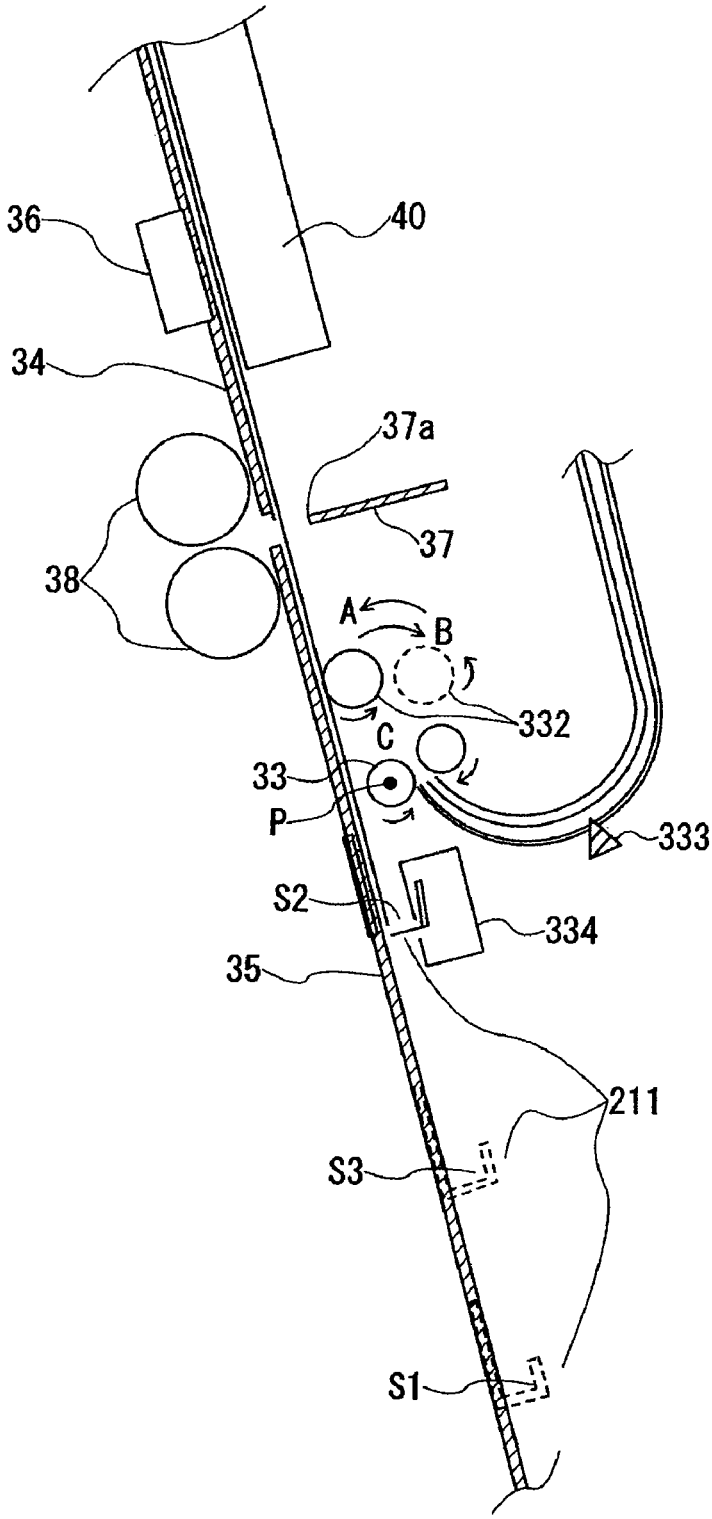
FIG. 4 is an enlarged sectional view illustrating a part of the sheet folding apparatus.

FIG. 3 is a sectional view showing a detailed configuration of the sheet folding apparatus 30. FIG. 4 is an enlarged sectional view illustrating a part of the sheet folding apparatus 30.

In the sheet folding apparatus 30, the sheet discharged from the discharge section 7C of the image forming section 12 is received by an inlet roller pair 31 and is delivered to an intermediate roller pair 32. The intermediate roller pair 32 further delivers the sheet to an outlet roller pair 33. The outlet roller pair 33 sends the sheet to a stack tray 34 having an inclined loading surface. The leading edge of the sheet moves to an upper part of the inclination of the stack tray 34.

As shown in FIG. 4, an assist roller 332 is disposed at an end of the outlet roller pair 33.

The sheet folding apparatus 30 includes a conveyance motor 301 (see FIG. 3). The conveyance motor 301 drives the outlet roller pairs 33 or the assist roller 332 via a timing belt not shown in synchronization with each other.

When the sheet is sent to the stack tray 34, the assist roller 332 is located at a position indicated by the broken line so as not to interfere with the sending of the sheet.

A discharge sensor 333 is disposed in a conveyance path of a sheet and detects a passage of the leading edge and the trailing edge of the sheet passing through the conveyance path. When the discharge sensor 333 detects the passage of the trailing edge of the sheet, it is determined that the sheet is completely sent to the stack tray 34 in a predetermined time after that time, and the position of the assist roller 332 is made to move in the direction of arrow A around a supporting point P. With this movement, the assist roller 332 comes in contact with the sheet sent to the stack tray 34.

The assist roller 332 is made to rotate in the direction of arrow C by the conveyance motor 301 and allows the sheet on the stack tray 34 to move down. The surface of the assist roller 332 is covered with a sponge or the like and can allow the sheet to move down without being damaged.

A stacker 35 stands by below the stack tray 34 having a stack pawl 211 and receives the lower edge of the sheet which is pressed down from the upper part of the inclination of the stack tray 34 by the assist roller 332.

When a subsequent sheet is sent to the stack tray 34, the assist roller 332 moves back in the direction of arrow B. The reciprocation of the assist roller 332 in the directions of arrow A and arrow B is carried out with a pulling force of a solenoid 334 and a restoring force of a spring coil not shown.

In this way, sheets are sequentially accumulated on the stacker 35. At this time, a longitudinal alignment of sheets is sequentially carried out with the pressing-down of the assist roller 332. When the number of sheets reaches the number instructed from the operation section 9, a lateral alignment is carried out by a lateral alignment unit 40.

A stapler (saddle-stitching unit) 36 is disposed at the middle of the stack tray 34. When the sheets are received by the stack tray 34, the position of the stacker 35 rises up from a standby position S1 shown in FIG. 4 to a sheet receiving position S2. The sheet receiving position S2 is adjusted so that the position (the center of a sheet bundle in the vertical direction) where the sheet bundle is to be stapled faces the stapler 36.

When the sheet bundle is saddle-stitched by the stapler 36, the stacker 35 moves down until the position (the center of the sheet bundle in the vertical direction and the position where staples were driven) where a fold of the sheet bundle is to be formed reaches the front of a folding blade 37 (a folding position S3 in FIG. 4).

When the position where the fold is to be formed reaches the front of the folding blade 37, an end 37*a* of the folding blade 37 pushes the surface which is to be a inner surface of the folded sheet bundle.

A folding roller pair 38 is disposed at the forward of the folding blade 37 in the traveling direction thereof. The sheet bundle pushed by the folding blade 37 is inserted into a nip of the folding roller pair 38 to form a fold at the center of the sheet bundle. The folding unit is constituted by the folding blade 37 and the folding roller pair 38.

The sheet bundle on which the fold is formed by the folding roller pair 38 is conveyed to a fold reinforcing unit 50 disposed downstream thereof. The sheet bundle conveyed to the fold reinforcing unit 50 is temporarily stopped there.

The fold reinforcing unit 50 includes a fold reinforcing roller pair 51 (an upper roller (second roller) 51*a* and a lower roller (first roller) 51*b*). The fold reinforcing roller pair 51 moves in a direction perpendicular to the conveyance direction of the sheet bundle (direction along the fold) while applying a pressure to the fold, thereby reinforcing the fold.

The sheet bundle of which the fold is reinforced by the fold reinforcing unit 50 starts again its conveyance and is guided and output to the sheet bundle loading section 41 by a discharge roller pair 39. The saddle-stitched sheet bundle (booklet) is loaded on the sheet bundle loading section 41.

(2) Lateral Alignment Unit

Figures 5A, 5B:
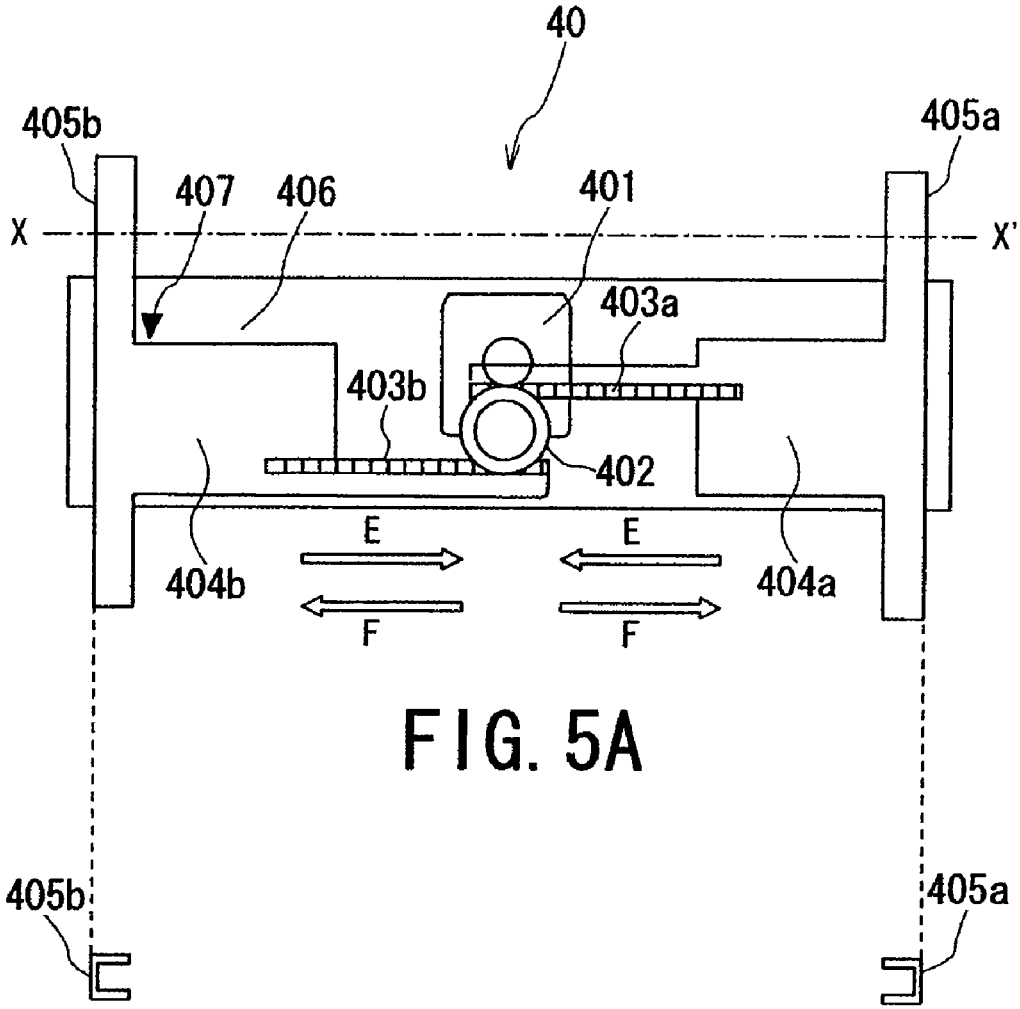
FIGS. 5A and 5B are a front view and a plan view illustrating a configuration of a lateral alignment unit, respectively.

FIG. 5A is a front view illustrating a configuration of the lateral alignment unit 40 and FIG. 5B is a plan view as cut plane X-X' is viewed from the upside.

The lateral alignment unit 40 includes a lateral alignment motor 401 which is a stepping motor, a gear 402, movable frames 404*a* and 404*b* to which racks 403*a* and 403*b* are fixed, respectively, lateral alignment plates 405*a* and 405*b* disposed at both ends of the movable frames, and a support frame 406 supporting these.

The lateral alignment motor 401 allows the gear 402 to rotate in clockwise and counterclockwise directions. The gear 402 engages with the racks 403*a* and 403*b* and thus the racks 403*a* and 403*b* move in the directions of arrow E and arrow F shown in FIG. 5A with the rotation of the gear 301. The lateral alignment plates 405*a* and 405*b* move in a direction perpendicular to the sheet conveying direction with the movement of the racks 403*a* and 403*b*. When the gear 402 rotates in the clockwise direction in FIG. 5A, the lateral alignment plates 405*a* and 405*b* move in the direction of arrow F (opening direction). When the gear 402 rotates in the counterclockwise direction in FIG. 5A, the lateral alignment plates 405*a* and 405*b* move in the direction of arrow E (closing direction).

The support frame 406 is provided with a lateral alignment motor HP (Home Position) sensor 407. The position of the lateral alignment plates 405*a* and 405*b* is controlled on the basis of the detection timing of the lateral alignment motor HP sensor 407 and the number of pulses of the lateral alignment motor 401.

Figure 6A:
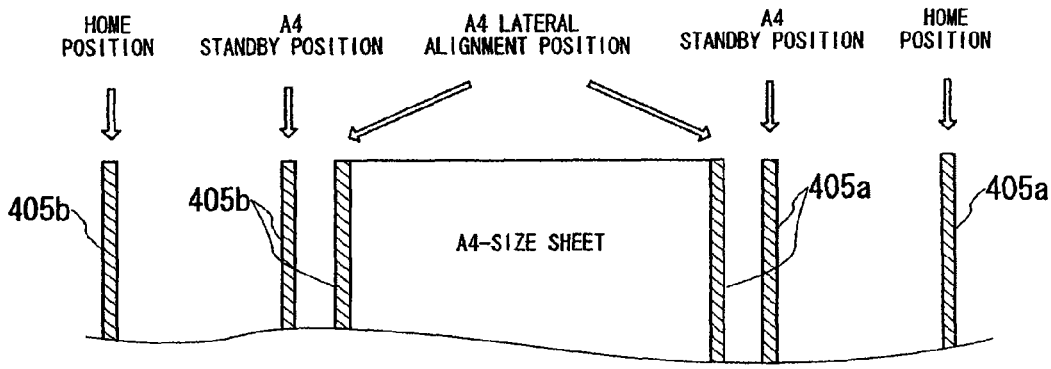
FIGS. 6A and 6B are diagrams illustrating a control position of a lateral alignment plate.
Figure 6B:
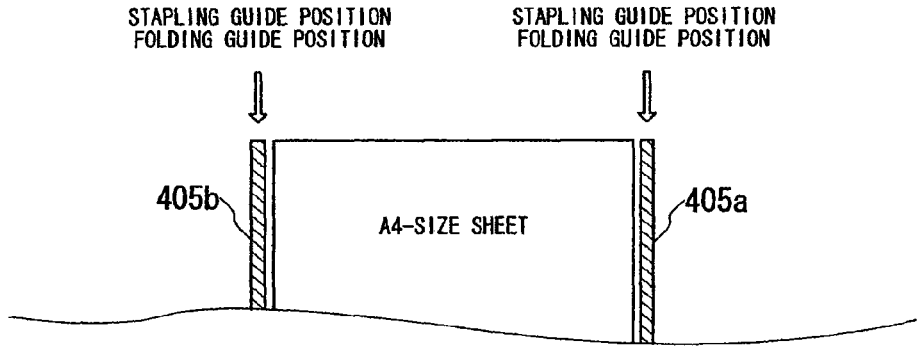

FIGS. 6A and 6B are diagrams illustrating the controlled positions of the lateral alignment plates 405*a* and 405*b*. The home position shown in FIG. 6A is a position detected by the lateral alignment motor HP sensor 407 and the detected position serves as a base of various positions. The standby position is a position which is apart by about 15 mm from both lateral edges of the sheets, though it depends on the size of the sheets. An A4 size is assumed in FIGS. 6A and 6B. When the sheet bundle is actually subjected to the lateral alignment, the lateral alignment plates 405*a* and 405*b* move from the standby position to a position where they come contact with both edges of the sheets.

When the saddle-stitching is performed by the stapler 36 or the folding is performed by pushing the folding blade 37 after the lateral alignment is performed, both edges of the sheet bundle are slightly misaligned. When the saddle-stitching or the folding is performed, the lateral alignment plates 405*a* and 405*b* are made to move to a position (a stapling guide position and a folding guide position) which has a margin by about 1 mm from both edges of the sheet bundle, as shown in FIG. 6B, to absorb the misalignment.

(3) Stacker

Figure 7:
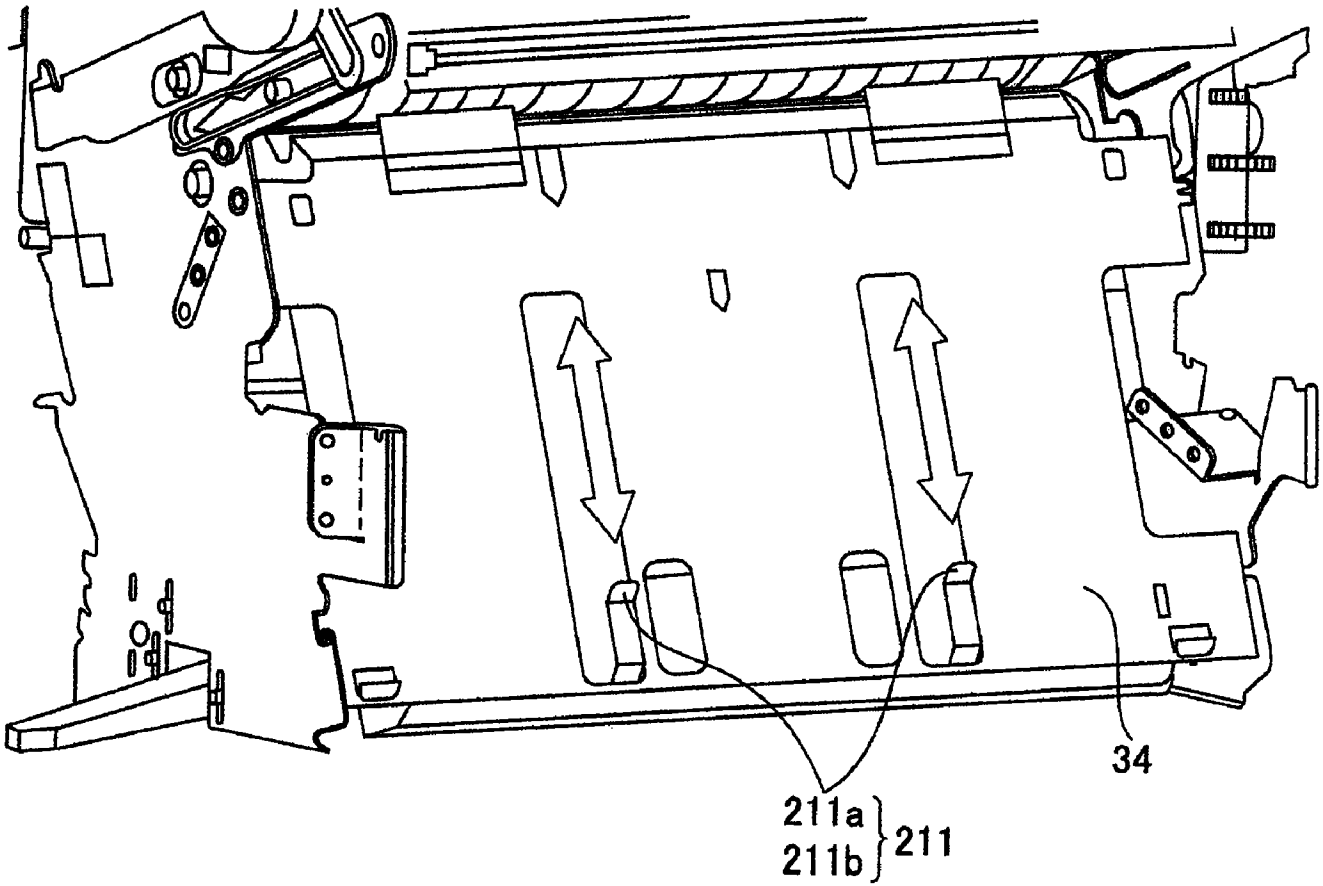
FIG. 7 is a perspective view illustrating a positional relation of a stack tray and a stack click.
Figure 8:
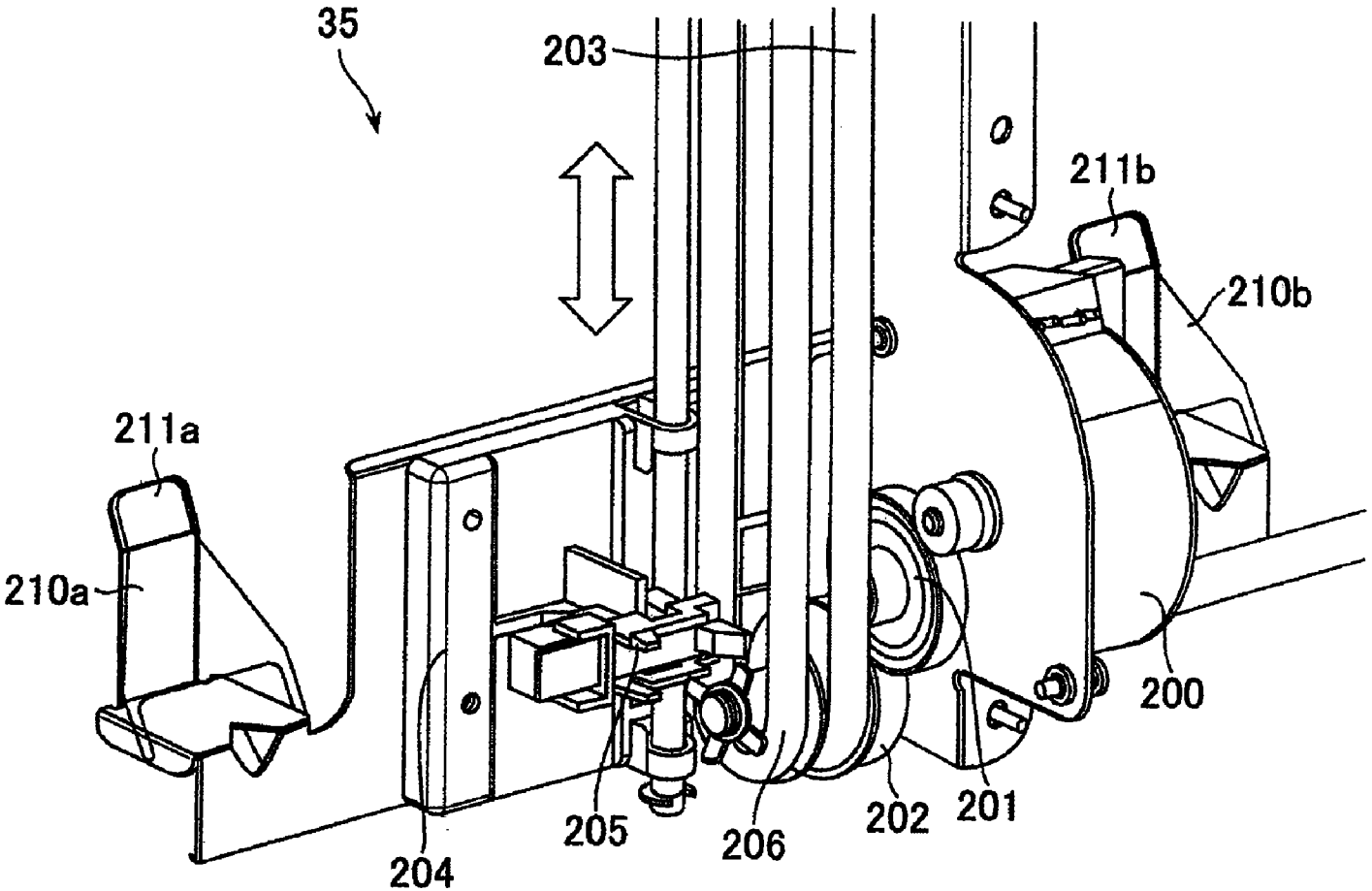
FIG. 8 is a perspective view illustrating a configuration of a stacker.

FIGS. 7 and 8 are diagrams illustrating a configuration of the stacker 35. As shown in FIG. 7, two stack pawls 211 (211*a* and 211*b*) are exposed from the lower side of the stack tray 34. The lower end of the sheet moving down along the stack tray 34 is received by the stack pawls 211 and the sheet bundle including a predetermined number of sheets is supported by the stack pawls 211.

When the saddle-stitching or the folding is performed, the stack pawls 211 are controlled to move along the inclination of the stack tray 34 to a predetermined position.

As shown in FIG. 8, the stacker 35 includes a stacker motor 200 which is a stepping motor, a gear 201, a gear and pulley 202, a driving mechanism including a timing belt 203, stack pawls 211*a* and 211*b*, and a supporting portion 204 supporting these.

The stacker motor 200 allows the gear 201 and the gear and pulley 202 to rotate. The timing belt 203 is suspended on the gear and pulley 202 and the support section 204 fixed to the timing belt 203 is made to move in the arrow direction shown in FIG. 8.

A coil spring 206 serving to prevent the backlash is also suspended on the gear and pulley 202.

The support section 204 includes the stack pawls 211*a* and 211*b*, which move in the arrow direction shown in FIG. 7 with the movement of the support section 204. The stack pawls 211*a* and 211*b* include flexible members 210*a* and 210*b* such as Mylar, respectively, which press and hold the sheet bundle aligned in the stack pawls 211*a* and 211*b* against a reference plane of the stack tray 34.

A stacker motor HP sensor 205 is disposed to control the moving positions of the stack pawls 211*a* and 211*b*. The positions of the stack pawls 211*a* and 211*b* are controlled on the basis of the detection timing of the stacker motor HP sensor 205 and the number of pulses of the stacker motor 200.

(4) Folding Unit

Figure 9:
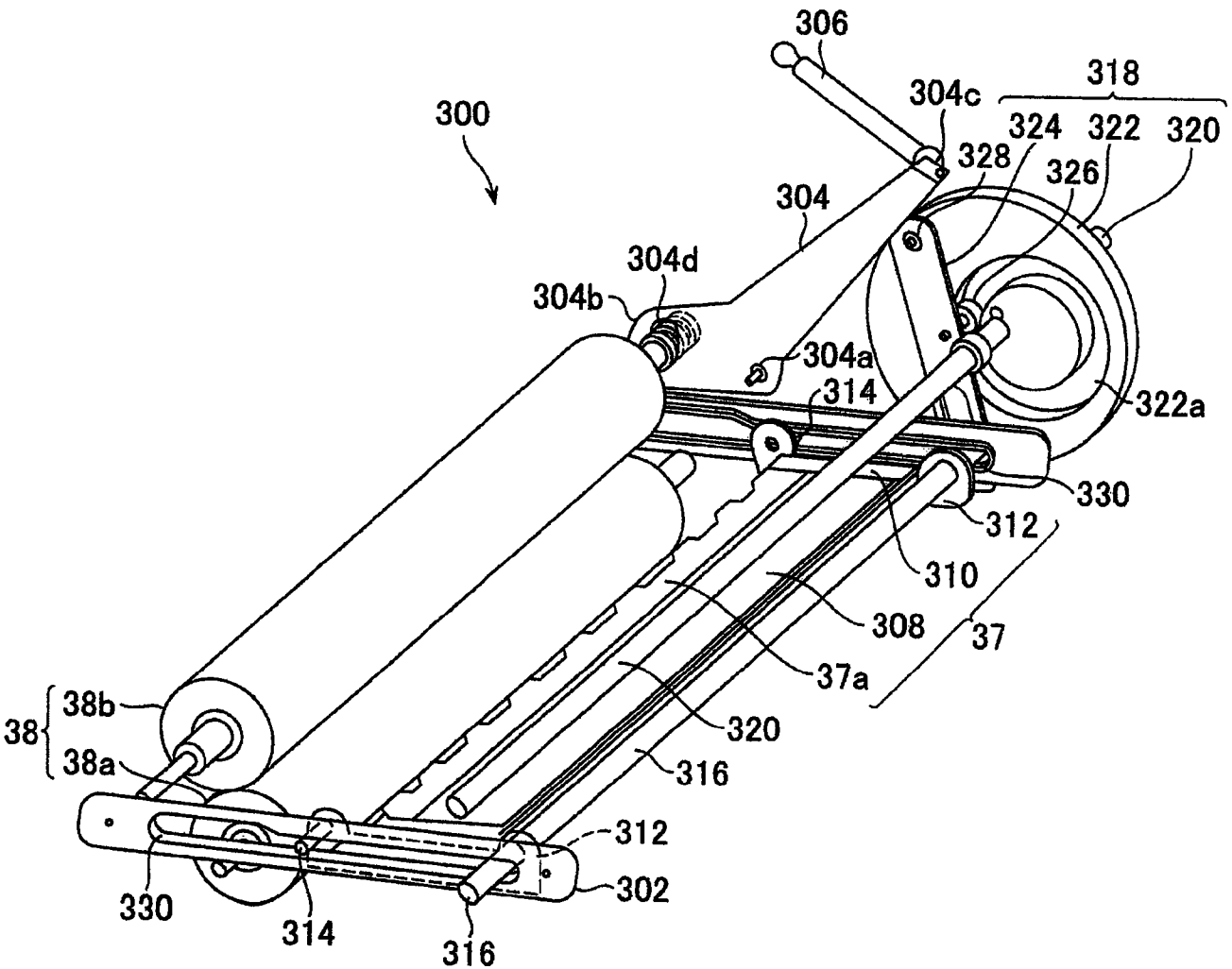
FIG. 9 is a perspective view illustrating a configuration of a folding unit.

FIG. 9 is a diagram illustrating a configuration of a folding unit 300.

The folding unit 300 includes the folding roller pair 38 folding a sheet bundle, the folding blade 37 which is a pressing member pushing the sheet bundle into the nip of the folding roller pair 38, and the guide member 302 holding the folding blade 37 so as to be movable toward the folding roller pair 38 and regulating the fluctuation of the folding blade 37 in the direction perpendicular to the moving direction of the folding blade 37 before pushing the sheet bundle into the nip.

The folding roller pair 38 includes a fixed folding roller 38*a* and a movable folding roller 38*b*. The fixed folding roller 38*a* is rotatably supported by an apparatus frame.

The movable folding roller 38*b* is rotatably supported by one end 304*b* of an arm 304, is movable in the direction perpendicular to the moving direction of the folding blade 37, and can be contacted with and separated from the fixed folding roller 38*a*.

A spring 306 is mounted on other end 304*c* of the arm 304. The movable folding roller 38*b* is urged by the spring 306 via the arm 304 rotating about a supporting point 304*a* and comes in pressing contact with the fixed folding roller 38*a* to form the nip. The one end 304*b* is provided with a first support hole 304*d* allowing the movable folding roller 38*b* to move straightly without drawing an arc when the arm 304 rotates.

The folding blade 37 includes the blade end portion 37*a* pushing a sheet bundle, first and second holding members 308 and 310 holding the blade end portion 37*a* interposed therebetween, and a side plate 312 attached to both ends of the second holding member 310.

A stud 314 is disposed in the front side of the side plate 312, that is, the side facing the folding roller pair 38, and a shaft 316 is disposed in the rear side thereof. The folding blade 37 is slidably held by the guide member 302 via the stud 314 and the shaft 316.

The gap between the stud 314 and the shaft 316 is more stable as it is longer. Accordingly, in this embodiment, the position of the stud 314 is closer to the folding roller pair 38 than to the end of the blade end portion 37*a*. The stud 314 and the shaft 316 as the sliding member are not limited to the above-mentioned configuration, but both may be a stud or a shaft. Alternatively, they may be rotatable rollers. The fixing position of the stud 314 to the side plate 312 is not limited to the above-mentioned configuration.

Both ends of the shaft 316 are provided with a driving mechanism 318 allowing the folding blade 37 to slide. The driving mechanism 318 includes a cam shaft 320, a groove cam 322 having a groove 322*a* and rotating about the cam shaft 320, and a driven member 324. A roller 326 such as a roller follower as a contactor is rotatably guided in the groove 322*a* of the groove cam 322 and the roller 326 is attached to the driven member 324. One end of the driven member 324 is provided with a driven member rotation shaft 328 and the driven member rotation shaft 328 is attached to the apparatus frame. The groove cam 322 is made to rotate by a driving motor connected to one end of the cam shaft 320. When the roller 326 is guided along the groove 322*a* with the rotation of the groove cam 322, the driven member 324 repeats the reciprocation like a pendulum about the driven member rotation shaft 328 due to the eccentricity of the groove 322*a*.

A driving mechanism of the folding roller pair 38 and the folding blade 37 will be described now.

Figure 10:
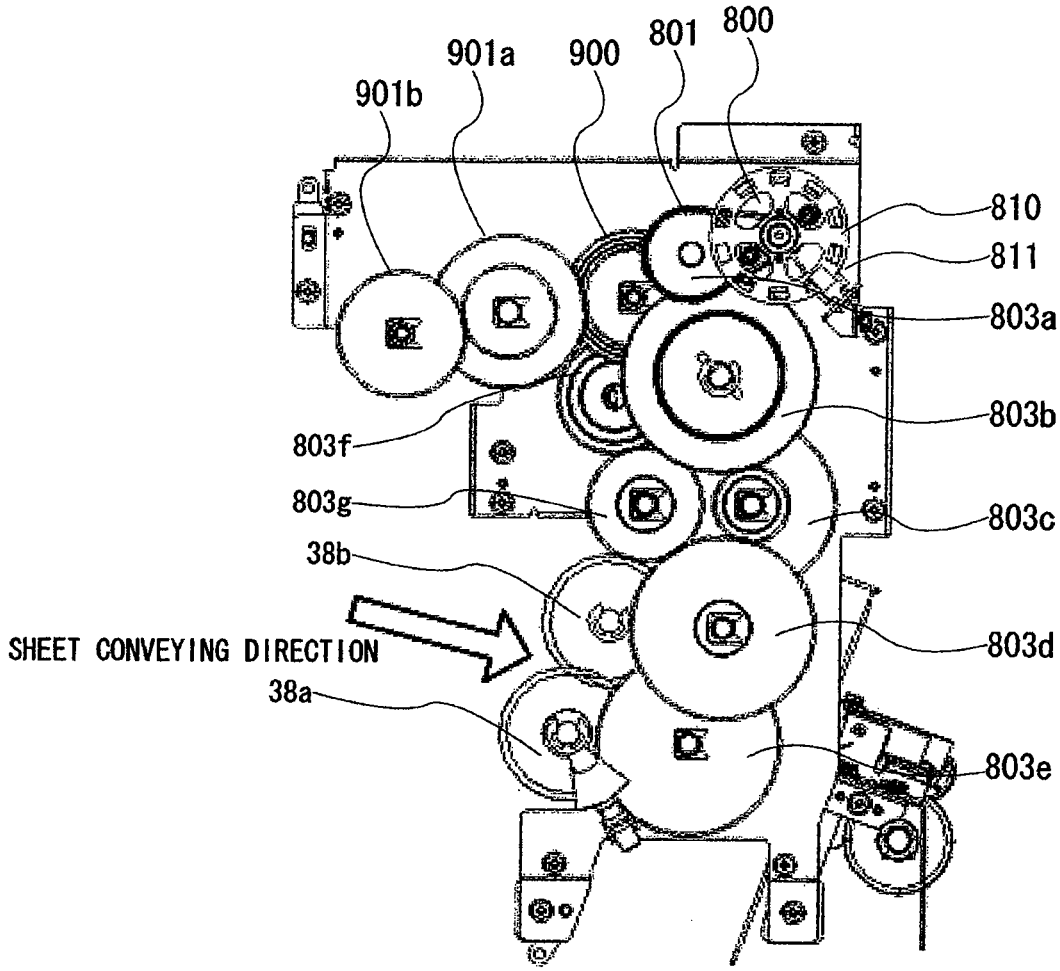
FIG. 10 is a first diagram illustrating a configuration of a folding unit driving mechanism.
Figure 11:
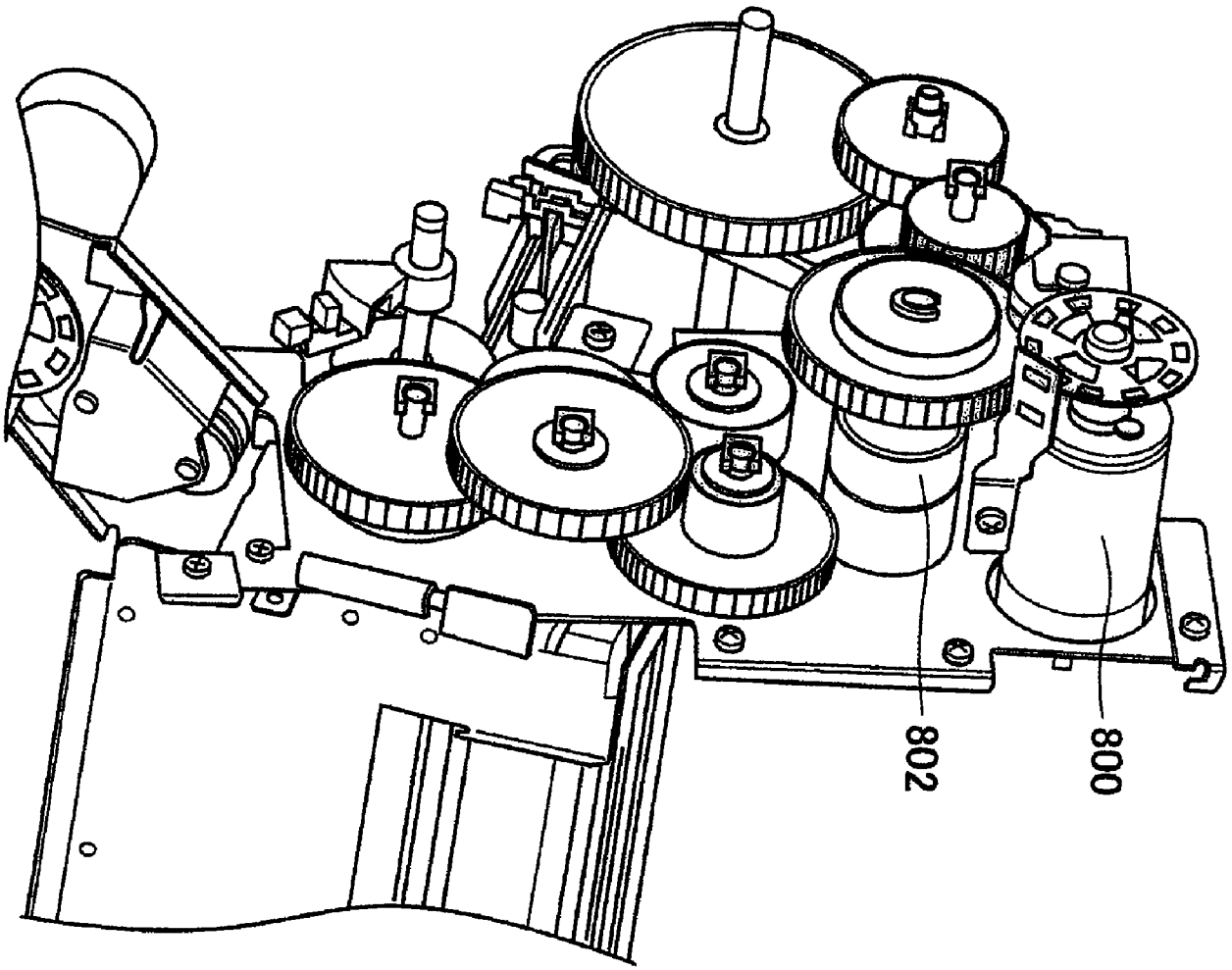
FIG. 11 is a second diagram illustrating the configuration of the folding unit driving mechanism.

FIG. 10 is a diagram illustrating a configuration of the driving mechanism of the folding roller pair 38 and the folding blade 37. The driving mechanism includes a folding motor 800 which is a DC motor (see FIG. 11), a timing belt 801, a one-way clutch 802, gears 803*a*, 803*b*, 803*c*, 803*d*, 803*e*, 803*f*, 803*g*, 901*a*, and 901*b*, and an electromagnetic clutch 900.

The folding motor 800 allows the gear 803*a* to rotate via the timing belt 801 and thus allows the electromagnetic clutch 900 and the gear 803*b* to rotate. The gear 803*b* is provided with the one-way clutch 802 (see FIG. 11). The one-way clutch 802 allows the fixed folding roller 38*a* to rotate in a path passing through the gears 803*b*, 803*c*, 803*d*, and 803*e* when the folding motor 800 is made to rotate forwardly. On the other hand, the one-way clutch allows the fixed folding roller 38*a* to rotate in another path, that is, a path passing through the gears 803*b*, 803*f*, 803*g*, 803*d*, and 803*e* when the folding motor 800 is made to rotate backwardly. This configuration is the driving mechanism of the folding roller pair 38.

The folding blade 37 also employs the folding motor 800 as a driving source. When the electromagnetic clutch 900 is turned on, the rotation of the folding motor 800 is transmitted to the gears 901*a* and 901*b*. The rotation of the gear 901*b* is transmitted to the driving mechanism 318 shown in FIG. 9 and thus the folding blade 37 is made to slide forward and backward about the nip of the folding roller pair 38 with the rotation of the driving mechanism 318.

The folding motor 800 is provided with an encoder actuator 810 and a folding motor encoder sensor 811, which are connected to the folding motor 800. The number of rotations of the folding roller pair 38 and the moving position of the folding blade 37 are controlled on the basis of an encoder pulse output from the folding motor encoder sensor 811.

Figure 12:
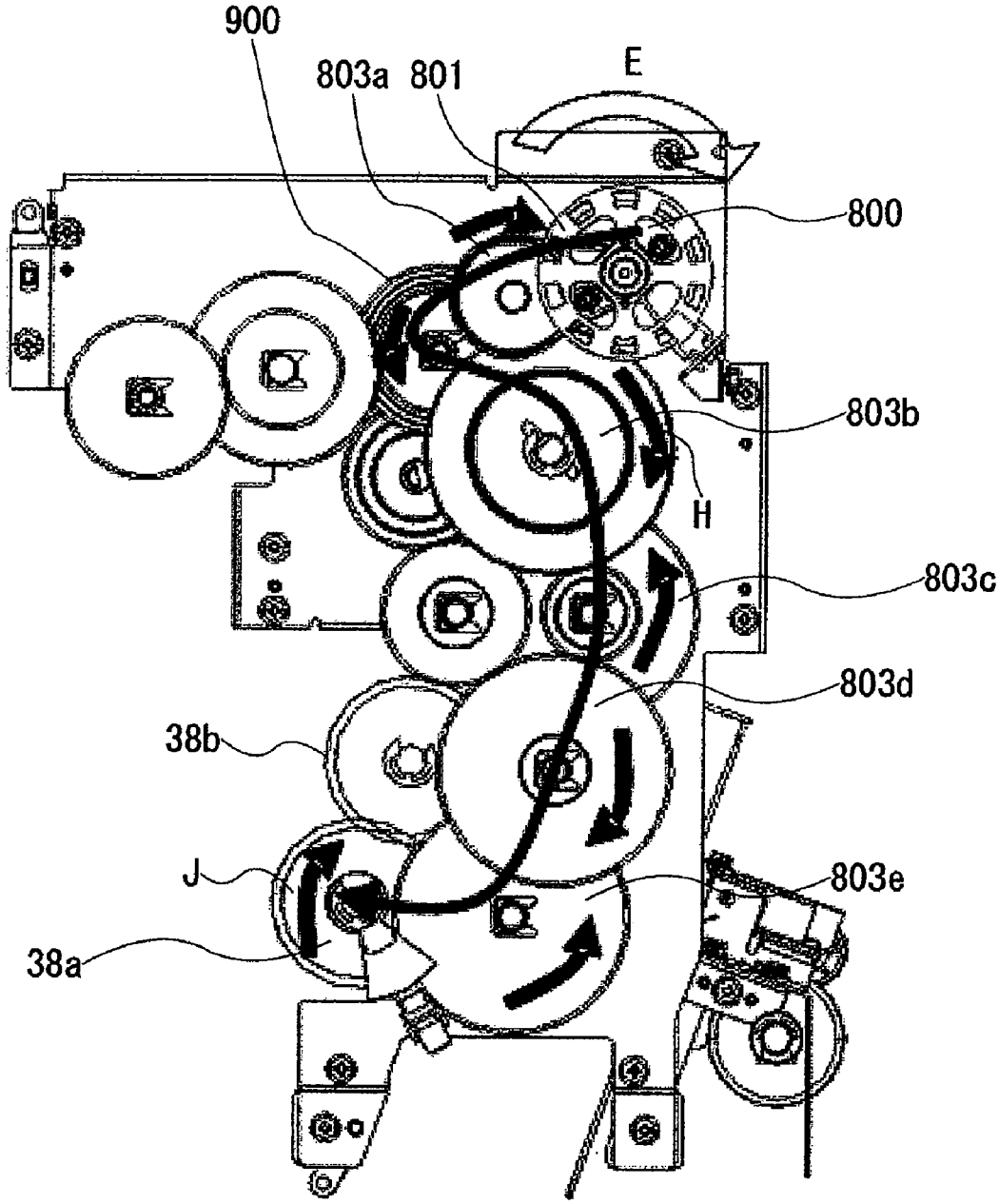
FIG. 12 is a first diagram illustrating a driving force transmitting path of the folding unit.
Figure 13:
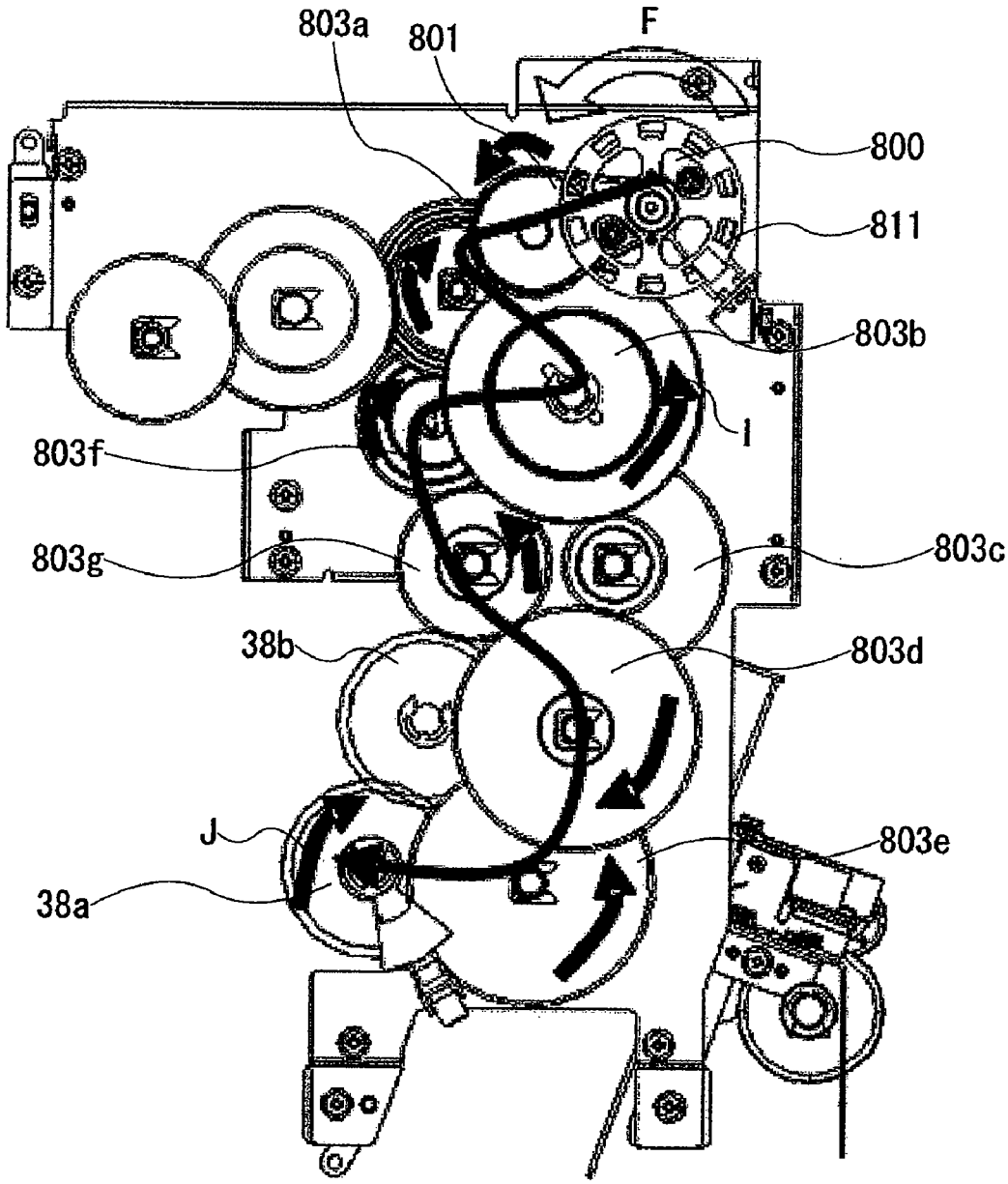
FIG. 13 is a second diagram illustrating the driving force transmitting path of the folding unit.

FIGS. 12 and 13 are diagrams illustrating a change of a rotation transmitting path due to the switching of the one-way clutch 802.

When the folding motor 800 is made to rotate in the direction of arrow E in FIG. 12, the gear 803*b* is made to rotate in the direction of arrow H via the timing belt 801, the gear 803*a*, and the electromagnetic clutch 900. When the gear 803*b* rotates in the direction of arrow H, the one-way clutch 802 transmits the rotation to the gear 803*c* and the fixed folding roller 38*a* is thus made to rotate in the direction of arrow J via the gears 803*d* and 803*e*. The gear train employing the gear 803*c* by allowing the folding motor 800 to rotate in the direction of arrow E is configured to increase its reduction ratio. As a result, the folding roller pair 38 rotates at a low speed and with high torque.

On the other hand, as shown in FIG. 13, when the folding motor 800 is made to rotate in the direction of arrow F (the direction opposite to the direction of arrow E in FIG. 12) in FIG. 13, the gear 803*b* is made to rotate in the direction of arrow I via the timing belt 801, the gear 803*a*, and the electromagnetic clutch 900. When the gear 803*b* rotates in the direction of arrow I, the one-way clutch 802 transmits the rotation to the gear 803*f* instead of the gear 803*c* and the fixed folding roller 38*a* is thus made to rotate in the direction of arrow J via the gears 803*g*, 803*d*, and 803*e*.

The gear train employing the gears 803*f* and 803*g* by allowing the folding motor 800 to rotate in the direction of arrow F is configured to decrease its reduction ratio. As a result, the folding roller pair 38 rotates at a high speed.

Since the gear train including the gears 803*f* and 803*g* rotates in the direction of arrow J similarly to FIG. 12, the conveyance direction of the sheet bundle in the folding roller pair 38 is not inverted.

With the above-mentioned mechanism, when the folding of the sheet bundle is performed, it is possible to drive the folding roller pair at a low speed and the high torque by allowing the folding motor 800 to rotate in the direction of arrow E, that is, a rotating direction in which the reduction ratio is high On the other hand, after the folding of the sheet bundle is ended, it is possible to convey the sheet bundle to the fold reinforcing unit 50 at a high speed by temporarily stopping the rotation of the motor and then allowing the folding motor 800 to rotate in the direction of arrow F which is the opposite direction.

(5) Fold Reinforcing Unit

Figure 14:
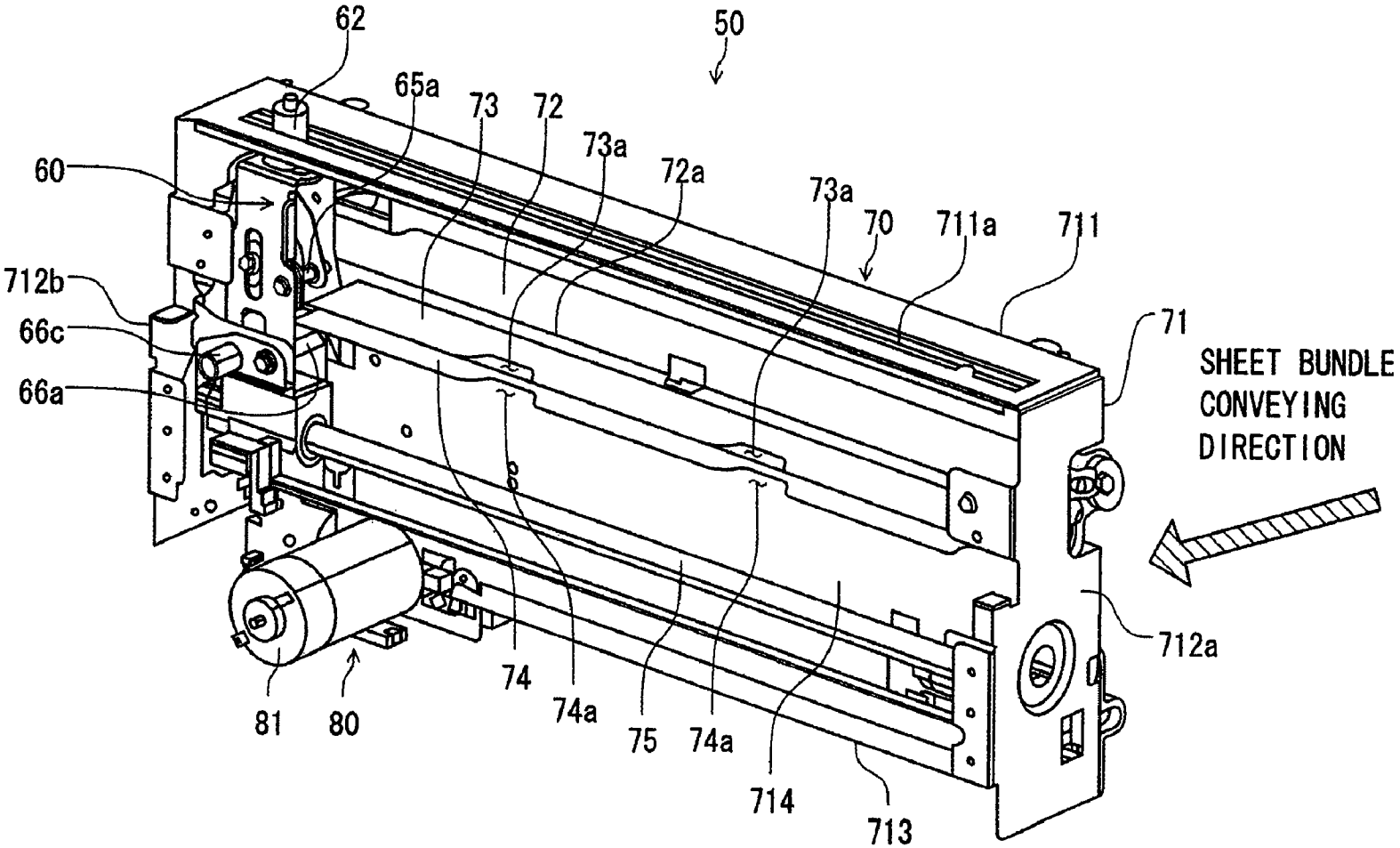
FIG. 14 is a perspective appearance view illustrating the entire structure of a fold reinforcing unit.

FIG. 14 is a perspective appearance view illustrating the entire structure of the fold reinforcing unit 50. The fold reinforcing unit 50 includes a fold reinforcing roller unit 60 (hereinafter, simply referred to as a roller unit 60), a support section 70, and a driving section 80.

The roller unit 60 includes the fold reinforcing roller pair 51. The fold reinforcing roller pair 51 nips and presses the fold of the sheet bundle pushed out from the folding roller pair 38 positioned upstream and moves along the fold, thereby reinforcing the fold.

The support section 70 supports the roller unit 60 to be slidable in the fold direction and includes nipping members of the sheet bundle and structure members of the whole fold reinforcing unit 50.

The driving section 80 includes a fold reinforcing motor 81. The fold reinforcing motor 81 drives the roller unit 60 along the fold.

Figure 15B:
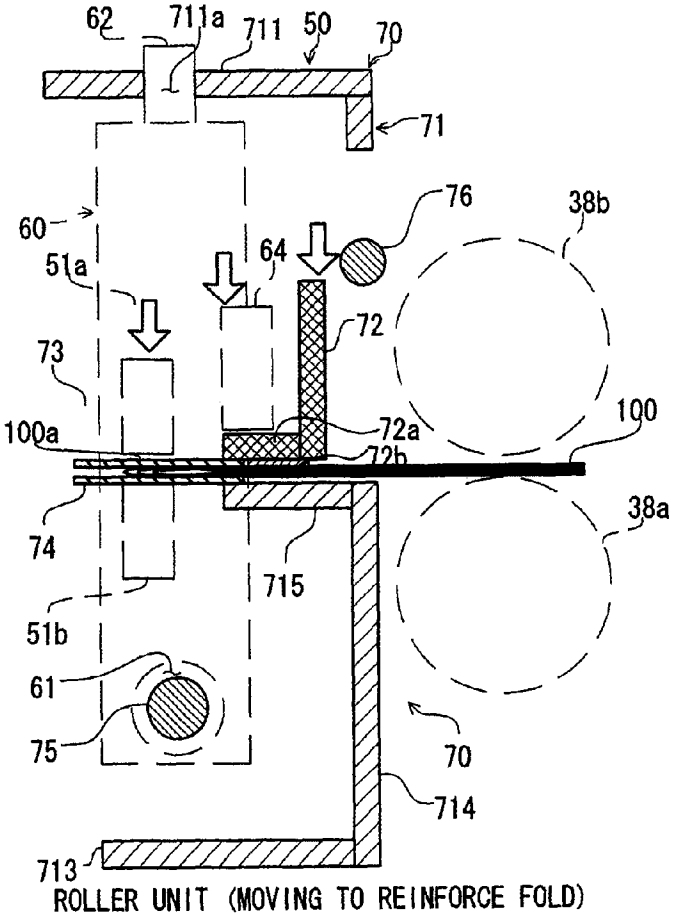
FIGS. 15A and 15B are sectional views schematically illustrating a structure of a supporting section.
Figure 15A:
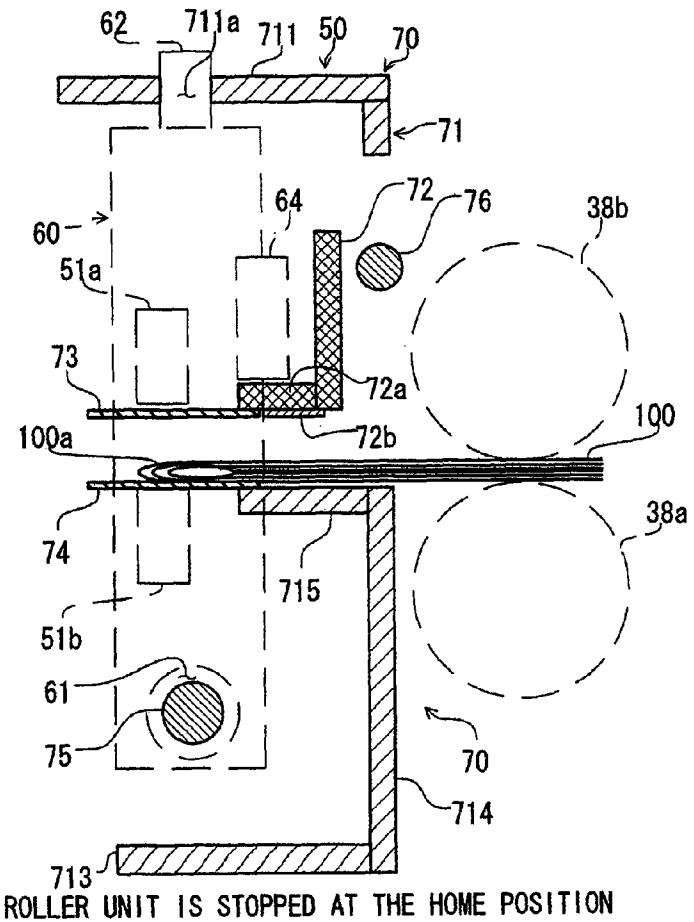

Among the roller unit 60, the support section 70, and the driving section 80, first, a structure of the support section 70 will be described with reference to FIG. 14 and FIGS. 15A and 15B. FIGS. 15A and 15B are sectional views schematically illustrating the structure of the support section 70. FIG. 15A is a sectional view when the roller unit 60 is located at a home position (standby position: position of the left end in FIG. 14) and FIG. 15B is a sectional view when the roller unit 60 is moving (reinforcing the fold).

The support section 70 includes a frame 71. The frame 71 includes a top plate 711, right and left side plates 712*a* and 712*b*, a bottom plate 713, a back plate 714, a sheet bundle loading base (loading base) 715 (see FIGS. 15A, 15B, etc.) and the like.

The top plate 711 is provided with a support hole 711*a* extending in the longitudinal direction.

A support shaft 75 supporting the roller unit 60, a conveyance guide 72 having an L-shaped section, a driving shaft 76 driving the conveyance guide 72 in the vertical direction (see FIGS. 15A, 15B, etc.) are disposed between both side plates 712*a* and 712*b*.

A band-like flexible member (second flexible member) 73 formed of a resin material such as film-like polyethylene terephthalate (PET) extends from a bottom plate (nipping plate) 72*a* of the conveyance guide 72. A similar flexible member (first flexible member) 74 also extends from the sheet loading base 715. An elastic member 72*b* to be described later is bonded to the surface, facing the sheet bundle loading base 715, of the bottom plate (nipping plate) 72*a* of the conveyance guide 72.

As shown in FIGS. 15A, and 15B, a fold 100*a* of a sheet bundle 100 is nipped between the flexible members 73 and 74 and is pressed by the fold reinforcing roller pair 51 (the upper roller 51*a* and the lower roller 51*b*) with the flexible members 73 and 74 interposed therebetween, thereby reinforcing the fold. The flexible members 73 and 74 prevent the occurrence of flaws or wrinkles in the sheet bundle 100.

The leading edges of the flexible members 73 and 74 are provided with notches 73*a* and 74*b*. The notches 73*a* and 74*b* are formed at positions corresponding to positions of the staples of the fold to prevent the flexible members 73 and 74 from being damaged by the staples.

As described later, a through hole 61 allowing the support shaft 75 to pass therethrough is disposed in a lower portion of the roller unit 60. A support roller 62 for posture holding is disposed in an upper portion of the roller unit 60 and the support roller 62 moves along the support hole 711*a* formed in the top plate 711.

The position (except the position change in the moving direction) of the roller unit 60 and the attitude of three-axis are regulated by the support shaft 75 and the through hole 61, together with the support hole 711*a* and the support roller 62, and are kept unchanged while the roller unit 60 is moving.

Figure 16:
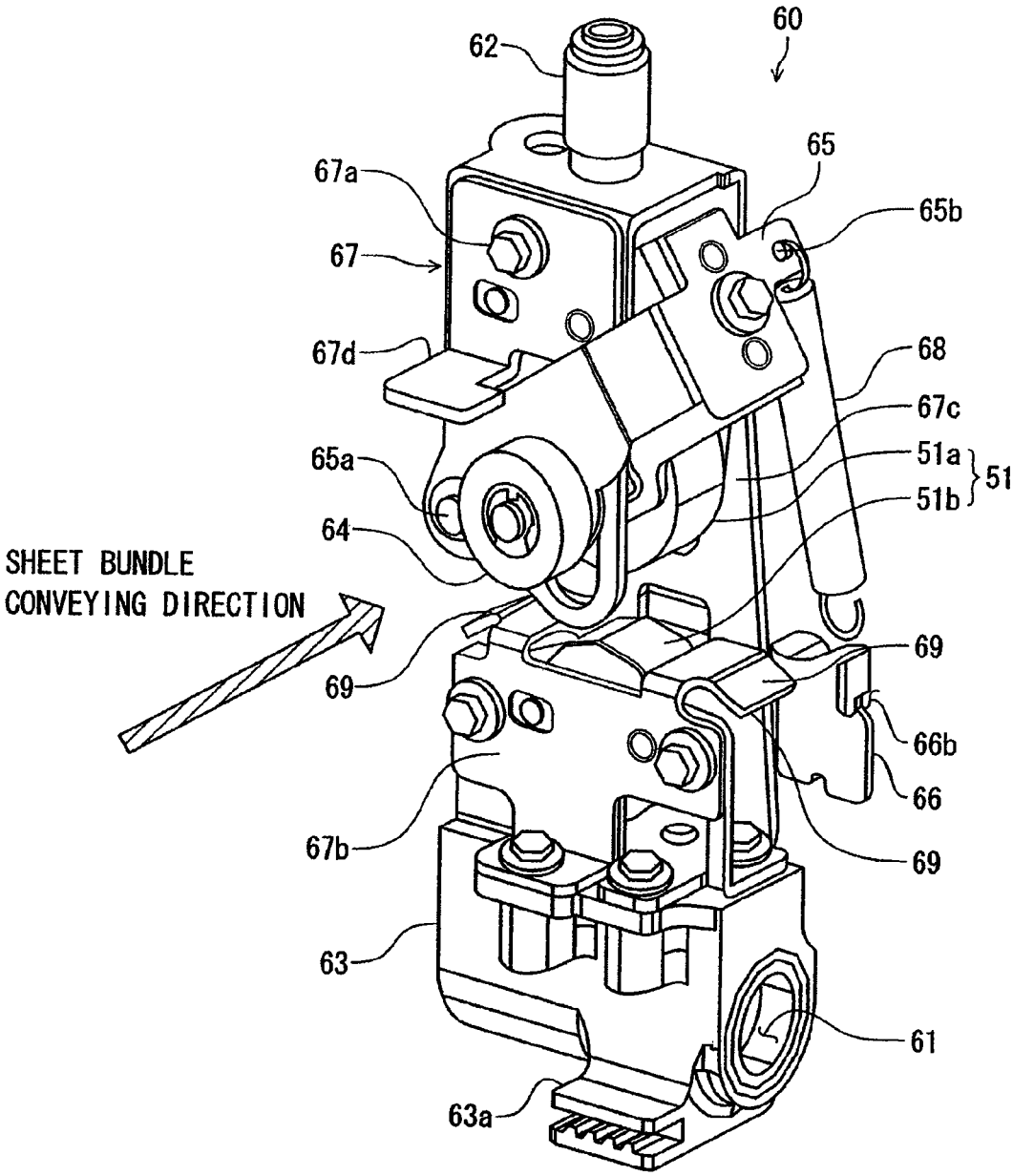
FIG. 16 is a perspective appearance view illustrating a structure of a roller unit.

The structure of the roller unit 60 will be described now. FIG. 16 is a perspective appearance view illustrating a structure of the roller unit 60 and is a view as viewed from the sending source (opposite to FIG. 14) of the sheet bundle.

The roller unit 60 is a unit having the fold reinforcing roller pair 51 built therein and includes a unit support section 63 which is positioned in a lower portion thereof and is provided with a through hole 61 and a roller frame 67 which is fixed to an upper portion of the unit support section 63.

In the roller frame 67, an upper frame 67*a* having a hollow part and a lower frame 67*b* having a hollow part are fixed and coupled to each other by a frame plate 67*c*.

Besides, the roller unit 60 includes an upper link member (second link member) 65 and a lower link member (first link member) 66, both of which are spring-coupled to each other by a spring 68. One end of the spring 68 is locked to a hook hole 65*b* of the upper link member 65 and the other end of the spring 68 is locked to a notch 66*b* of the lower link member 66. FIG. 16 shows the spring 68 in a free state in which the other end of the spring 68 is unlocked from the notch 66*b*. In the state where the other end of the spring 68 is actually locked to the notch 66*b*, the pulling force of the spring 68 is applied between the upper link member 65 and the lower link member 66.

The lower roller 51*b* as one of the fold reinforcing roller pair 51 is contained in the hollow portion of the lower frame 67*b*. The lower roller 51*b* is supported to be rotatable about a lower roller shaft (not shown) fixed to the lower frame 67*b*.

The lower link member 66 is rotatably coupled to the side surface of the lower frame 67*b* via a lower link shaft 66*a* (see FIG. 14) fixed to the lower frame 67*b*.

The upper roller 51*a* as one of the fold reinforcing roller pair 51 is contained in the hollow portion of the upper frame 67*a*. The upper roller 51*a* is supported to be rotatable about an upper roller shaft (not shown) fixed to the upper link member 65 (not to the upper frame 67*a*).

The rotation shaft (lower roller shaft) of the lower roller 51*b* is fixed to the lower frame 67*b* (that is, fixed to the roller frame 67). Even if the roller unit 60 moves, the position of the lower roller 51*b* does not change in the vertical direction. The position of the upper end of the lower roller 51*b* is adjusted to become the same position as the flexible member 74. When the roller unit 60 moves, the lower roller 51*b* rotates while contacting with the lower surface of the flexible member 74.

On the other hand, the upper roller shaft of the roller 51*a* is fixed to the upper link member 65. When the roller unit 60 goes away from the home position and starts its movement, the upper link member 65 is pulled by the spring 68 and starts rotating downward about an upper link shaft 65*a*. By this rotation, the upper roller 51*a* rotatably attached to the upper link member 65 starts moving down and moves to a position where it comes in contact with the lower roller 51*b*. The pressing force caused by the pulling force of the spring 68 is mutually applied between the upper roller 51*a* and the lower roller 51*b*. Actually, since the sheet bundle is nipped between the upper roller 51*a* and the lower roller 51*b* with the flexible members 73 and 74 interposed therebetween, the fold of the sheet bundle is reinforced by the pressing force between the upper roller 51*a* and the lower roller 51*b*.

Figure 17:
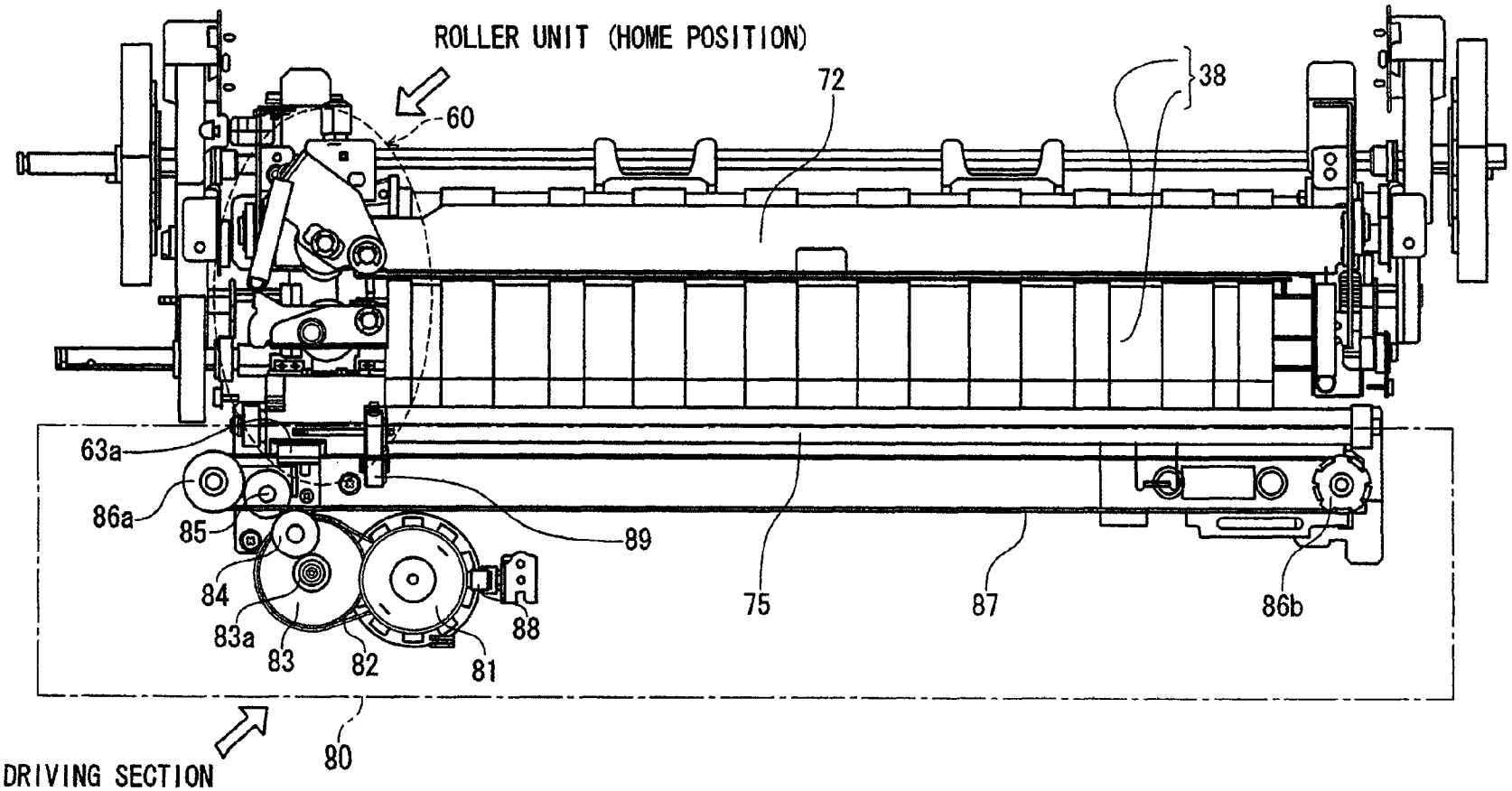
FIG. 17 is a diagram illustrating the fold reinforcing unit as viewed from a conveyance destination of a sheet bundle.

The structure of the driving section 80 will be described now. FIG. 17 is a view showing a configuration and a structure of the driving section 80. FIG. 17 is a view as the conveyance source is viewed from the conveyance destination of the sheet bundle and also shows the roller unit 60 at the home position, the folding roller pair 38, and the driving mechanism of the folding roller pair 38. The illustration of structural members of the support section 70 is partially omitted for convenience of explanation.

The driving section 80 includes the fold reinforcing motor 81 as a unique driving source of the fold reinforcing unit 50. The fold reinforcing motor 81 is a DC motor and the rotation direction and the rotation speed thereof can be controlled from the outside.

The driving force of the fold reinforcing motor 81 is transmitted to a pulley 83 via a motor belt 82 and is further transmitted from a gear 83*a* of the pulley 83 to a driving-side pulley 86*a* via a gear 84 and a gear 85. A unit driving belt 87 is stretched between the driving-side pulley 86*a* and a driven-side pulley 86*b*. The unit driving belt 87 is made to move between the driving-side pulley 86*a* and the driven-side pulley 86*b* by the driving force of the fold reinforcing motor 81.

A rack is formed on the surface of the unit driving belt 87. The rack and the teeth of a fitting section 63*a* (see FIG. 16) provided at a lower part of the roller unit 60 are fitted to each other, whereby the roller unit 60 can be made to certainly move in the folding direction without sliding. The moving direction of the unit driving belt 87 can be changed by reversing the rotation direction of the fold reinforcing motor 81, thereby allowing the roller unit 60 to reciprocate.

The moving distance and the moving speed of the unit driving belt 87, that is, the moving distance and the moving speed of the roller unit 60, can be controlled by controlling the rotation of the fold reinforcing motor 81. The rotation distance and the rotation speed of the fold reinforcing motor 81 are detected by a sequence of pulse signals outputted from an encoder sensor 88 to control the rotation of the fold reinforcing motor 81 on the basis of the detected rotation distance and rotation speed.

The fold reinforcing motor 81 may be constructed of a pulse motor. In this case, the rotation speed can be detected by counting the pulses directly outputted from the fold reinforcing motor 81.

Figure 18:
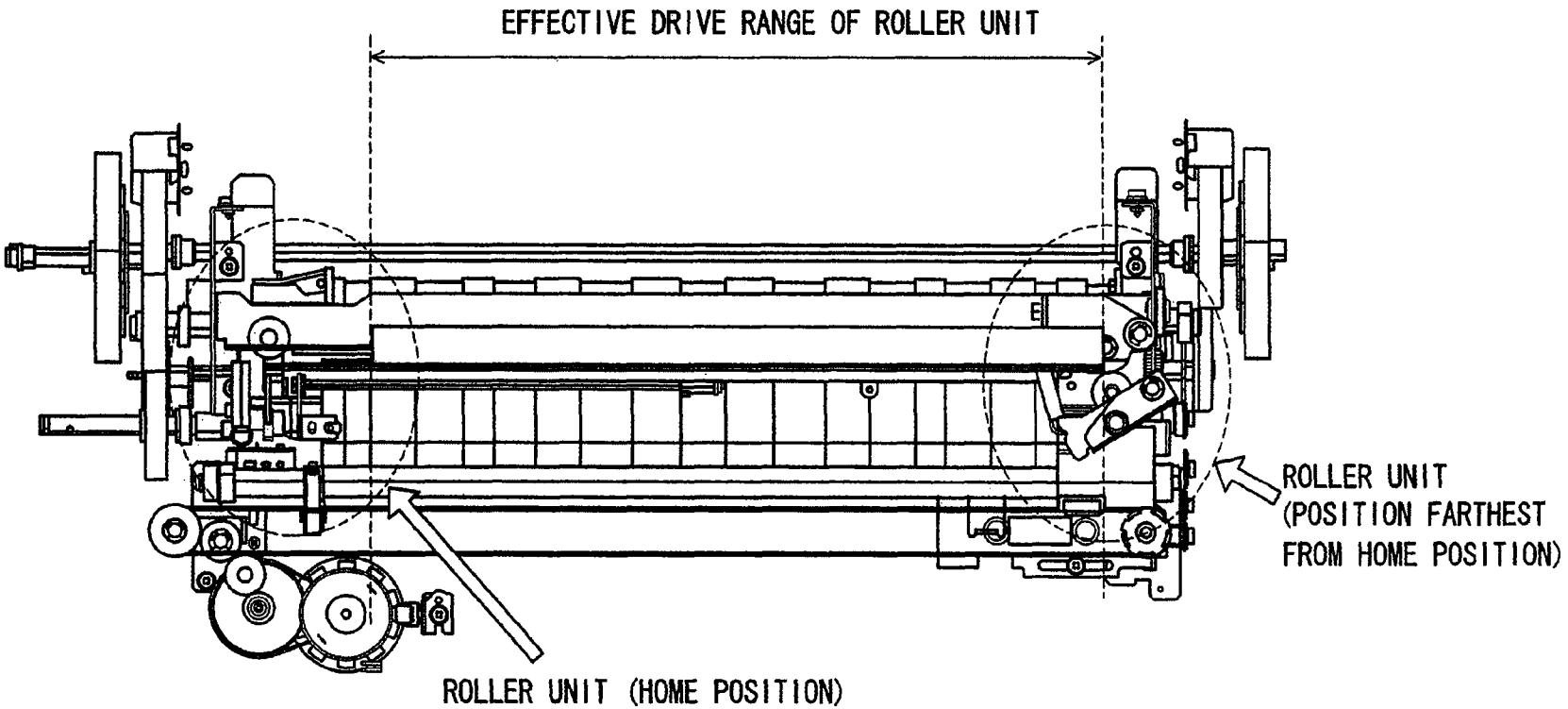
FIG. 18 is a diagram illustrating an effective driving range of the roller unit.

FIG. 18 is a diagram illustrating a relation between an effective driving range of the roller unit 60 and a width of a processable maximum sheet size (for example, A3 size). As shown in FIG. 18, the home position of the roller unit 60 is set at a position where even the sheet bundle of the processable maximum size does not interfere. A position of the roller unit 60 farthest from the home position is set to the farthest position within the range where the nip of the fold reinforcing roller pair 51 does not exceed the edge of the sheet bundle of the processable maximum size.

The roller unit 60 goes away from the home position and starts moving, moves along the fold while reinforcing the fold, and once stops at the edge of the sheet bundle opposite to the home position. Thereafter, the roller unit moves along a return path while continuously reinforcing the fold and returns to the home position.

The position where the roller unit once stops at the edge of the sheet bundle opposite to the home position varies according to the sheet size and the once stop position is determined on the basis of information on the sheet size.

The vertical driving of the upper roller 51*a* inside the roller unit 60 and the vertical driving of the conveyance guide 72 are also performed in addition to the movement of the roller unit 60 along the fold by the fold reinforcing unit 50. Both driving sources of these vertical drivings are the fold reinforcing motor 81. That is, all the driving operations of the fold reinforcing unit 50 are performed by the single fold reinforcing motor 81. Hereinafter, the mechanism of the vertical driving of the upper roller 51*a* and the mechanism of the vertical driving of the conveyance guide 72 will be described now.

Figure 19:
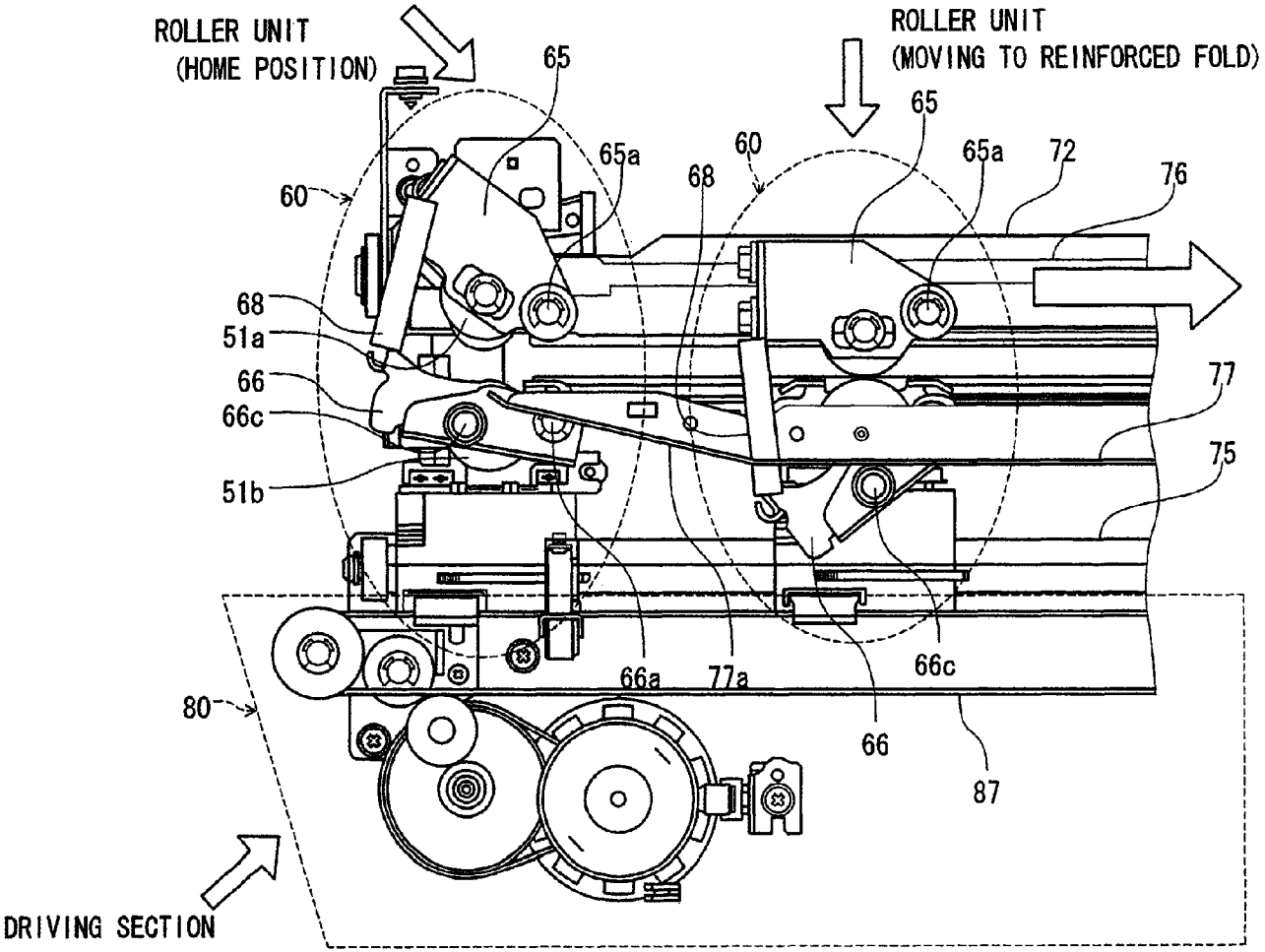
FIG. 19 is a first diagram illustrating a mechanism for vertically driving an upper roller.
Figure 20:
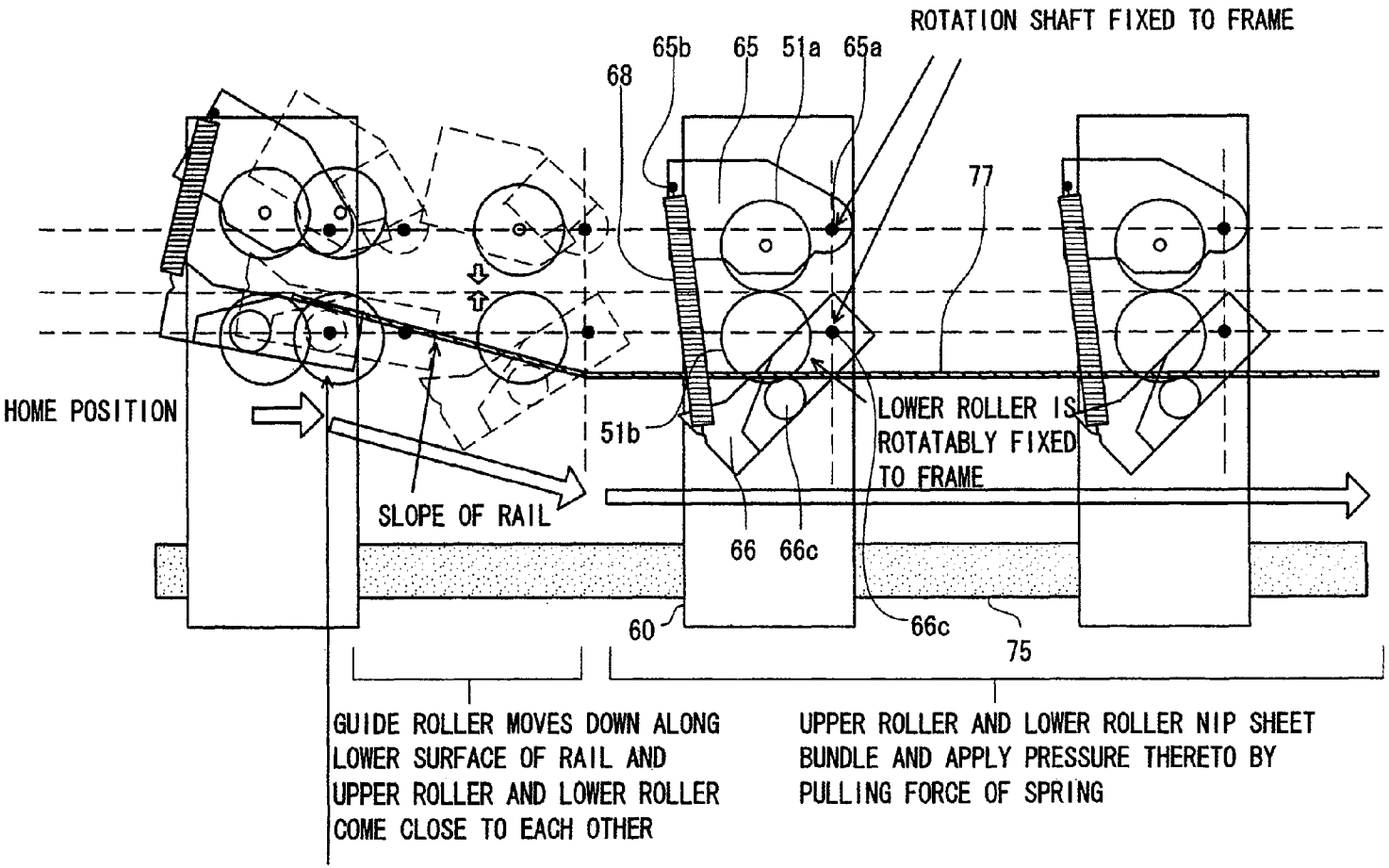
FIG. 20 is a second diagram illustrating the mechanism for vertically driving the upper roller.

FIG. 19 and FIG. 20 are diagrams illustrating the mechanism of the vertical driving of the upper roller 51*a*. As described above, the upper link member 65 and the lower link member 66 of the roller unit 60 are spring-coupled to each other by the spring 68 at the position farthest from the respective rotation shafts (65*a* and 66*a*). The lower link member 66 is provided with a freely rotating guide roller 66*c* (see FIG. 14, etc.).

As shown in FIG. 19, the support section 70 includes a guide rail 77 having an L-shaped section. The guide rail 77 includes an inclined section 77*a* and is parallel to the fold of the sheet bundle except for the inclined section 77*a*.

When the roller unit 60 is driven by the driving belt 87 and goes away from the home position, as shown in FIG. 20, the guide roller 66*c* comes in contact with the bottom surface of the inclined section 77*a* of the guide rail 77. Thereafter, the guide roller 66*c* moves down along the bottom surface of the inclined section 77*a*. As the guide roller 66*c* moves down, the lower link member 66 rotates about the lower link shaft 66*a* in the counterclockwise direction in FIG. 20. Besides, the upper link member 65 is also pulled by the spring 68 and rotates in the counterclockwise direction about the upper link shaft 65*a*. As a result, while the roller unit 60 is moving along the inclined section 77*a*, the upper roller 51*a* positioned between the upper link shaft 65*a* and the hook hole 65*b* of the spring 68 gradually moves down and the gap between the upper roller 51*a* and the lower roller 51*b* becomes gradually short. When the inclined section 77*a* terminates, the upper roller 51*a* and the lower roller 51*b* come in contact with each other. The upper roller 51*a* and the lower roller 51*b* may come in contact with each other before the inclined section 77*a* terminates. At this time, the pressure (pressing force) for pressing each other acts between the upper roller 51*a* and the lower roller 51*b*. The pressing is based on the pulling force of the spring 68.

In the horizontal region of the guide rail 77 (that is, the effective driving region), the upper roller 51*a* and the lower roller 51*b* apply the pressure to the fold of the sheet bundle while keeping the pressing force, thereby reinforcing the fold.

The mechanism of the vertical driving of the conveyance guide 72 will be described now. As shown in FIG. 15A, when the roller unit 60 is located at the home position, the conveyance guide 72 is lifted up and the sheet bundle 100 is conveyed through an opening between the bottom plate 72*a* of the conveyance guide 72 and the sheet bundle loading base 715. On the other hand, as shown in FIG. 15B, when the roller unit 60 moves into the effective movement range and performs the fold reinforcing operation, the conveyance guide 72 moves down and nips the sheet bundle.

Figure 21:
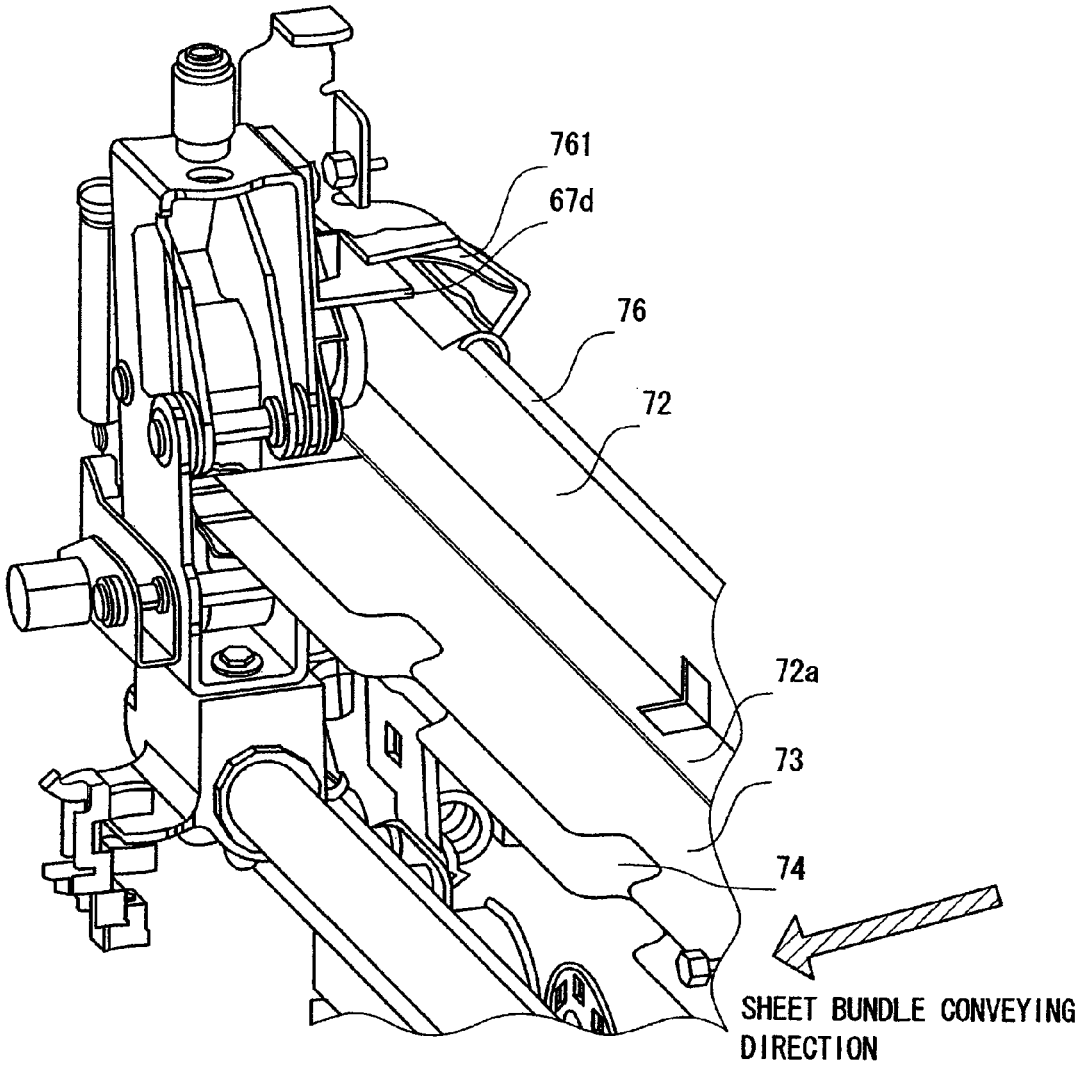
FIG. 21 is a first diagram illustrating a driving structure used to vertically drive a conveyance guide.
Figure 22:
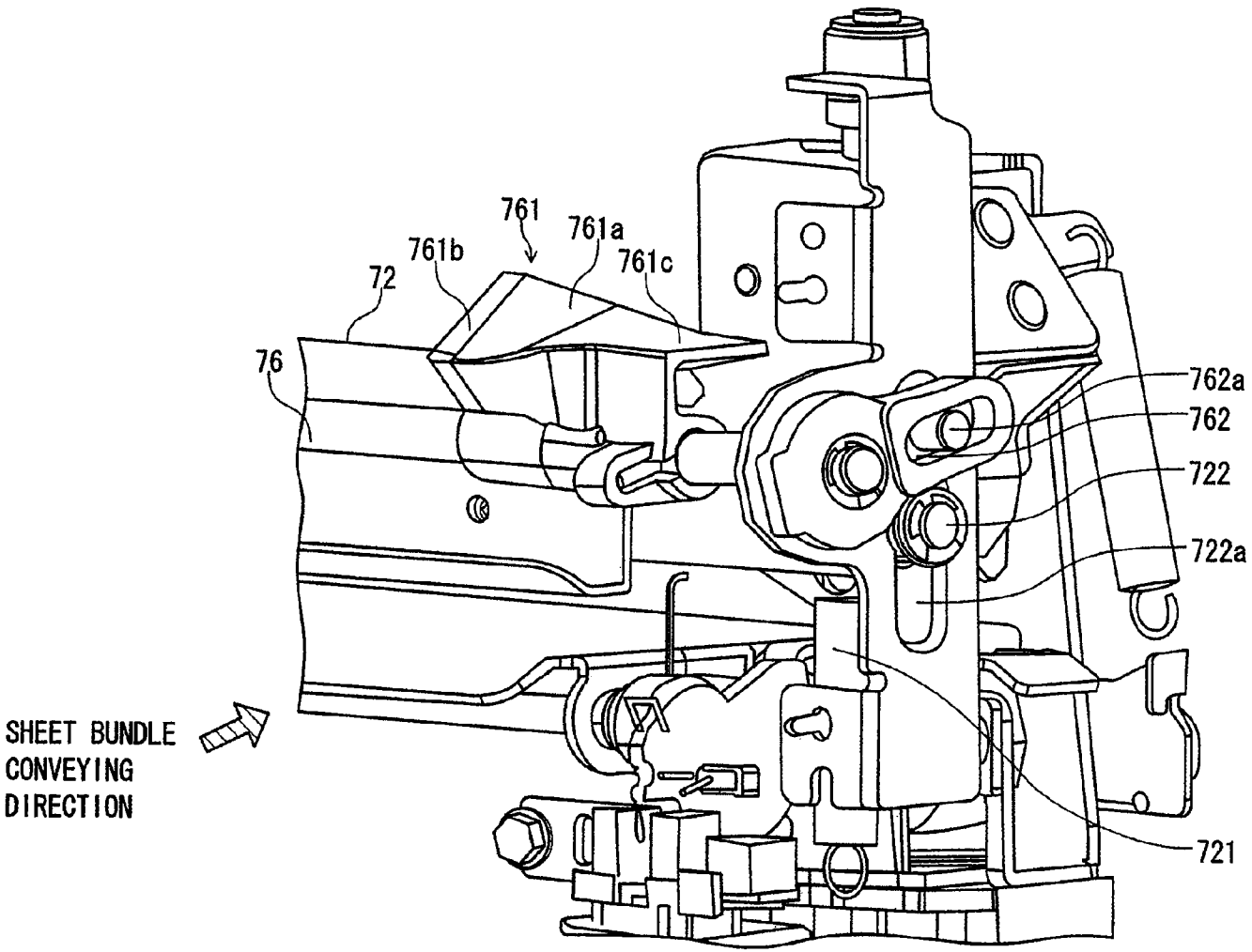
FIG. 22 is a second diagram illustrating the driving structure used to vertically drive the conveyance guide.

FIGS. 21 and 22 are diagrams illustrating a driving structure used for the vertical driving of the conveyance guide 72.

As shown in FIGS. 21 and 22, the driving shaft 76 used for the vertical driving of the conveyance guide 72 is disposed between the conveyance guide 72 and the folding roller pair 38. A cam member 761 is fixed to one end of the driving shaft 76 close to the home position.

As shown in FIG. 22, the cam member 761 includes a twisted section 761*a* having a twisted shape of a plate member, a horizontal section 761*c* extending from the twisted section 761*a*, and a leading section 761*b* on the opposite side of the horizontal section 761*c*.

A lever member 762 is fixed to the driving shaft 76 at the leading end of the cam member 761 close to the home position. The leading section of the lever member 762 is provided with a long hole 762*b* and a lever roller 762*a* fixed to the end of the conveyance guide 72 is slidably inserted in the long hole 762*b*.

A bearing member 722 is fixed to the end of the conveyance guide 72. The bearing member 722 is inserted into a long hole 722*a* formed in the roller frame 67 of the roller unit 60 and can slide in the vertical direction.

The end of the bottom plate 72*a* of the conveyance guide 72 close to the home position and the bottom plate 713 of the frame 71 are spring-coupled to each other by a conveyance guide spring 721. The conveyance guide 72 is pulled down (toward the bottom plate 713) by the pulling force of the conveyance guide spring 721.

The movement of this driving structure will be described with reference to FIGS. 23A to 23D.

Figure 23A:
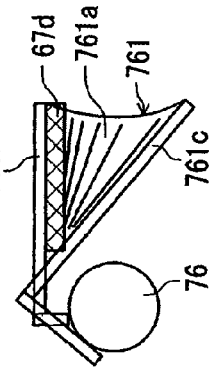
FIGS. 23A to 23D are diagrams schematically illustrating the movement of the vertical driving structure of the conveyance guide.
Figure 23B:
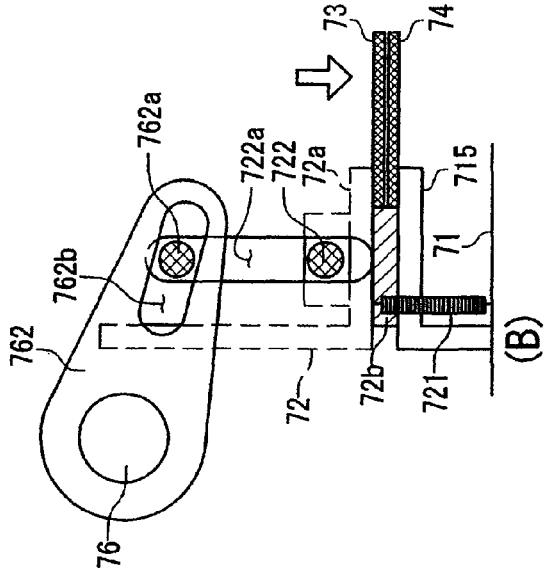
Figure 23C:
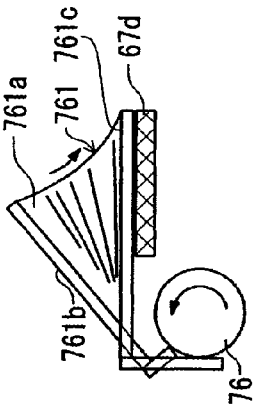
Figure 23D:
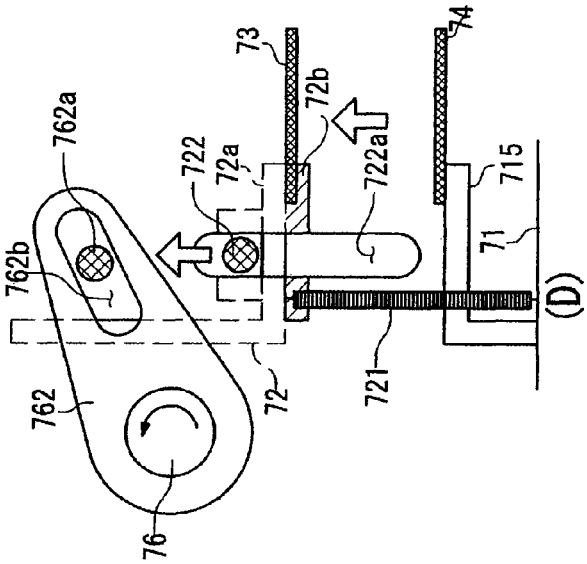

FIGS. 23A and 23B are diagrams illustrating a state where the roller unit 60 moves apart from the home position, that is, a state where it reinforcing the fold.

FIG. 23A is a diagram illustrating a positional relation between the cam member 761 fixed to the driving shaft 76 and a conveyance guide supporting base 67*d*. The roller unit 60 includes the conveyance guide supporting base 67*d* horizontally extending from the roller frame 67 (see FIGS. 21 and 16). When the roller unit 60 goes away from the home position, the cam member 761 is located at a position separated from the conveyance guide supporting base 67*d* and they do not interfere with each other.

On the other hand, when reinforcing the fold, as shown in FIG. 23B, the conveyance guide 72 is pulled down by the pulling force of the conveyance guide spring 721 and thus the bottom plate 72*a* (and the flexible member 73) of the conveyance guide 72 is strongly pressed against the sheet bundle loading base 715 (and the flexible member 74) with the sheet bundle (not shown) interposed therebetween.

At this time, the bearing member 722 fixed to the conveyance guide 72 and the lever roller 762*a* are also pulled down and thus the leading end of the lever member 762 is directed slightly downward and is stopped in this state. As shown in FIG. 23A, the leading section 761*b* of the cam member 761 is stopped at the position where it is parallel to the conveyance guide supporting base 67*d* of the roller unit 60.

When the roller unit 60 reaches the opposite side of the home position and again returns to the vicinity of the home position, the conveyance guide supporting base 67*d* of the roller unit 60 first come in contact with the lower surface of the leading section 761*b* of the cam member 761.

Thereafter, when the roller unit 60 further moves to the home position, the conveyance guide supporting base 67*d* moves while sliding on the lower surface of the twisted section 761*a* of the cam member 761. At this time, an upward force acting on the cam member 761 is generated by the curve of the twisted section 761*a* to allow the driving shaft 76 fixed to the cam member 761 to rotate (rotate in the counterclockwise direction in FIG. 23C).

As the driving shaft 76 rotates, the lever member 762 also rotates in the same direction and the leading end of the lever member 762 moves up. As a result, the lever roller 762*a* inserted into the long hole 762*b* of the lever member 762 is pulled up and the conveyance guide 72 fixed to the lever roller 762*a* is also made to move up against the pulling force of the conveyance guide spring 721.

When the roller unit 60 completely returns to the home position, the conveyance guide supporting base 67*d* of the roller unit 60 passes through the twisted section 761*a* of the cam member 761, reaches the horizontal section 761*c*, and stops here.

A force for causing a downward movement is applied to the conveyance guide 72 by the pulling force of the conveyance guide spring 721. However, at the home position, since the horizontal section 761*c* of the cam member 761 is placed on the upper surface of the conveyance guide supporting base 67*d*, it cannot move down. Thus, the driving shaft 76 and the lever member 762 are in the state where the rotation in the clockwise direction is inhibited and the lever roller 762*a* and the conveyance guide 72 fixed thereto cannot thus move down.

As described above, when the roller unit 60 is located at the home position, the conveyance guide 72 and the flexible member 73 are held in the state where they are lifted up.

In this state, the sheet bundle of which the fold is already reinforced is pushed out with the rotation of the folding roller pair 38 and is conveyed to the sheet bundle loading section 41. The sheet bundle of which the fold is to be reinforced from now is conveyed in this state so that the fold is positioned between the flexible members 73 and 74.

When the roller unit 60 goes away from the home position in order to reinforce the fold, the movement thereof is opposite to the above-mentioned movement. When the roller unit 60 starts going away from the home position, the conveyance guide supporting base 67*d* of the roller unit 60 moves from the horizontal section 761*c* of the cam member 761 to the position of the twisted section 761*a*. The driving shaft 76 receives a clockwise force resulting from the pulling force of the conveyance guide spring 721 and gradually rotates in the clockwise direction while the conveyance guide supporting base 67*d* moves along the curved portion of the twisted section 761*a*. The lever member 762 also rotates in the clockwise direction with this movement and the lever roller 762*a*, the bearing member 722, and the conveyance guide 72 fixed to these move down. Finally, the bottom plate 72*a* of the conveyance guide 72 and the flexible member 73 reach the sheet bundle and the downward movement stops at the stage where the sheet bundle is pressed with the pulling force of the conveyance guide spring 721.

Although the description is hitherto given to the lateral movement of the roller unit 60 along the fold of the sheet bundle, the vertical movement of the upper roller 51*a* in the roller unit 60, and the vertical movement of the conveyance guide 72, these movements can be roughly summarized as follows.

(a) When the roller unit 60 is located at the home position, the conveyance guide 72 and the upper flexible member 73 are lifted up. Besides, the upper roller 51*a* in the roller unit 60 is also lifted up.

Incidentally, the positions of the sheet bundle loading base 715 and the lower flexible member 74 in the vertical direction are almost the same as the nip of the folding roller pair 38 and are always constant regardless of the movement of the roller unit 60. Similarly, the vertical position of the lower roller 51*b* in the roller unit 60 is always constant regardless of the movement of the roller unit 60 and the position of the upper end of the lower roller 51*b* is set to almost the same position as the lower flexible member 74.

(b) When the roller unit 60 is located at the home position, the sheet bundle is conveyed through the nip of the folding roller pair 38 and the conveyance of the sheet bundle is once stopped when the fold reaches between the flexible members 73 and 74.

(c) Here, the fold reinforcing motor 81 is driven and the roller unit 60 starts the lateral movement by the unit driving belt 87 and starts going away from the home position.

(d) When the roller unit 60 goes away from the home position, the conveyance guide 72 and the upper flexible member 73 move down and press the sheet bundle from above in cooperation with the bottom plate 72*a* of the conveyance guide 72 (operation shown in FIGS. 23A to 23D). The pressing force results from the pulling force of the conveyance guide spring 721. The downward movement of the conveyance guide 72 is completed before the roller unit 60 reaches the effective driving range, where the fold of the sheet bundle is nipped by the upper and lower flexible members 73 and 74.

(e) When the roller unit 60 goes away from the home position, the upper roller 51*a* in the roller unit 60 also starts moving down. The upper roller presses (operation of FIG. 20) the upper surface of the upper flexible member 73 of which the downward operation is ended. At this time, the lower roller 51*b* is positioned at the lower surface of the lower flexible member 74 and the upper and lower flexible members 73 and 74 are pressed by the upper roller 51*a* and the lower roller 51*b*. The pressing force results from the pulling force of the spring 68 in the roller unit 60.

(f) Thereafter, the roller unit 60 is made to move with the movement of the unit driving belt 87. When the roller unit 60 reaches the position of the sheet bundle, the upper roller 51*a* runs onto the sheet bundle with the upper flexible member 73 interposed therebetween and moves along the fold while pressing the fold of the sheet bundle. When the roller unit 60 reaches the opposite end of the home position, the movement of the unit driving belt 87 is reversed and the roller unit moves in the return path along the fold while pressing the fold of the sheet bundle. Finally, the roller unit returns to the home position.

As described above, in the fold reinforcing unit 50 according to this embodiment, since the sheet bundle is nipped by the fold reinforcing roller pair 51 with the upper and lower flexible members 73 and 74 interposed therebetween, the sheet is not turned up (curled up) at the edge of the sheet bundle. Besides, since the fold reinforcing roller pair 51 does not come in direct contact with the fold, a wrinkle or a flaw is not generated on the fold.

Besides, the conveyance guide 72 being driven in the vertical direction is provided and the conveyance guide 72 applies the pressure to the sheet bundle to press it. Accordingly, even if the fold reinforcing roller pair 51 moves along the fold, the sheet bundle is not misaligned in the lateral direction.

In the past, in order to prevent the sheet bundle from being misaligned in the lateral direction, a structure was proposed in which a stop member is disposed at the edge of the sheet bundle. However, the position of the stop member must be changed depending on the size of the sheet, thereby causing inconvenience.

On the contrary, in this embodiment, since the sheet bundle is pressed by the conveyance guide 72 having a sufficient width to cover the width of the maximum sheet size (for example, A3 size), the lateral misalignment of the sheet bundle can be prevented regardless of the sheet size.

Besides, the fold reinforcing unit 50 according to this embodiment includes a conveyance guide roller 64 further pressing the conveyance guide 72. As shown in FIG. 6, the conveyance guide roller 64 is attached to the upper link member 65 of the roller unit 60. When the roller unit 60 goes away from the home position, the conveyance guide roller 64 moves down and presses the bottom plate 72*a* of the conveyance guide 72 from above, similarly to the upper roller 51*a*, (see FIGS. 15A and 15B). The downward movement of the conveyance guide roller 64 is embodied by the same mechanism as the downward movement of the upper roller 51*a*. The conveyance guide 72 is pressed by the conveyance guide roller 64 in addition to the pulling force of the conveyance guide spring 721, thereby reinforcing the prevention of the lateral misalignment of the sheet bundle.

Here, a point to be noted is that in this embodiment, three independent movements, that is, the lateral movement of the roller unit 60, the vertical movement of the upper roller 51*a* (and the conveyance guide roller 64) in the roller unit 60, and the vertical movement of the conveyance guide 72, are embodied by the single driving source, that is, by only the fold reinforcing motor 81, not by plural independent driving sources. As a result, the number of driving motors can be reduced, which contributes to the reduction in cost and the reduction in electric power. When it is intended to embody the respective independent movements by the use of plural driving motors, the synchronization of the mutual movements must be taken and a control circuit for the synchronization becomes complicated. On the contrary, in this embodiment, since the respective movements are embodied by the single fold reinforcing motor 81, a synchronization control circuit of the driving motors is not necessary.

Figure 24:
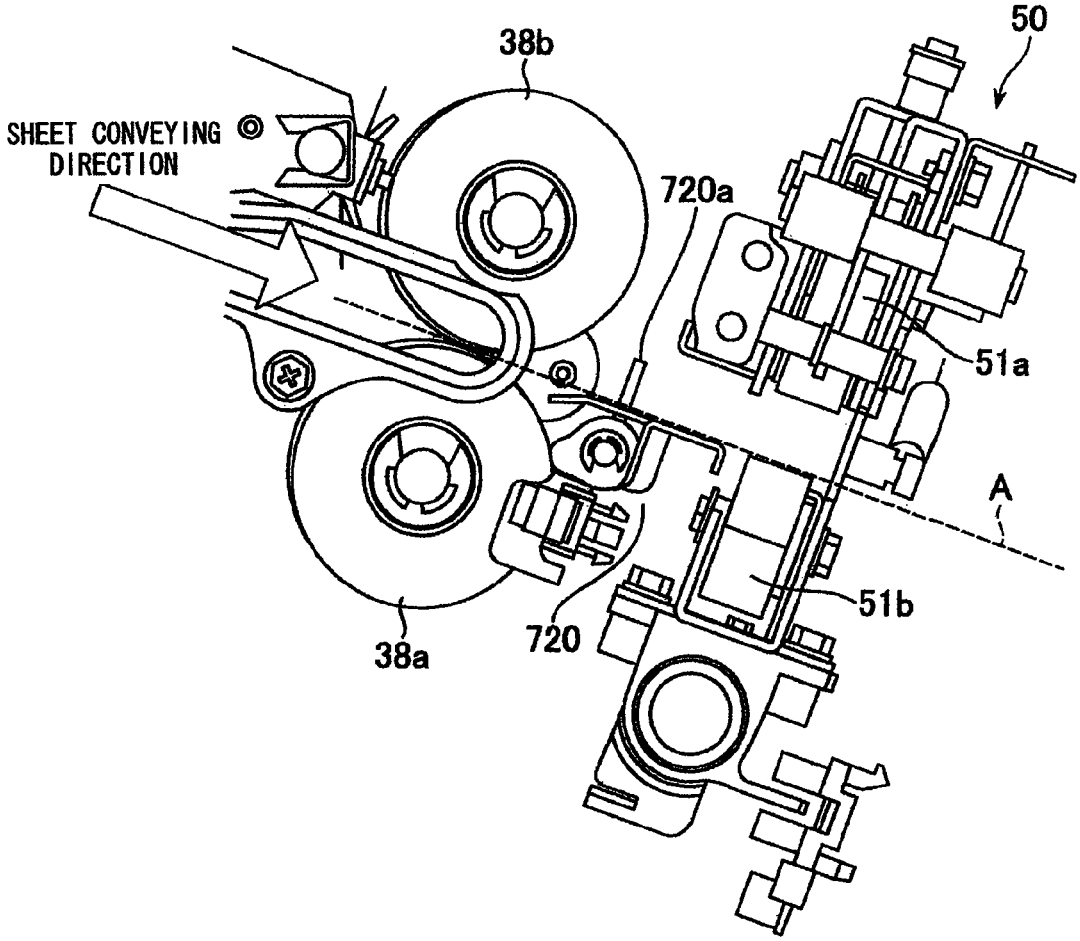
FIG. 24 is a diagram illustrating a positional relation of components around the roller unit.

FIG. 24 is a diagram illustrating a positional relation around the fold reinforcing unit 50. A fold reinforcing position sensor 720 is disposed between the folding roller pair 38 (38*a* and 38*b*) and the fold reinforcing unit 50. The fold reinforcing position sensor 720 includes a sensor lever 720*a* and detects the passing timing of the leading edge of the sheet bundle by allowing the folded portion of the sheet bundle (the leading edge of the sheet bundle) passing through the folding roller pair 38 to push down the sensor lever 720*a*. After the passing timing is detected, the sheet bundle is conveyed by a predetermined distance and then the sheet bundle is stopped. Thereafter, the fold reinforcing roller pair 51*a* and 51*b* is made to move to the fold, thereby reinforcing the fold.

A conveyance reference plane A is disposed at a position equal to or slightly lower than the outer circumferential surface of the fixed folding roller 38*a*. The outer circumferential surface of the fold reinforcing roller 51*b* of which the position is fixed is disposed at a position equal to or slightly lower than the conveyance reference plane A. Thanks to these positional relations, the folded portion of the sheet bundle can be accurately guided to the fold reinforcing position.

As described above, when the roller unit 60 goes away from the home position, the conveyance guide 72 and the upper flexible member 73 move down and the bottom plate (nipping plate) 72*a* of the conveyance guide 72 presses the sheet bundle from above (operations shown in FIGS. 23A to 23D). The pressing force is the pulling force of the conveyance guide spring 721 and the conveyance guide spring 721 is made to have a strong elastic force so as to prevent the lateral misalignment of the sheet bundle during the fold reinforcing operation. Accordingly, when the roller unit 60 goes away from the home position, the bottom plate 72*a* of the conveyance guide 72 moves down to the sheet loading base 715 at a high speed.

When a normal fold reinforcing operation is performed, the impact accompanied with the downward movement of the bottom plate is absorbed due to the sheet bundle interposed between the bottom plate 72*a* and the sheet loading base 715.

However, no sheet bundle exists in an initial operation. Accordingly, when the roller unit 60 goes away from the home position, the bottom plate 72*a* directly collides with the sheet loading base 715 at a high speed, thereby generating an impact sound not negligible.

Here, the initial operation means an operation of checking abnormality by allowing the roller unit 60 to once move to the home position and then allowing the roller unit 60 to reciprocate at least once in the state where no sheet bundle exists before starting performing a printing on a sheet after the apparatus is powered, etc. The initial operation is performed on the lateral alignment unit 40 or the stacker 35 as well as the roller unit 60 and permits the high-accuracy position control using the detection timing of the home position sensors acquired from the initial operation, in addition to the check of abnormality. Even when the apparatus is stopped due to a jam of a sheet, etc., the initial operation is performed as a restoring operation after removing the jammed sheet.

Figure 25:
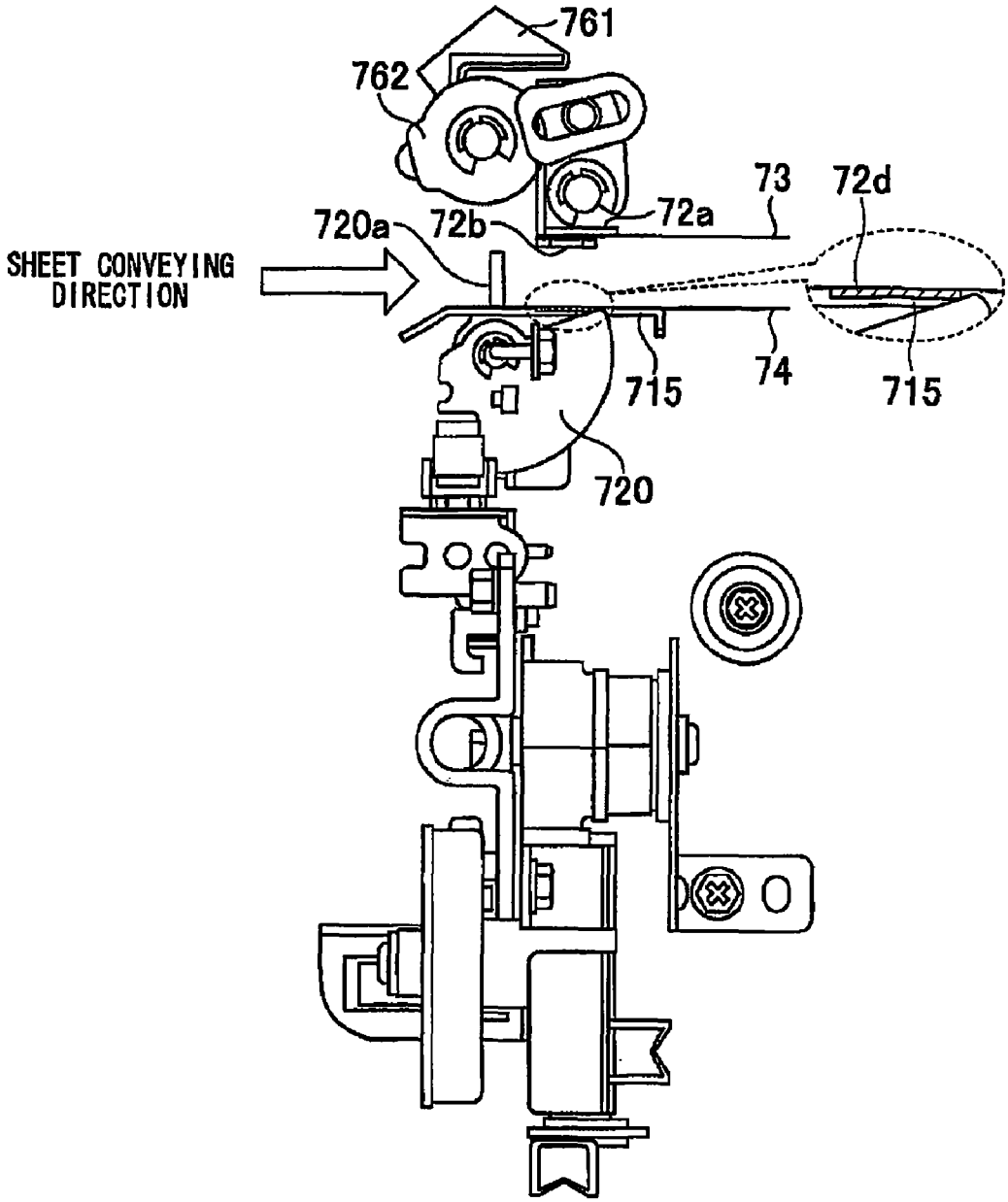
FIG. 25 is a first diagram illustrating an elastic member disposed in a nipping plate.
Figure 26:
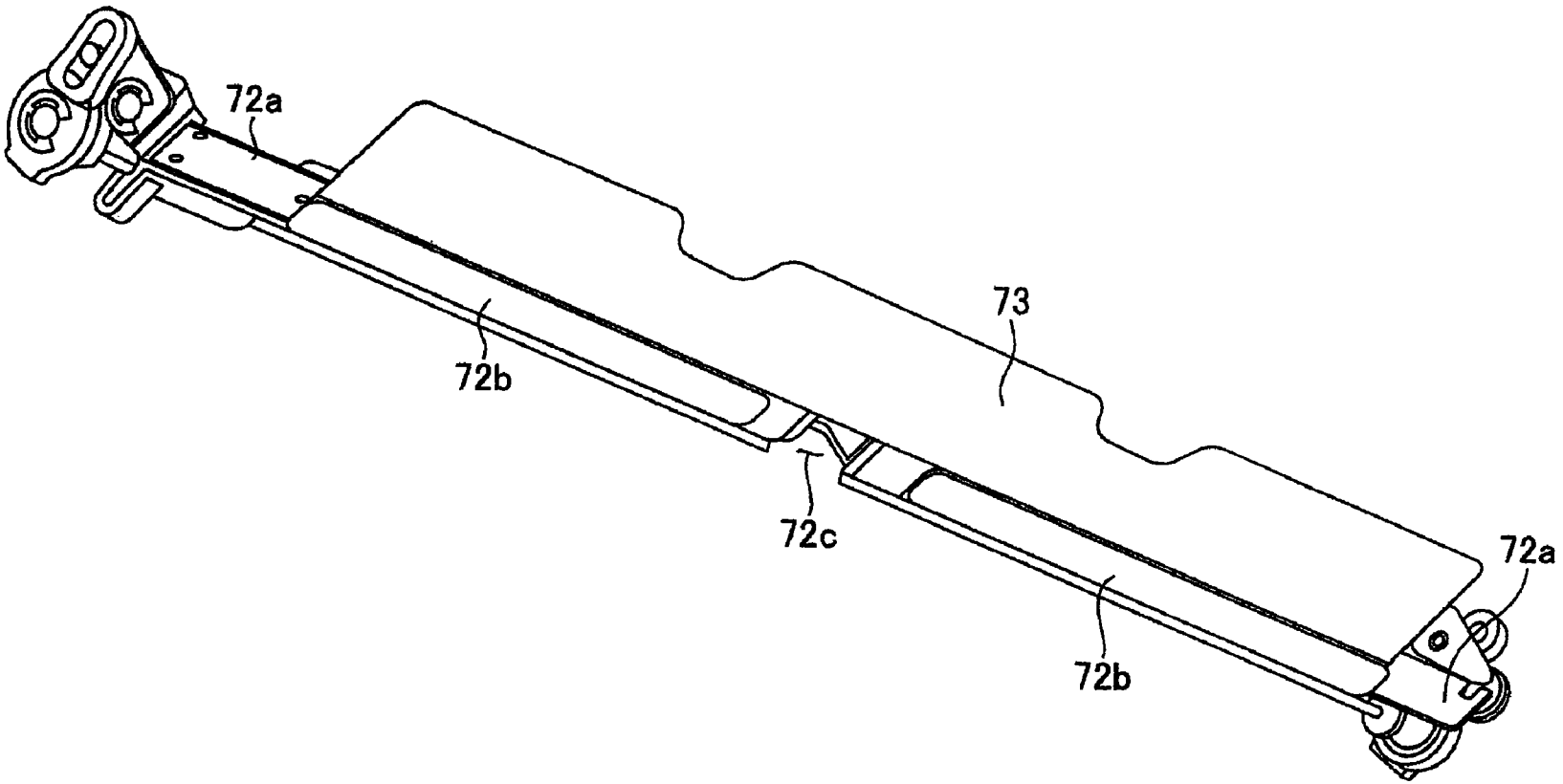
FIG. 26 is a second diagram illustrating the elastic member disposed in the nipping plate.

The initial operation is performed for the above-mentioned purposes. However, in order to reduce the impact sound generated due to the collision of the bottom plate 72*a* and the sheet loading base 715, in the sheet folding apparatus 30 according to this embodiment, the elastic member 72*b* is disposed on the surface, facing the sheet loading base 715, of the bottom plate (nipping plate) 72*a* as shown in FIGS. 25 and 26.

The elastic member 72*b* is a plate-like elastomer such as a cushion member or a rubber member. By bonding the elastic member 72*b* to the surface, facing the sheet loading base 715, of the bottom plate (nipping plate) 72*a*, for example, by the use of a double-sided tape, it is possible to prevent the generation of the impact sound.

Even in the normal operation of reinforcing the folding of a sheet bundle, it is possible to further prevent the lateral misalignment of the sheet bundle by the use of the elastic member 72*b*.

Since the elastic member 72*b* is bonded to the almost entire surface of the bottom plate 72*a* of the conveyance guide 72 but notches 72*c* are formed at the center of the bottom plate 72*a*, the elastic member is divided into two parts about the notches 72*c*.

Figure 27A:
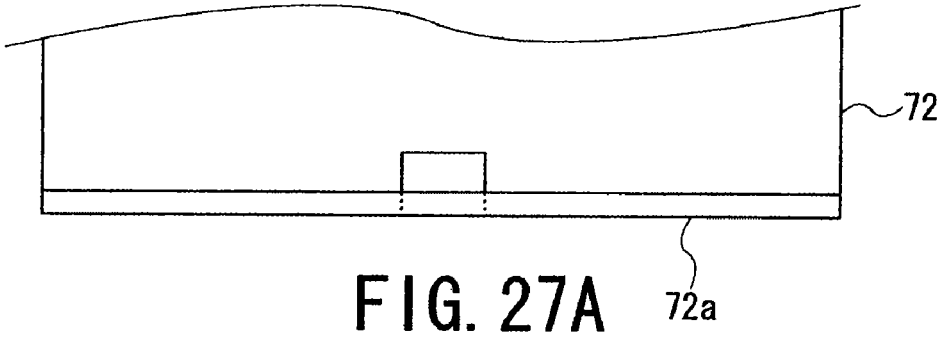
FIGS. 27A to 27C are diagrams illustrating a notch formed in the nipping plate.
Figure 27B:
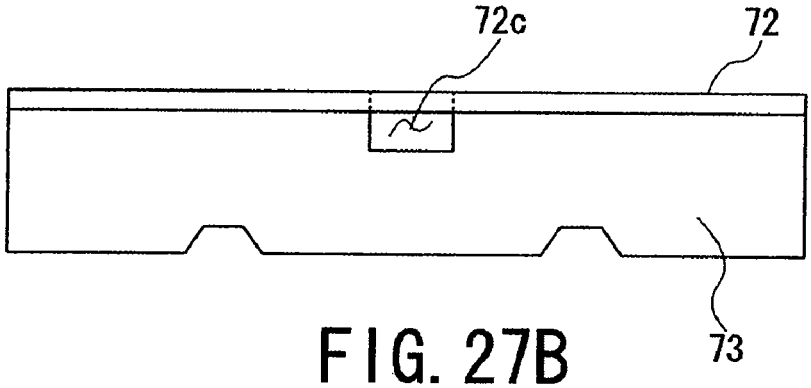
Figure 27C:
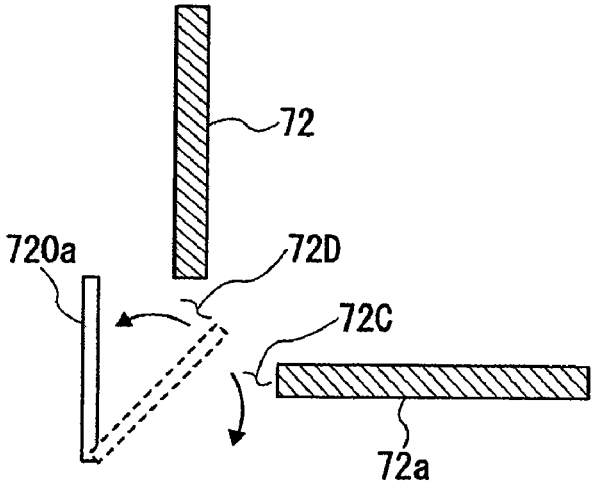

As shown in FIGS. 27A, 27B, and 27C, the notches 72*c* is disposed so that the sensor lever 720*a* of the fold reinforcing position sensor 720 does not interfere with the conveyance guide 72 even in the state where the conveyance guide 72 moves down. Even when the conveyance guide 72 moves down but no sheet bundle is conveyed, the sensor lever 720*a* can return to its upright posture by the notches 72*c*, thereby satisfactorily detecting the presence or absence of the sheet bundle.

Another elastic member 72*d* may be disposed in the sheet loading base 715 in addition to the bottom plate 72*a* of the conveyance guide 72. In this case, it is preferable that the elastic member 72*d* is buried in the sheet loading base 715 so as not to hinder the conveyance of the sheet bundle. That is, it is preferable that a second elastic member 72*d* of the sheet loading base 715 (in the lower side) is directed to the elastic member 72*b* of the bottom plate 72*a* (in the upper side) and does not protrude from the surface of the sheet loading base 715.

Further in this case, the frictional coefficient of the second elastic member disposed in the sheet loading base 715 (in the lower side) is preferably lower than the frictional coefficient of the elastic member 72*b* disposed in the bottom plate 72*a* of the conveyance guide 72 (in the upper side). As a result, it is possible to prevent the lateral misalignment of the sheet bundle due to the elastic member 72*b* having the high frictional coefficient of the bottom plate 72*a* (in the upper side), while it is also possible to smoothly convey the sheet bundle due to the second elastic member having the low frictional coefficient of the sheet loading base 715.

(6) Operation Sequence

Figure 28:
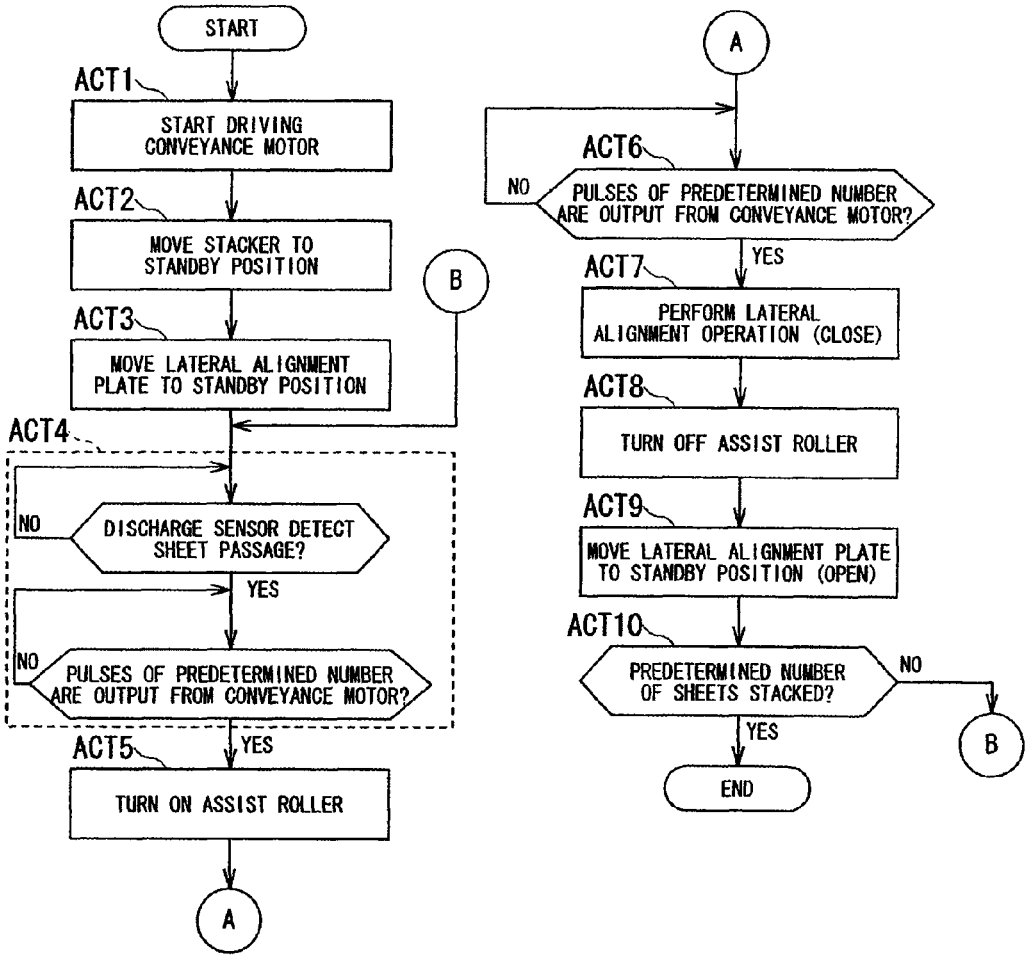
FIG. 28 is a flowchart illustrating an example of an operation sequence of piling and receiving sheets in a stack tray.
Figure 29:
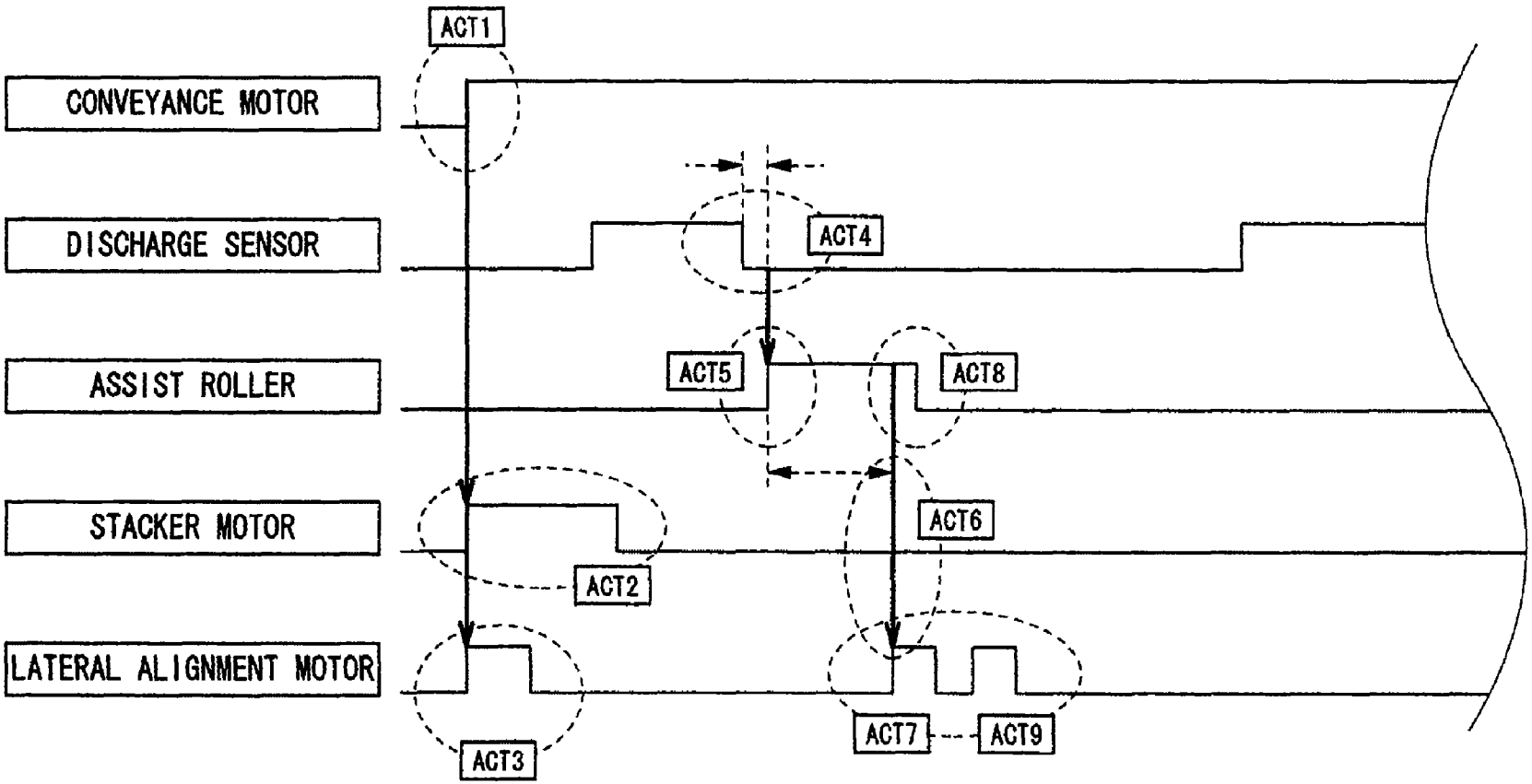
FIG. 29 is a timing diagram illustrating ON and OFF states of the units associated with the operation sequence shown in FIG. 28.

FIG. 28 is a flowchart illustrating an example of an operation sequence of piling and receiving sheets in the stack tray 34. FIG. 29 is a timing diagram illustrating ON and OFF states of the units associated with the operation sequence.

When a discharge signal of a first sheet is output from the image forming apparatus 10, the driving of the conveying motor 301 is started (ACT1) and the stacker 35 and the lateral alignment plates 405*a* and 405*b* are made to move to the standby position (ACT2 and ACT3).

Thereafter, a sheet is sensed by the discharge sensor 333 and when predetermined pulses for allowing the sheet to reach the stack tray 34 pass after the off of the sensor is detected (ACT4), the solenoid 334 is turned on (ACT5).

By turning on the solenoid 334, the assist roller 332 conveys the sheet conveyed from the stack tray 34 to the stacker 35. When the conveying motor 301 is driven again by predetermined pulses after the solenoid 334 is turned on (ACT6), the lateral alignment motor 401 starts its driving and performs an operation of laterally aligning the sheets (ACT7).

When the conveying motor 301 is driven again by the predetermined pulses after starting the driving of the lateral alignment motor 401, the solenoid 334 is turned off (ACT8). Thereafter, when the lateral alignment operation is ended, the lateral alignment motor 401 is made to rotate in the opening direction which is the opposite direction into the standby position (ACT9). These processes are repeated until a designated number of sheets are stacked in the stacker 35 (ACT10).

After the trailing edge of the sheet is sensed by the discharge sensor 333 in ACT4, when the sheet in process is the first sheet, the conveyance speed is reduced. This is because the friction is small due to no sheet on the stack tray 34 in case of the first sheet and the sheet is flied too high when the sheet is discharged from the discharge roller 33 as the final roller in the conveyance path onto the stack tray 34. In case of the second and subsequent sheets, a sheet is remains on the stack tray 34. Accordingly, it is not necessary to reduce the speed due to the friction existing between the sheets.

The period of time when the assist roller 332 is turned on from ACT5 to ACT8 varies depending on the sheet size designated from the image forming apparatus 10. This is because the sheet receiving position in the stacker 35 varies depending on the sheet size.

The predetermined pulses in ACT6 vary depending on the first sheet or the second and subsequent sheets. This is because in the lateral alignment (operation) using the lateral alignment plates 405*a* and 405*b*, it is necessary to bring the assist roller 332 into contact with the edges of the sheets in the conveyance direction in the state where the assist roller is located at the standby position and thus the driving of the lateral alignment (operation) ACT7 is ended prior to ACT8 in which the assist roller 332 is turned off by a predetermined time.

Figure 30:
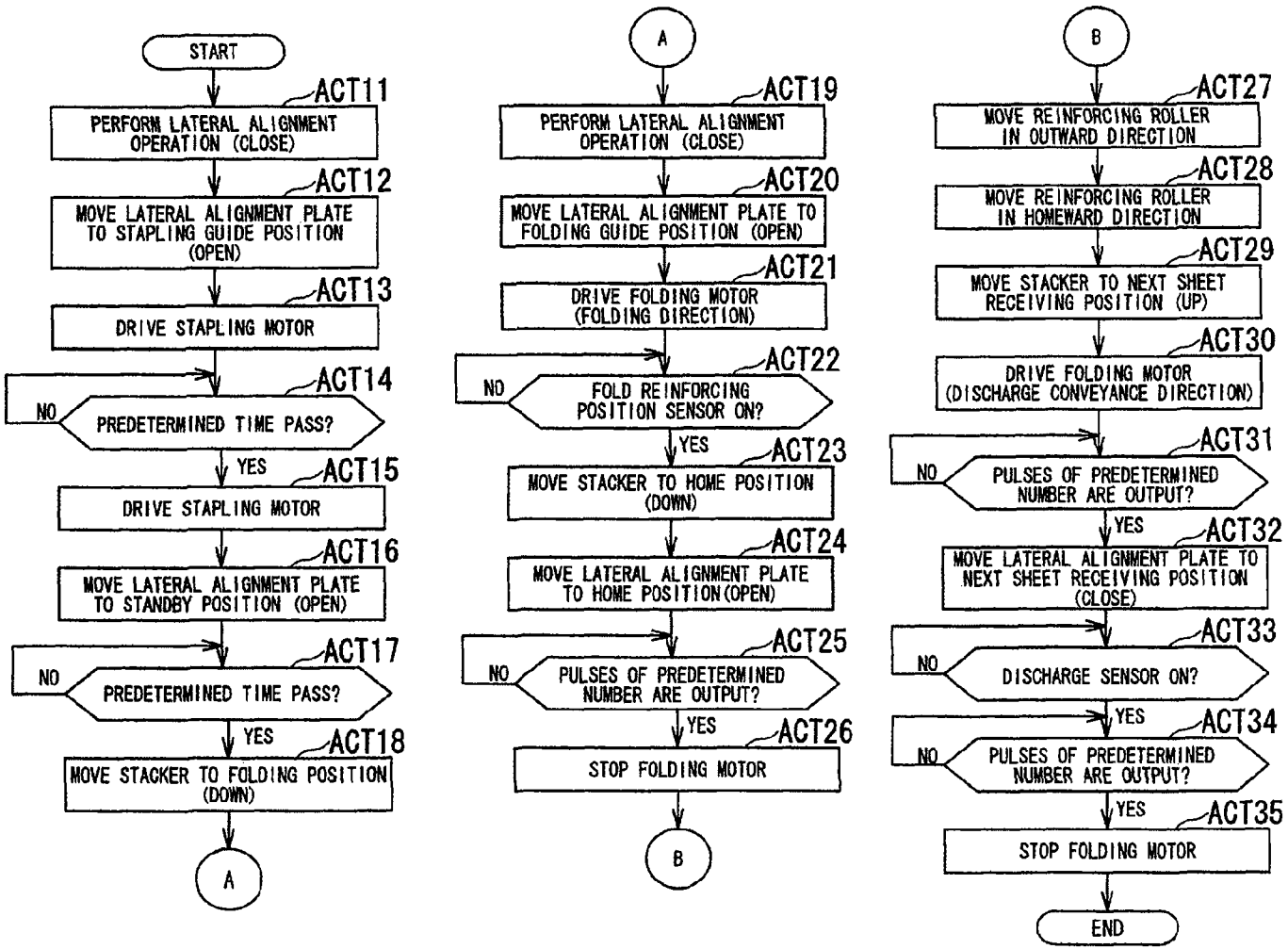
FIG. 30 is a flowchart illustrating an example of an operation sequence of saddle-stitching and folding.
Figure 31:
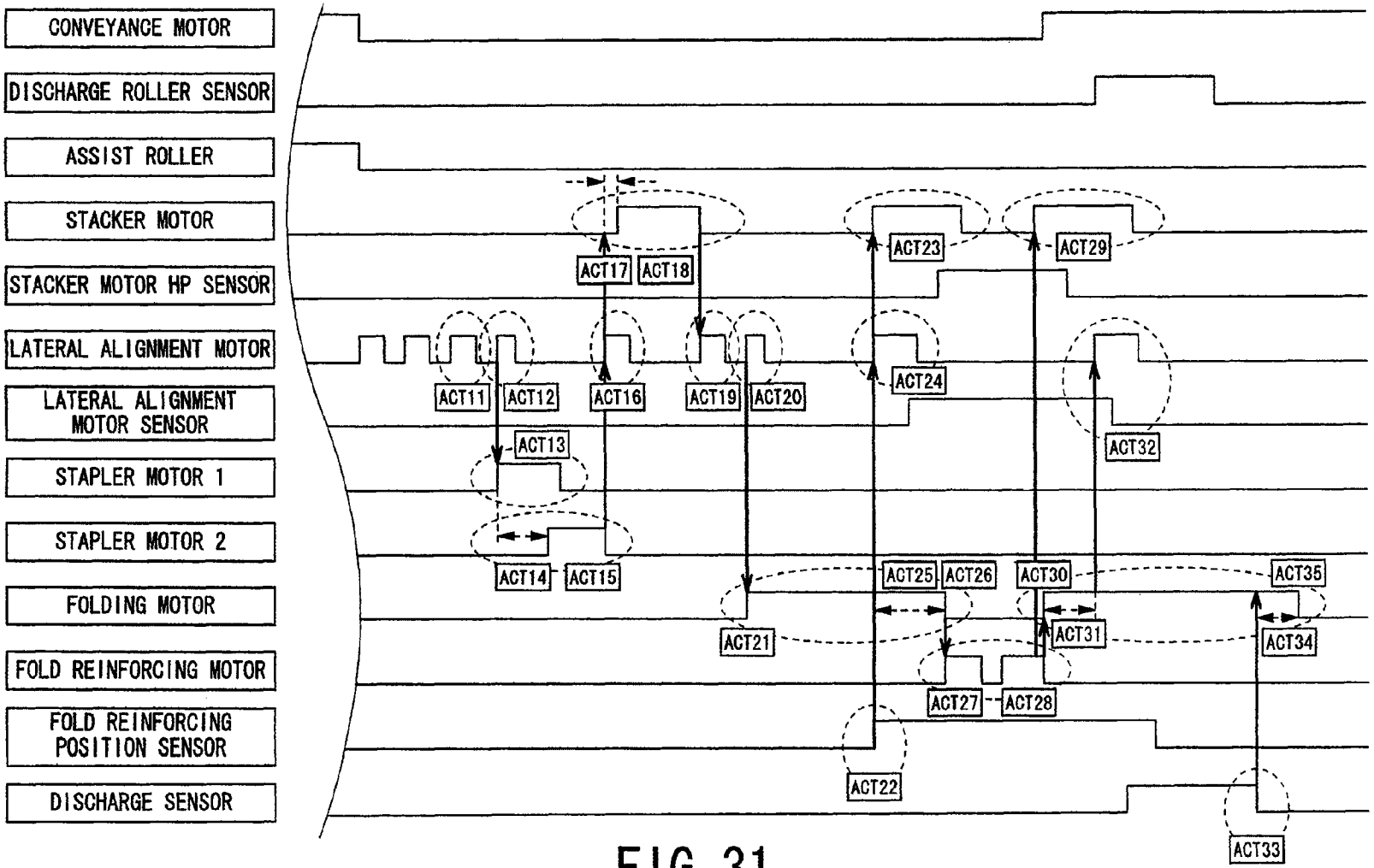
FIG. 31 is a timing diagram illustrating ON and OFF states of the units associated with the operation sequence shown in FIG. 30.

FIG. 30 is a flowchart illustrating an example of an operation sequence of the saddle-stitching and the folding. FIG. 31 is a timing chart illustrating ON and OFF states of the units associated with the operation sequence.

When the operation of ACT10 in FIG. 28, in which sheets are stacked and received on the stack tray 34, is ended, the lateral alignment operation is performed again (ACT11). Thereafter, the lateral alignment plates 405*a* and 405*b* are slightly driven in the opening direction to the guide position for stapling (ACT12) (see FIG. 6B). At the same time as starting ACT12, the deep-side staple motor of both staple motors is driven to perform the stitching (ACT13). In a predetermined time after the driving of the staple motor is started in ACT13 (ACT14), the front-side staple motor is driven to complete the stitching (ACT15).

When the stitching using both staplers is completed, the lateral alignment motor drives the lateral alignment plates 405*a* and 405*b* in the opening direction to move from the stapling guide position to the standby position (ACT16). In a predetermined time after the driving of the lateral alignment motor is started in ACT16 (ACT17), the stacker motor 200 drives the stacker 35 to move from the stapling position (sheet receiving position) to the folding position (ACT18) for performing a bundle conveying (operation).

After the bundle conveying (operation) is ended, the lateral alignment motor drives the respective lateral alignment plates 405*a* and 405*b* forwardly again to perform the lateral alignment (operation) (ACT19) and then drives them slightly in the opening direction to the guide position for performing the folding (operation) (ACT20) (see FIG. 6B).

At the same time as starting ACT20, the folding motor 800 and the electromagnetic clutch 900 are turned on to start the folding (operation) (ACT21). Since a great torque is required for performing the folding (operation) of the folding motor 800 and thus the load applied to the electromagnetic clutch 900 is also great, the driving of the folding motor 800 may be started in a predetermined time after the electromagnetic clutch 900 is turned on.

When the folding is performed, the discharge conveyance using the folding roller pair 38 is performed, and then the fold reinforcing position sensor 720 detects the sheet bundle (ACT22), the stacker motor 200 and the lateral alignment motor 401 are driven to the HP (ACT23 and ACT24). Meanwhile, when the folding roller pair 38 is driven in the predetermined pulses after the detection of the fold reinforcing position sensor 720 in ACT22 and thus the leading edge of the sheet bundle reaches the fold reinforcing position (ACT25), the driving of the folding motor 800 is stopped and thus the sheet bundle is stopped at the fold reinforcing position (ACT26).

When the sheet bundle is stopped at the fold reinforcing position, the fold reinforcing motor 81 is driven to allow the fold reinforcing roller 51 to move from the HP to the opposite side (ACT27) and to move from the opposite side of the HP to the HP again (ACT28) to perform the fold reinforcing.

When a next job remains, the stacker motor 200 is driven to move the stacker 35 to the sheet receiving position (ACT29) in the course of performing the fold reinforcing in ACT28.

When the fold reinforcing is ended, the folding motor 800 is driven to start a discharge conveyance (operation) (ACT30). When a next job remains and a predetermined number of the pulses are counted after the driving of the folding motor is started (ACT31), the lateral alignment motor is driven to move the lateral alignment plates 405*a* and 405*b* to the next sheet receiving position (ACT32).

After the turning-off of the discharge sensor is detected (ACT33) by performing the discharge conveyance (operation), the folding motor is stopped (ACT35) in the predetermined pulses (ACT34).

When a next job remains, the operation of ACT4 in FIG. 28 is performed again. When no next job remains, the operation is ended and a stop command from the image forming apparatus 10 is waited for.

Figure 32:
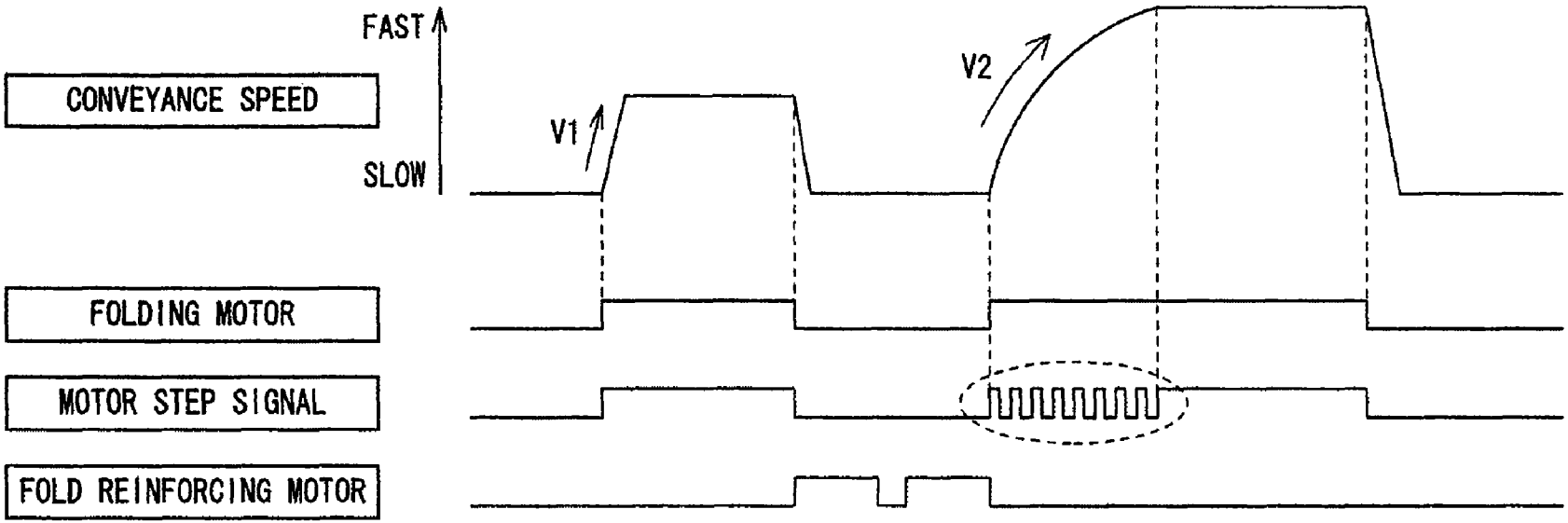
FIG. 32 is a diagram illustrating details of a driving control of a folding motor.

The driving control of the folding mechanism in ACT21 and ACT30 in FIG. 30 will be described now with reference to FIG. 32. As described above, if the driving is suddenly started at a high speed at the time of starting the conveyance again after the conveyance of the sheet bundle is once stopped, wrinkles may be generated in the sheet bundle. Accordingly, in the driving control in ACT21 and ACT30 in FIG. 30, by performing the PWM control on the motor step signal of the folding motor 800 as shown in FIG. 32, the control of enhancing the speed up to the maximum speed with the acceleration of V2 smaller than the acceleration V1 of the rotation of the folding motor 800 at the time of the folding control is performed at the time of starting the rotation of the discharge conveyance.

Figure 33:
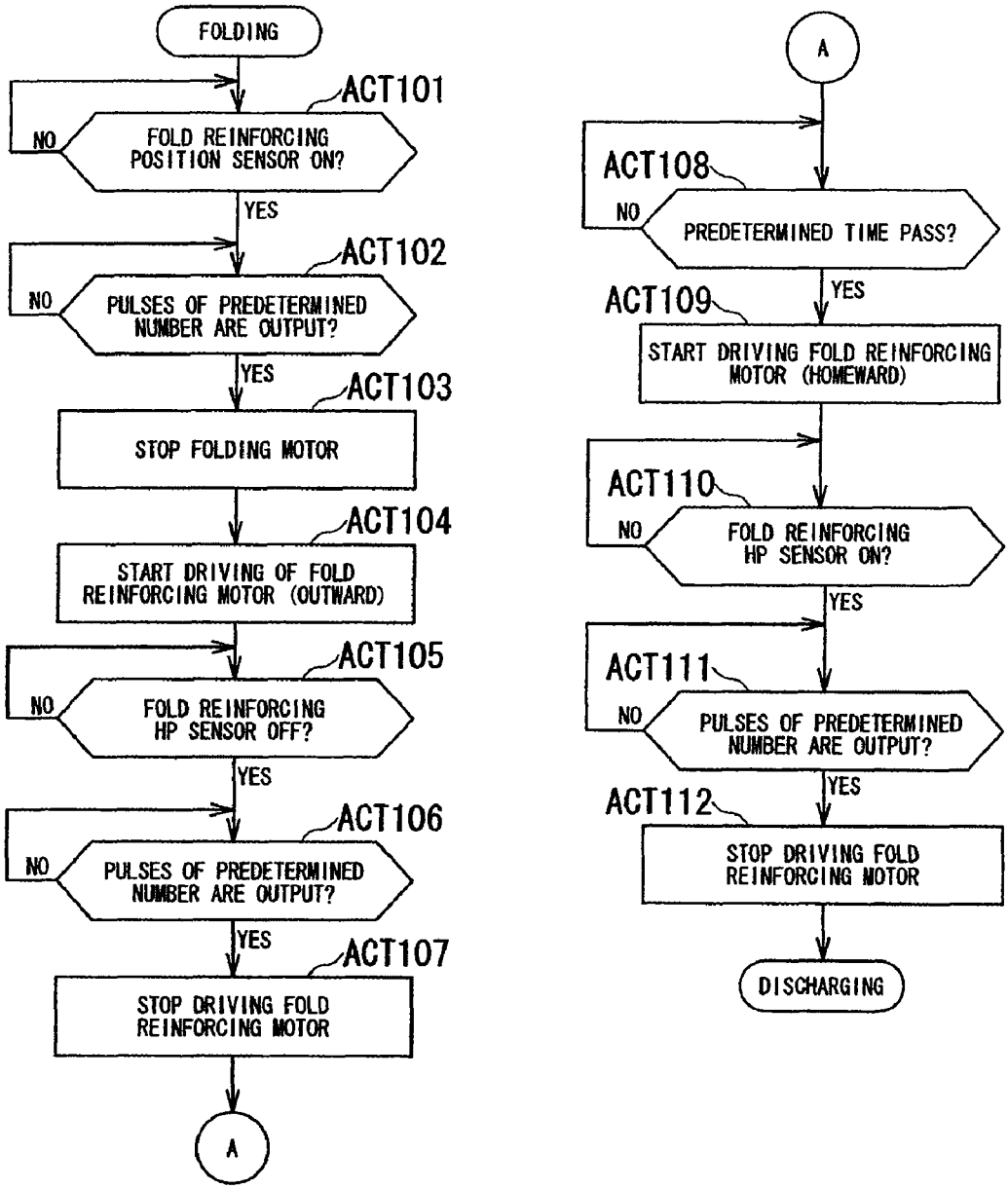
FIG. 33 is a flowchart illustrating an example of an operation sequence of fold reinforcing.
Figure 34:
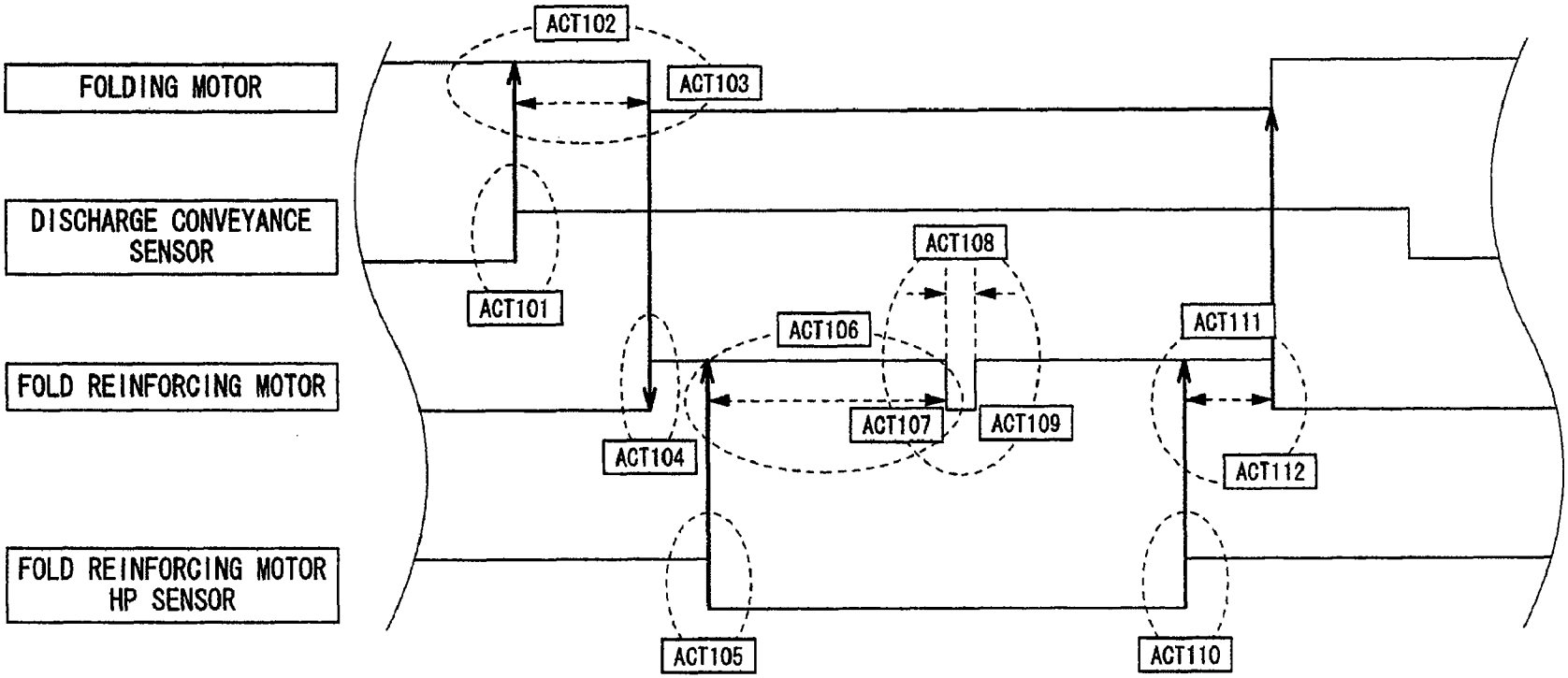
FIG. 34 is a timing diagram illustrating ON and OFF states of the units associated with the operation sequence shown in FIG. 33.

Now, the driving control of the fold reinforcing unit 50 in ACT22 to ACT28 in FIG. 30 will be described with reference to FIGS. 33 and 34.

The sheet bundle is folded and inserted into the folding roller pair 38 by the folding blade 37 and the turning-on of the fold reinforcing position sensor 720 is detected (ACT101). When predetermined pulses pass after the detection of the fold reinforcing position sensor 720 (ACT102), the folding motor 800 is stopped to stop the sheet bundle at the fold reinforcing position (ACT103). Thereafter, the forward driving of the fold reinforcing motor 81 is started (ACT104), the turning-off of the fold reinforcing motor HP sensor is detected (ACT105), predetermined pulses pass (ACT106), and then the fold reinforcing motor is stopped (ACT107). When a predetermined time passes after the fold reinforcing motor 81 is stopped (ACT108), the backward driving of the fold reinforcing motor 81 is started (ACT109), the turning-on of the fold reinforcing motor HP sensor is detected (ACT110), predetermined pulses pass (ACT111), the fold reinforcing motor is stopped (ACT112), and the discharge is performed.

(7) Speed Control of Fold Reinforcing Roller Unit

As described above, the sheet bundle is not conveyed onto the sheet loading base 715 in the initial operation. Accordingly, if the elastic member 72*b* is not disposed on the bottom plate (nipping plate) 72*a* of the conveyance guide 72, when the roller unit 60 goes away from the home position, the bottom plate 72*a* of the conveyance guide 72 collides with the sheet loading base 715 directly, thereby generating an impact sound.

A similar impact sound may be generated between the fold reinforcing roller pair 51*a* and 51*b* of the roller unit 60. The fold reinforcing roller pair 51*a* and 51*b* applies a strong force to each other to reinforce the fold. When the speed at which the roller unit 60 goes away from the home position is great, the speed at which the fold reinforcing roller pair 51*a* and 51*b* gets close to each other is great, thereby generating an impact sound at the time of contact. The impact in normal fold reinforcing is absorbed by the sheet bundle nipped by the fold reinforcing roller pair 51*a* and 51*b*. However, in the initial operation, the impact cannot be satisfactorily absorbed because only the flexible members 73 and 74 formed of a polyethylene terephthalate (PET) film or the like are interposed therebetween.

When the fold reinforcing roller pair 51*a* and 51*b* is contacted with each other and driven in the state where the sheet bundle does not exist, a great sliding noise is also generated.

Figure 35:
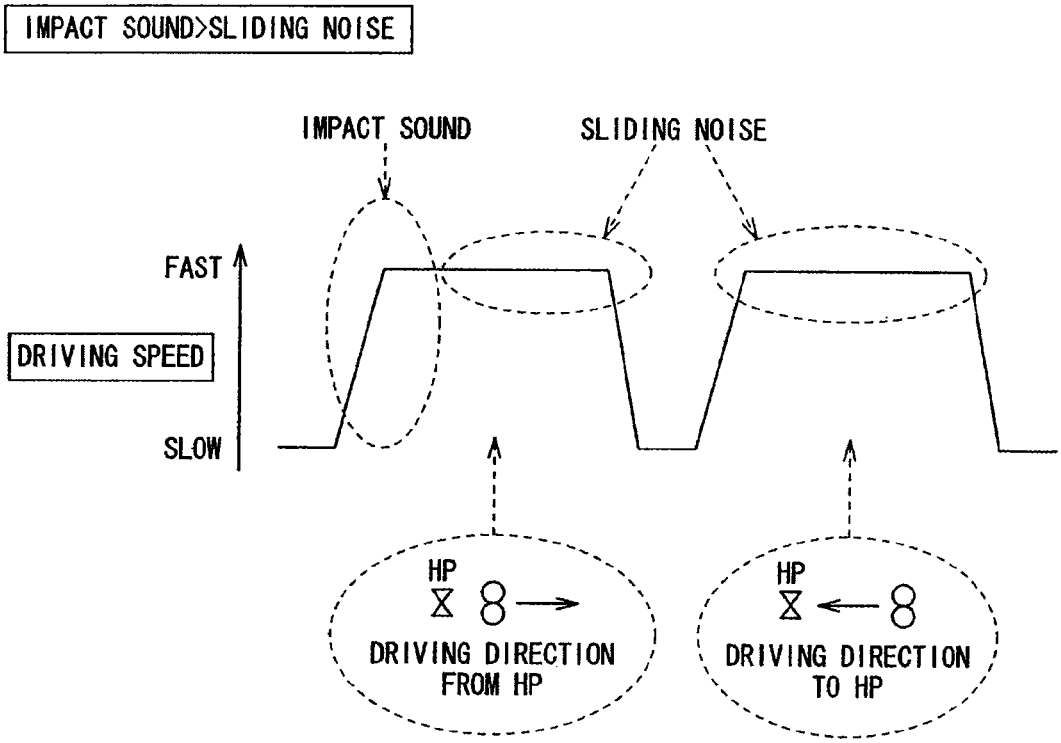
FIG. 35 is a diagram illustrating a speed control of the roller unit in normal operation.

FIG. 35 is a diagram schematically illustrating the generation of the impact sound or the sliding noise when the fold reinforcing roller pair 51*a* and 51*b* is made to reciprocate from the home position in the state where the sheet bundle does not exist. As shown in FIG. 35, the impact sound is generated just after the fold reinforcing roller pair 51*a* and 51*b* goes away from the home position. In general, the impact sound is louder than the sliding noise.

In the sheet folding apparatus 30 according to this embodiment, the speed control of the roller unit 60 is performed to suppress the impact sound or the sliding noise. In the state where the sheet bundle does not exist as in the initial operation, the speed is controlled to be lower than the normal moving speed.

Since the initial operation is performed before actually saddle-stitching or folding sheets, there is no problem even when the speed of the roller unit 60 may be set lower than the normal speed.

Figures 36A, 36B:
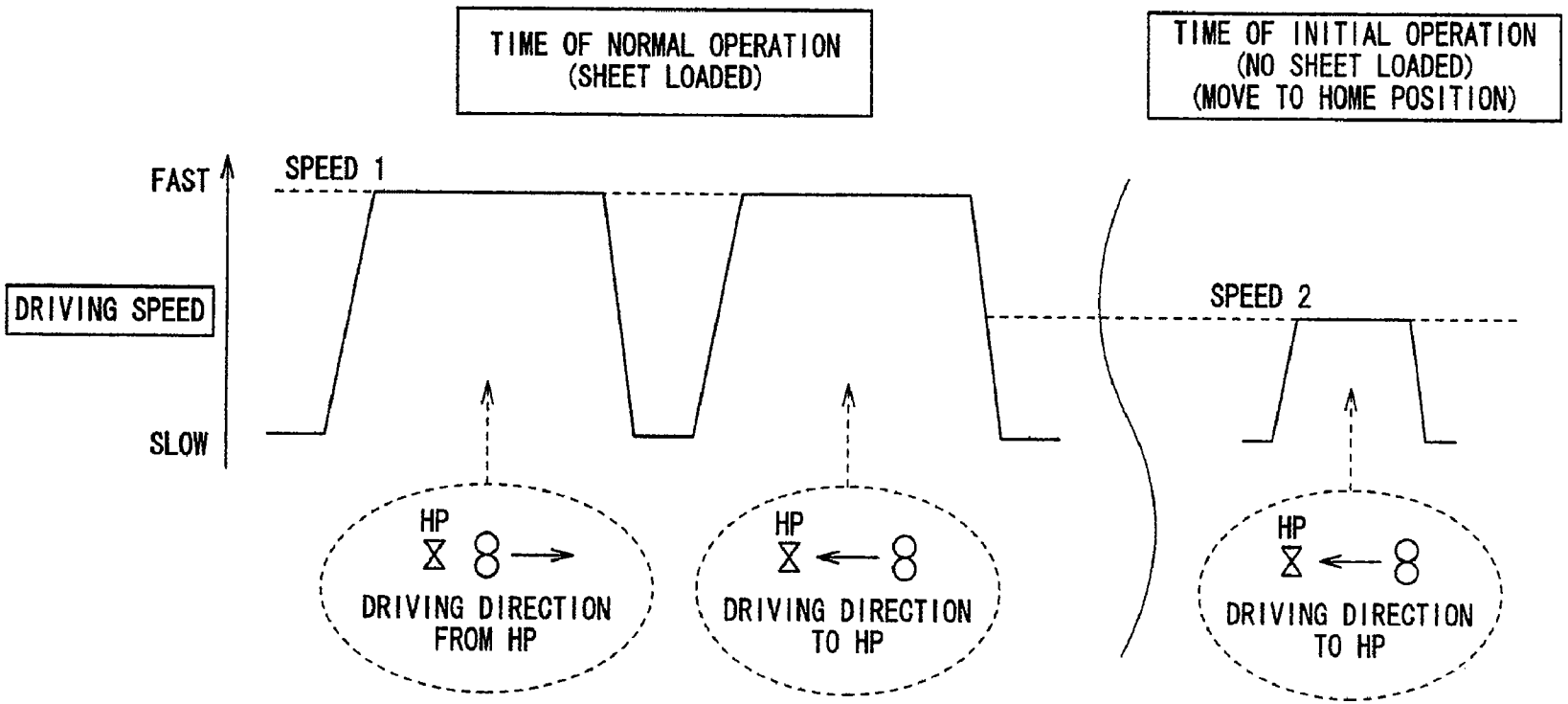
FIGS. 36A and 36B are diagrams illustrating a first example of the speed control of the roller unit in a state where no sheet bundle exists.

FIGS. 36A and 36B are diagrams illustrating a first example of the speed control. FIG. 36A illustrates a speed pattern of the normal operation when the sheet bundle exists for the purpose of comparison and FIG. 36B is a diagram illustrating the first example of the speed control according to this embodiment. The first example of the speed control is a speed control when the sheet bundle does not exist and the roller unit 60 is stopped at a position other than the home position and returns to the HP (Home Position) from the stopped state. In this case, speed 2 for returning to the HP from the stopped state is set lower than speed 1 for the normal operation. As a result, the sliding noise is reduced.

Figures 37A, 37B:
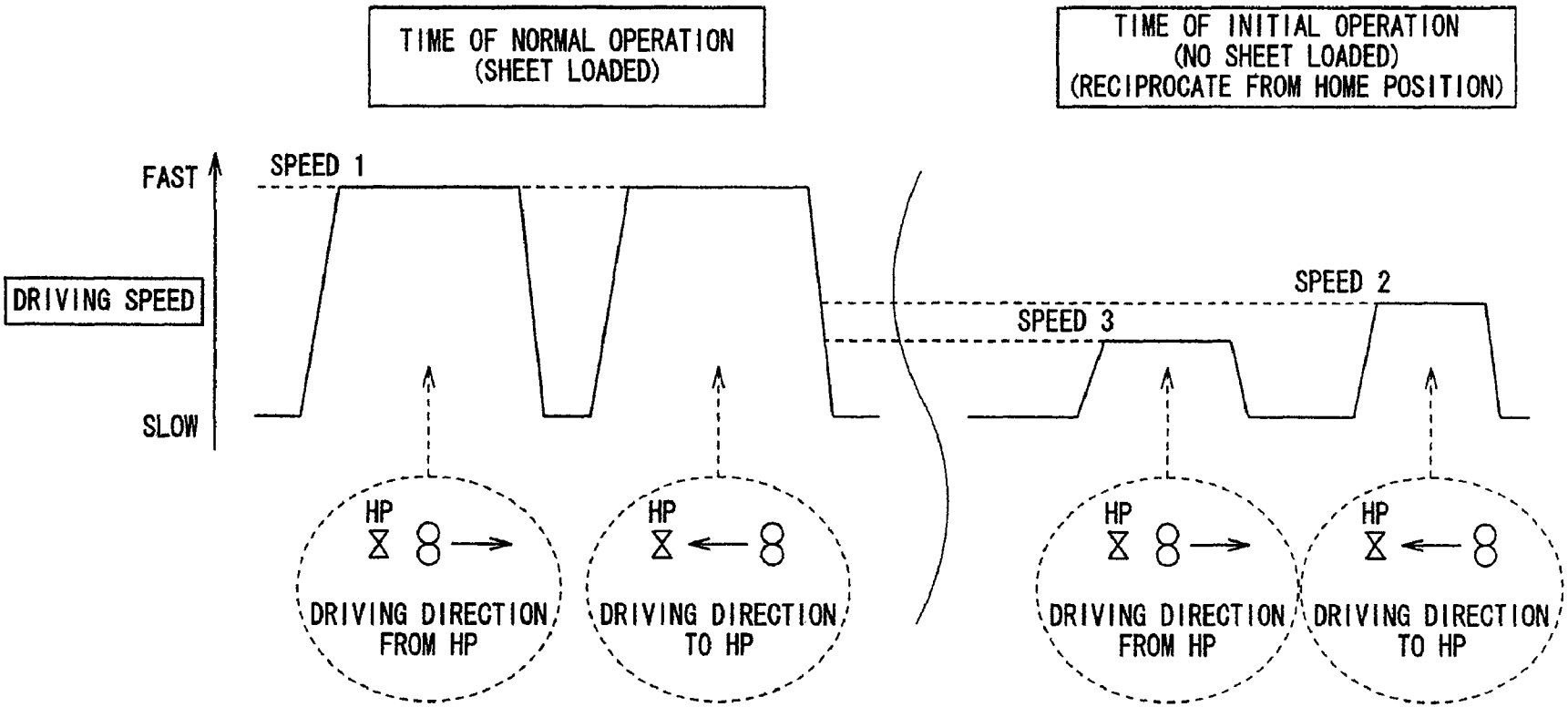
FIGS. 37A and 37B are diagrams illustrating a second example of the speed control of the roller unit in a state where no sheet bundle exists.

FIGS. 37A and 37B are diagrams illustrating a second example of the speed control. FIG. 37A shows a speed pattern of a normal operation for the purpose of comparison.

The second example of the speed control is a speed control when the sheet bundle does not exist and the roller unit 60 is made to reciprocate from the HP. As shown in FIG. 35, the impact sound is generated when the fold reinforcing roller pair 51*a* and 51*b* comes in contact with each other, that is, just after the movement in the traveling path is started. Accordingly, in the second example of the speed control, the moving speed in the traveling path is set to speed 3 lower than speed 2, thereby reducing the impact sound. Since the impact sound is not generated in the return path, only the sliding noise is reduced by the use of speed 2.

Figures 38A, 38B:
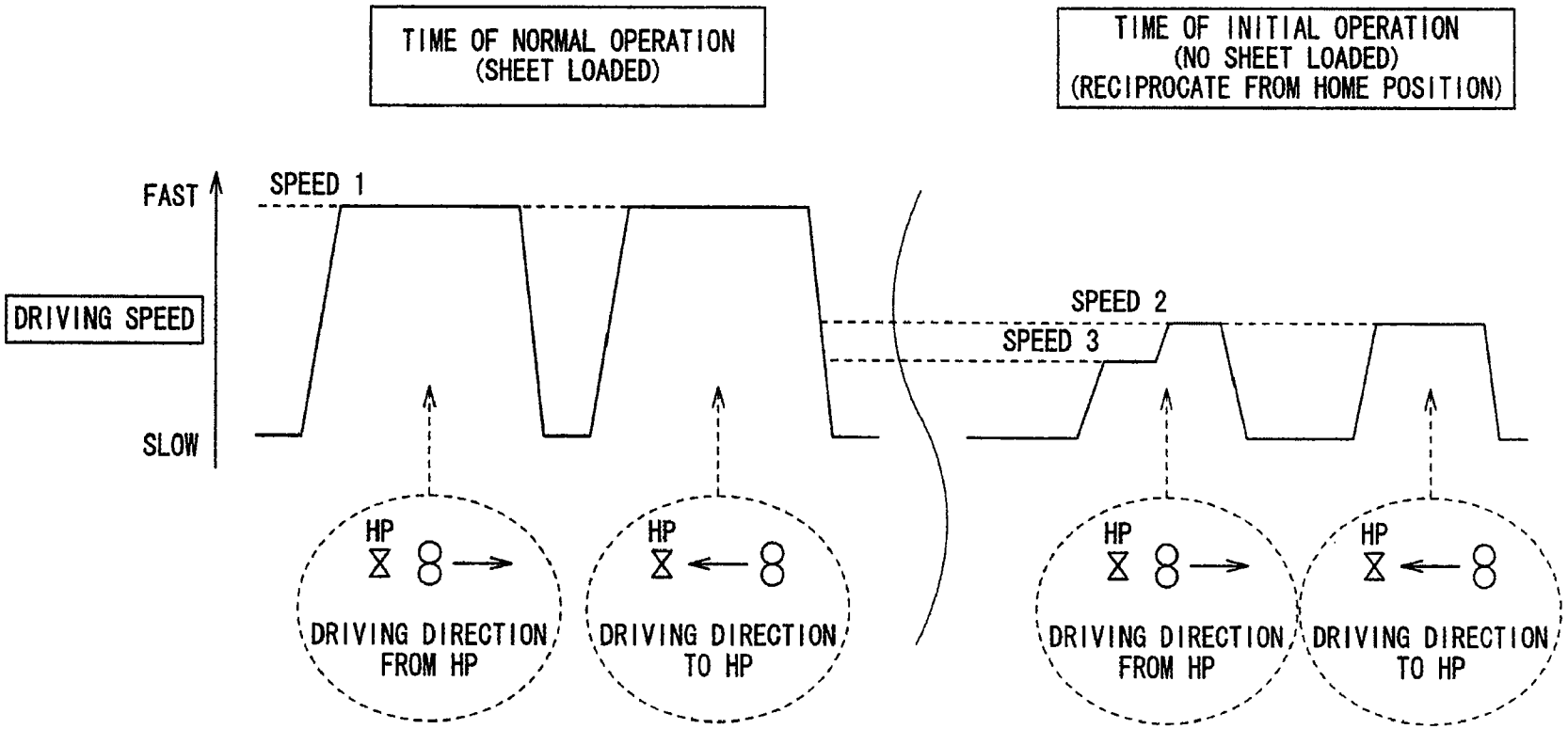
FIGS. 38A and 38B are diagrams illustrating a third example of the speed control of the roller unit in a state where no sheet bundle exists.

FIGS. 38A and 38B are diagrams illustrating a third example of the speed control. FIG. 38A shows a speed pattern for the normal operation for the purpose of comparison. The impact sound is generated due to the contact of the fold reinforcing roller pair 51*a* and 51*b* just after it goes away from the HP, but the impact sound is not generated during the entire period of the traveling path. Accordingly, in the third example of the speed control, the moving speed is set to speed 3 which is the lowest speed only in the initial period of the traveling path and is set to speed 2 in the other period.

By this speed control, it is possible to reduce the impact sound and the sliding noise of the fold reinforcing roller pair 51*a* and 51*b* generated when the sheet bundle does not exist.

The speed of the roller unit 60 is controlled by controlling the rotation speed of the fold reinforcing motor 81. The fold reinforcing motor 81 also serves as a power source of the vertical driving of the bottom plate (nipping plate) 72*a* of the conveyance guide 72. Accordingly, when the above-mentioned speed control of the roller unit 60 is performed, the impact sound between the bottom plate 72*a* of the conveyance guide 72 and the sheet loading base 715 is also reduced.

The situation where the sheet bundle does not exist between the fold reinforcing roller pair 51*a* and 51*b*, may occur not only in the initial operation but also in the normal operation depending on the sheet size.

Figure 39A:
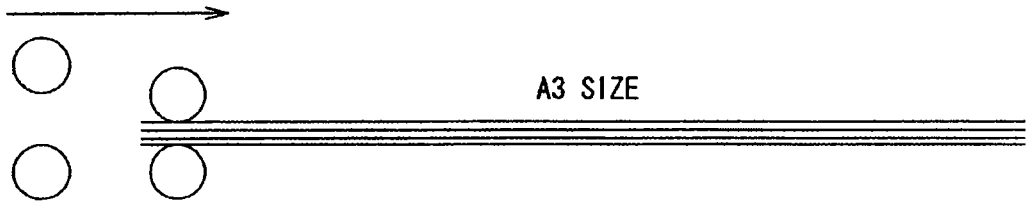
FIGS. 39A and 39B are diagrams illustrating the speed control of the roller unit when the size of the sheet bundle is large.
Figure 39B:
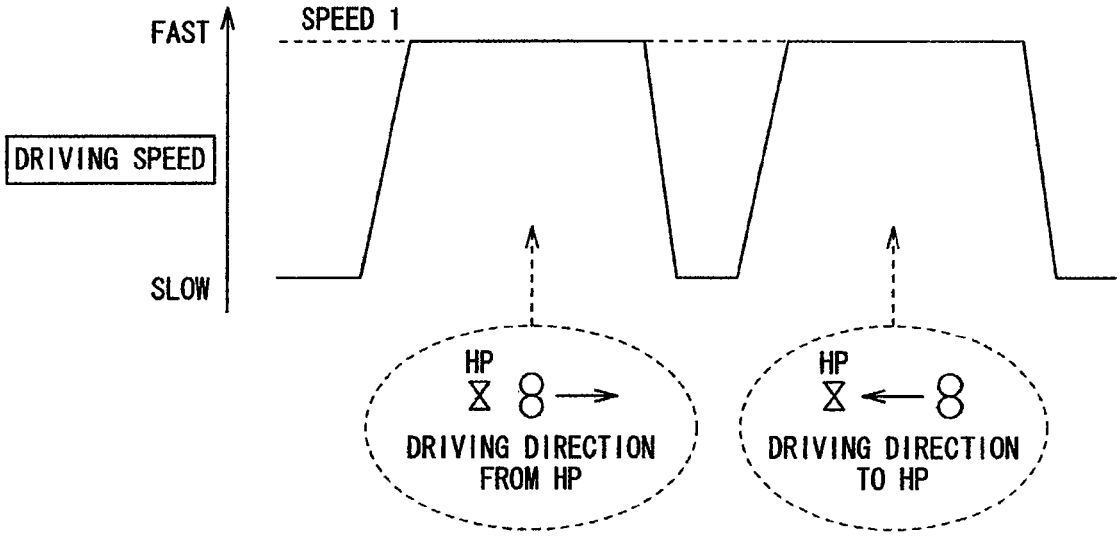

As shown in FIG. 39A, when the fold reinforcing is performed on the sheet of the maximum size (A3 size), the fold reinforcing roller pair 51*a* and 51*b* comes in contact with each other at the edge of the sheet bundle and thus the impact sound and the sliding noise are not generated. In this case, as shown in FIG. 39B, the speed can be set to speed 1 which is the normal speed in both the traveling path and the return path.

Figure 40A:
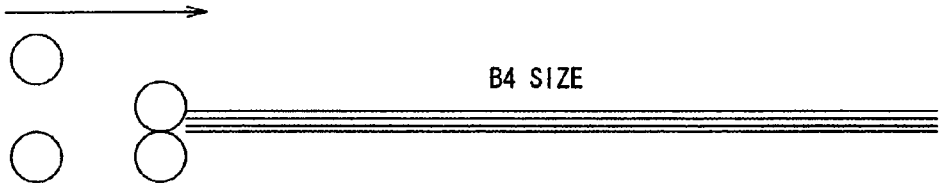
FIGS. 40A and 40B are diagrams illustrating the speed control of the roller unit when the size of the sheet bundle is middle.
Figure 40B:
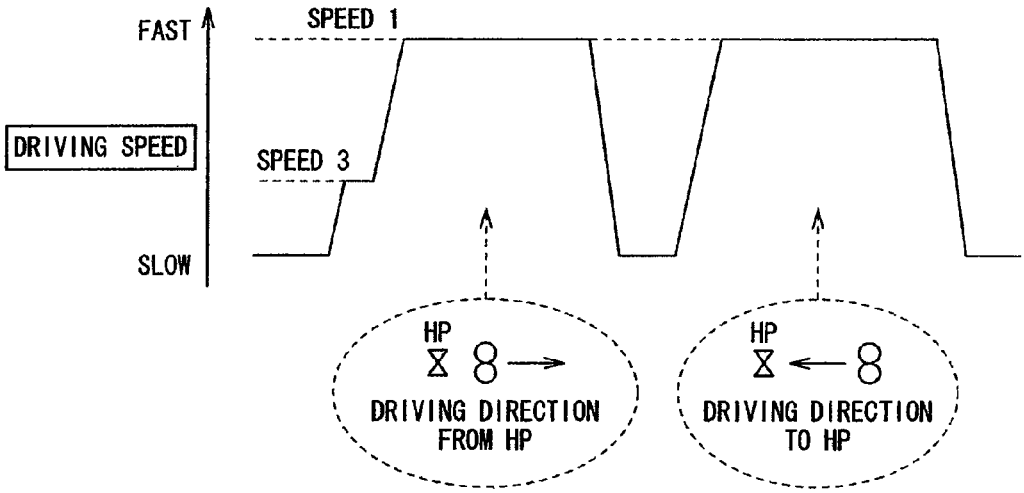

When the sheet size is a B4 size, as shown in FIG. 40A, the fold reinforcing roller pair 51*a* and 51*b* comes in contact with each other at a position slightly apart from the edge of the sheet bundle. In this case, as shown in FIG. 40B, the generation of the impact sound is prevented by setting the speed to speed 3 which is the lowest speed just after the roller unit 60 goes away from the HP. The speed can be set to speed 1 after the fold reinforcing roller pair 51*a* and 51*b* gets over the edge of the sheet bundle.

Figure 41A:
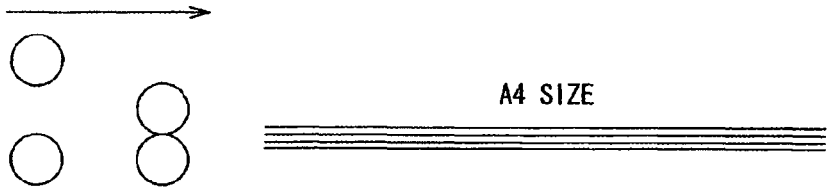
FIGS. 41A and 41B are diagrams illustrating the speed control of the roller unit when the size of the sheet bundle is small.
Figure 41B:
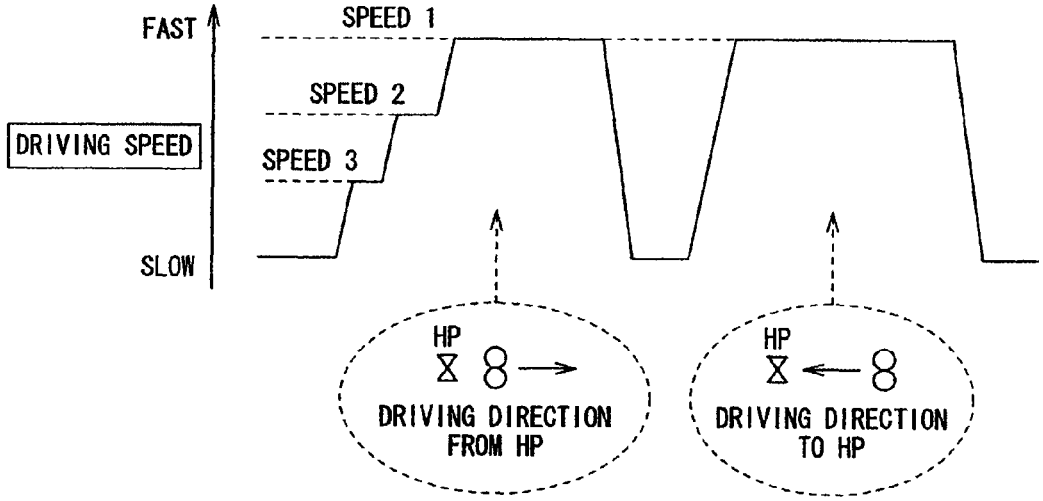

When the sheet size is further smaller like the A4 size, as shown in FIG. 41B, the fold reinforcing roller pair 51*a* and 51*b* comes in contact with each other at a position apart from the edge of the sheet bundle and moves in the region where the sheet bundle does not exist in the contact state for a moment. In this case, the sliding noise is also generated as well as the impact sound. Accordingly, in this case, as shown in FIG. 41B, the generation of the impact sound can be prevented by setting the speed to speed 3 which is the lowest speed just after the roller unit 60 goes away from the HP, the generation of the sliding noise can be prevented by setting the speed to speed 2 until the fold reinforcing roller pair 51*a* and 51*b* gets over the edge of the sheet bundle, and the speed can be set to speed 1 after the fold reinforcing roller pair gets over the edge of the sheet bundle.

As described above, by employing the sheet folding apparatus according to this embodiment, the image forming apparatus using the sheet folding apparatus, and the sheet folding method, it is possible to excellently reinforce the fold while reducing the impact sound and the sliding noise.

The invention is not directly limited to the respective embodiments, and can be embodied by modifying the components within the range not departing from the gist. Besides, various embodiments of the invention of can be formed by suitable combinations of plural components disclosed in the respective embodiments. For example, some components may be deleted from all components disclosed in the embodiment. Further, components of different embodiments may be suitably combined.

What is claimed is:

1. A sheet folding apparatus comprising:

a folding unit configured to fold the sheet bundle at the center to form a fold;

a first roller and a second roller configured to be separated from each other when the first and second rollers are at a home position, and to move along the direction of the fold while nipping the fold when the first and second rollers reinforce the fold; and a driving unit configured to move the first and second rollers at a first speed when the fold is reinforced, and to move the first and second rollers at a second speed slower than the first speed when the sheet bundle does not exist or when the first and second rollers move along without nipping the sheet bundle.

2. The sheet folding apparatus of claim 1, wherein in an initial operation in which the first and second rollers are moved in a situation where the sheet bundle does not exist, the driving unit, when the first and second rollers are at a position other than the home position, moves the first and second rollers to the home position at the second speed.

3. The sheet folding apparatus of claim 1, wherein in an initial operation in which the first and second rollers are moved in a situation where the sheet bundle does not exist, the driving unit, when the first and second rollers reciprocates from the home position, moves the first and second rollers at a third speed slower than the second speed in a outward path and then moves the first and second rollers at the second speed in a homeward path.

4. The sheet folding apparatus of claim 1, wherein in an initial operation in which the first and second rollers are moved in a situation where the sheet bundle does not exist, the driving unit, when the first and second rollers reciprocates from the home position, moves the first and second rollers at a third speed slower than the second speed in an initial period of a outward path and then moves the first and second rollers at the second speed in the outward path other than the initial period and a homeward path.

5. The sheet folding apparatus of claim 1, wherein in an operation in which the fold of the sheet bundle is reinforced, the driving unit moves the first and second rollers at a third speed slower than the second speed until the first and second rollers get over an edge of the sheet bundle after the first and second rollers leave the home position and come in contact with each other, and then moves the first and second rollers at the first speed after getting over the edge of the sheet bundle.

6. The sheet folding apparatus of claim 5, wherein the size of the sheet bundle is B4-size.

7. The sheet folding apparatus of claim 1, wherein in an operation in which the fold of the sheet bundle is reinforced, the driving unit moves the first and second rollers at a third speed slower than the second speed until the first and second rollers complete coming in contact with each other after the first and second rollers leave the home position, then moves the first and second rollers at the second speed until the first and second rollers get over the edge of the sheet bundle after completion coming in contact, and then moves the first and second rollers at the first speed after the first and second rollers get over the edge of the sheet bundle.

8. The sheet folding apparatus of claim 7, wherein the size of the sheet bundle is A4-size.

9. The sheet folding apparatus of claim 1, wherein the first and second rollers nip the sheet bundle without getting over the edge of the sheet bundle, and in an operation in which the fold of the sheet bundle is reinforced, the driving unit moves the first and second rollers at the first speed in a reciprocating movement.

10. The sheet folding apparatus of claim 9, wherein the size of the sheet bundle is A3-size.

11. A sheet folding method comprising:

folding the sheet bundle at the center to form a fold;

separating a first roller and a second roller when the first and second rollers are at a home position, and moving the first and second rollers along the direction of the fold while nipping the fold when the first and second rollers reinforce the fold; and moving the first and second rollers at a first speed when the fold is reinforced, and moving the first and second rollers at a second speed slower than the first speed when the sheet bundle does not exist or when the first and second rollers move along without nipping the sheet bundle.

12. The sheet folding method of claim 11, wherein in an initial operation in which the first and second rollers are moved in a situation where the sheet bundle does not exist, when the first and second rollers are at a position other than the home position, the first and second rollers are moved to the home position at the second speed.

13. The sheet folding method of claim 11, wherein in an initial operation in which the first and second rollers are moved in a situation where the sheet bundle does not exist, when the first and second rollers reciprocates from the home position, the first and second rollers are moved at a third speed slower than the second speed in a outward path and then moved at the second speed in a homeward path.

14. The sheet folding method of claim 11, wherein in an initial operation in which the first and second rollers are moved in a situation where the sheet bundle does not exist, the driving unit, when the first and second rollers reciprocates from the home position, the first and second rollers are moved at a third speed slower than the second speed in an initial period of a outward path and then moved at the second speed in the outward path other than the initial period and a homeward path.

15. The sheet folding method of claim 11, wherein in an operation in which the fold of the sheet bundle is reinforced, the first and second rollers are moved at a third speed slower than the second speed until the first and second rollers get over an edge of the sheet bundle after the first and second rollers leave the home position and come in contact with each other, and then moved at the first speed after getting over the edge of the sheet bundle.

16. The sheet folding method of claim 15, wherein the size of the sheet bundle is B4-size.

17. The sheet folding method of claim 11, wherein in an operation in which the fold of the sheet bundle is reinforced, the first and second rollers are moved at a third speed slower than the second speed until the first and second rollers complete coming in contact with each other after the first and second rollers leave the home position, then moved at the second speed until the first and second rollers get over the edge of the sheet bundle after completion coming in contact, and then moved at the first speed after the first and second rollers get over the edge of the sheet bundle.

18. The sheet folding method of claim 17, wherein the size of the sheet bundle is A4-size.

19. The sheet folding method of claim 11, wherein the first and second rollers nip the sheet bundle without getting over the edge of the sheet bundle, and in an operation in which the fold of the sheet bundle is reinforced, the first and second rollers are moved at the first speed in a reciprocating movement.

20. The sheet folding method of claim 19, wherein the size of the sheet bundle is A3-size.

* * * * *